US009012380B2

(12) United States Patent
Sano et al.

(10) Patent No.: US 9,012,380 B2
(45) Date of Patent: Apr. 21, 2015

(54) LUBRICANT BASE OIL, LUBRICANT COMPOSITION FOR INTERNAL COMBUSTION ENGINE AND LUBRICANT COMPOSITION FOR DRIVING FORCE TRANSMITTING DEVICE

(75) Inventors: Takashi Sano, Yokohama (JP); Hitoshi Komatsubara, Yokohama (JP); Hisayuki Wada, Yokohama (JP); Osamu Kurosawa, Yokohama (JP); Masaaki Itou, Yokohama (JP); Shigeki Matsui, Yokohama (JP); Masato Takahashi, Yokohama (JP); Kai Fu, Yokohama (JP); Shinichi Shirahama, Yokohama (JP); Izuru Sugiura, Yokohama (JP); Masahiro Taguchi, Yokohama (JP); Shozaburo Konishi, Yokohama (JP)

(73) Assignees: Nippon Oil Corporation, Tokyo (JP); Petroleum Energy Center, Tokyo (JP)

( * ) Notice: Subject to any disclaimer, the term of this patent is extended or adjusted under 35 U.S.C. 154(b) by 1903 days.

(21) Appl. No.: 11/794,739

(22) PCT Filed: Jan. 10, 2006

(86) PCT No.: PCT/JP2006/300149
§ 371 (c)(1),
(2), (4) Date: Sep. 28, 2009

(87) PCT Pub. No.: WO2006/073198
PCT Pub. Date: Jul. 13, 2006

(65) Prior Publication Data

US 2010/0035777 A1 Feb. 11, 2010

(30) Foreign Application Priority Data

| | | |
|---|---|---|
| Jan. 7, 2005 | (JP) | P2005-002888 |
| Feb. 2, 2005 | (JP) | P2005-026808 |
| Feb. 3, 2005 | (JP) | P2005-028104 |
| Feb. 10, 2005 | (JP) | P2005-035040 |

(51) Int. Cl.

| | |
|---|---|
| ***C10M 105/02*** | (2006.01) |
| ***C10M 169/04*** | (2006.01) |
| ***C10M 101/02*** | (2006.01) |
| ***C10M 171/00*** | (2006.01) |

(52) U.S. Cl.

CPC ..... *C10M 101/02* (2013.01); *C10M 169/044* (2013.01); *C10M 169/045* (2013.01); *C10M 171/00* (2013.01); *C10M 2203/1025* (2013.01); *C10M 2205/173* (2013.01); *C10M 2207/026* (2013.01); *C10M 2207/283* (2013.01); *C10M 2207/289* (2013.01); *C10M 2209/084* (2013.01); *C10M 2215/064* (2013.01); *C10M 2215/28* (2013.01); *C10M 2219/046* (2013.01); *C10M 2219/066* (2013.01); *C10M 2223/00* (2013.01); *C10M 2223/045* (2013.01); *C10M 2223/049* (2013.01); *C10M 2227/09* (2013.01); *C10N 2220/02* (2013.01); *C10N 2220/022* (2013.01); *C10N 2220/025* (2013.01); *C10N 2220/028* (2013.01); *C10N 2220/033* (2013.01); *C10N 2220/13* (2013.01); *C10N 2230/06* (2013.01); *C10N 2230/10* (2013.01); *C10N 2230/42* (2013.01); *C10N 2230/43* (2013.01); *C10N 2230/52* (2013.01); *C10N 2230/74* (2013.01)

(58) Field of Classification Search

USPC ..... 508/110, 382, 469
See application file for complete search history.

(56) References Cited

U.S. PATENT DOCUMENTS

| | | | | |
|---|---|---|---|---|
| 3,576,898 | A | 4/1971 | Blake | |
| 4,023,980 | A | 5/1977 | Prillieux | |
| 6,500,786 | B1 * | 12/2002 | Hartley et al. | 508/365 |
| 2004/0118744 | A1 | 6/2004 | Daniel et al. | |
| 2006/0027486 | A1 * | 2/2006 | Rosenbaum et al. | 208/180 |
| 2006/0172898 | A1 * | 8/2006 | Roby et al. | 508/485 |

FOREIGN PATENT DOCUMENTS

| | | |
|---|---|---|
| EP | 0 725 130 | 8/1996 |
| EP | 0 978 555 | 2/2000 |
| EP | 0 776 959 B1 | 10/2004 |
| JP | 51-40384 | 4/1976 |
| JP | 63-223094 | 9/1988 |
| JP | 4-36391 | 2/1992 |
| JP | 4-68082 | 3/1992 |
| JP | 4-120193 | 4/1992 |

(Continued)

OTHER PUBLICATIONS

"Axxess Chemicals, LLC PAO 8—Option C Technical Data Sheet," Jan. 15, 2010.

(Continued)

*Primary Examiner* — James Goloboy
(74) *Attorney, Agent, or Firm* — Finnegan, Henderson, Farabow, Garrett & Dunner, LLP

(57) ABSTRACT

The lubricating base oil of the invention is characterized by satisfying at least one of the following conditions (a) or (b).

(a) A saturated compound content of 95% by mass or greater, and a proportion of 0.1-10% by mass of cyclic saturated compounds among the saturated compounds.

(b) The condition represented by the following formula (1).

$$1.435 \leq n_{20} - 0.002 \times kv100 \leq 1.450 \quad (1)$$

wherein $n_{20}$ represents the refractive index of the lubricating base oil at 20° C., and kv100 represents the kinematic viscosity ($mm^2/s$) of the lubricating base oil at 100° C.

4 Claims, No Drawings

(56) References Cited

FOREIGN PATENT DOCUMENTS

| | | | | |
|---|---|---|---|---|
| JP | 8-302378 | | | 11/1996 |
| JP | 9-3463 | | | 1/1997 |
| JP | 2002 275488 | | | 9/2002 |
| JP | 2002-317190 (A) | | | 10/2002 |
| JP | 2003-505533 | | | 2/2003 |
| JP | 2003-155492 | | | 5/2003 |
| JP | 2004-149799 (A) | | | 5/2004 |
| JP | 2004-521976 | | | 7/2004 |
| JP | 2004-521977 | | | 7/2004 |
| JP | 2004-522848 | | | 7/2004 |
| JP | 2004-262979 | | | 9/2004 |
| JP | 2004-262980 | | | 9/2004 |
| JP | 2004-277712 | | | 10/2004 |
| JP | 2004-292684 (A) | | | 10/2004 |
| JP | 2007246659 | A | * | 9/2007 |
| WO | WO 00/14187 | | | 3/2000 |
| WO | WO 02/064710 | | | 8/2002 |
| WO | WO 02/070636 | | | 9/2002 |
| WO | WO 2004/009738 | | | 1/2004 |
| WO | WO 2004/033606 | A1 | | 4/2004 |

OTHER PUBLICATIONS

"Axxess Chemicals, LLC PAO 5—Option A Technical Data Sheet," Jan. 15, 2010.

Shubkin, Ronald L., "Polyalphaolefins," CRC Handbook of Lubrication and Tribology: Theory of Tribology, Jan. 1, 1993, pp. 219-236, XP009108705.

EP Office Action in EP Counterpart Application No. 10 006 926.9-2104 dated Sep. 19, 2011.

European Search Report dated Oct. 7, 2010.

Haus, F., et al., "Primary biodegradability of mineral base oils in relation to their chemical and physical characteristics," *Chemosphere* 45 (2001) 983-990.

Product Data Sheet "SpectraSyn 2C Polyalphaolefin (PAO) Fluid" Exxon Mobile 2010, XP002595810.

Sharma, B.K., et al., "Effects of hydroprocessing on structure and properties of base oils using NMR," *Fuel Processing Tech.*, 89 (2008) 984-991.

Office Action in Application P2006-003031 issued on Jul. 24, 2012.

Office Action for Counterpart JP Application No. P2012-235085 mailed Jan. 27, 2015.

* cited by examiner

LUBRICANT BASE OIL, LUBRICANT COMPOSITION FOR INTERNAL COMBUSTION ENGINE AND LUBRICANT COMPOSITION FOR DRIVING FORCE TRANSMITTING DEVICE

TECHNICAL FIELD

The present invention relates to a lubricating base oil, a lubricating oil composition for an internal combustion engine, and a lubricating oil composition for a power train device.

BACKGROUND ART

It has been a goal in the field of lubricating oils to improve the properties of lubricating oils, including the viscosity-temperature characteristic and heat and oxidation stability, by addition of various additives such as highly refined mineral oils to the lubricating base oils (see Patent documents 1-3).

For example, lubricating oils used for internal combustion engines such as automobile engines must exhibit heat and oxidation stability to withstand used for long periods under severe conditions. In order to ensure heat and oxidation stability for conventional internal combustion engine lubricating oils, it is common to use high performance base oils which include highly refined base oils as represented by hydrocracked mineral oils and synthetic oils, and to mix with the base oils peroxide-decomposing sulfur-containing compounds such as zinc dithiophosphate (ZDTP) or molybdenum dithiocarbaminate (MoDTC), or ashless antioxidants such as phenolic or amine antioxidants (for example, see Patent documents 1 and 4-6).

In recent years it has become a major goal to achieve energy reduction, i.e. improved fuel efficiency, for automobiles, construction equipment, agricultural machinery and the like in the light of environmental issues such as reducing carbon dioxide gas emissions, and it is strongly desirable to devise means of further reducing energy used by power train devices such as transmissions and final reduction gears. One means for achieving increased fuel efficiency in power train devices is to lower the viscosity of the lubricating oil to reduce stirring resistance and friction resistance on the sliding surfaces. Typical transmitting devices such as automobile automatic transmissions and continuously variable transmissions comprise torque converters, wet clutches, gear bearing mechanisms, oil pumps, overpressure control mechanisms and the like, while manual transmissions and final reduction gears comprise gear bearing mechanisms, and it is possible to realize fuel savings by lowering the viscosity of the lubricating oils used therein to lower the stirring resistance and friction resistance, thus improving power transmission efficiency. However, lowering the viscosity of lubricating oils also leads to lower lubricity (antiwear property, anti-seizing properties and fatigue life), which can cause problems in transmission devices and the like. When phosphorus-containing extreme-pressure agents are added to ensure antiwear property for low-viscosity lubricating oils, the fatigue life is significantly shortened. Sulfur-containing extreme-pressure agents are effective for improving fatigue life, but as is generally known, the effect of the viscosity of the lubricating base oil is greater than that of the additives in low-viscosity lubricating base oils. In order to ensure lubricity with low-viscosity lubricating oils for the purpose of achieving fuel savings, it has therefore been attempted to optimize the combination of phosphorus-containing extreme-pressure agents and sulfur-containing extreme-pressure agents added to lubricating base oils (for example, see Patent documents 7 and 8).

[Patent document 1] Japanese Unexamined Patent Publication HEI No. 4-36391
[Patent document 2] Japanese Unexamined Patent Publication HEI No. 4-68082
[Patent document 3] Japanese Unexamined Patent Publication HEI No. 4-120193
[Patent document 4] Japanese Unexamined Patent Publication SHO No. 63-223094
[Patent document 5] Japanese Unexamined Patent Publication HEI No. 8-302378
[Patent document 6] Japanese Unexamined Patent Publication HEI No. 9-003463
[Patent document 7] Japanese Unexamined Patent Publication No. 2004-262979
[Patent document 8] Japanese Unexamined Patent Publication No. 2004-262980

DISCLOSURE OF THE INVENTION

Problems to be Solved by the Invention

However, with ever increasing demands on the properties of lubricating oils in recent times, it cannot be said that the lubricating base oils described in Patent documents 1-3 are always satisfactory in terms of the viscosity-temperature characteristic and heat and oxidation stability. There have also been limits to the improvement in properties of such conventional lubricating base oils that can be achieved by inclusion of additives.

In the case of a lubricating oil for an internal combustion engine, the conditions of use are even more severe while demands are also higher in terms of the long drain property of the lubricating oil, from the standpoint of effective utilization of resources, reduction of waste oil and lower costs for the lubricating oil user, and the conventional internal combustion engine lubricating oils mentioned above are still in need of improvement to meet these demands. According to research by the present inventors, the lubricating base oils used in conventional internal combustion engine lubricating oils, even though they are called "high performance base oils", are not necessarily satisfactory in terms of their heat and oxidation stability. The heat and oxidation stability can be improved to some degree by increasing the amount of antioxidants added, but this method by itself can only provided limited improvement in heat and oxidation stability.

The conventional power train lubricating oils mentioned above are also in need of improvement in order to meet increasing demands for fuel savings in recent years. Other research by the present inventors has shown that the lubricating base oils used in conventional lubricating oils for power train device, even though they are called "high performance base oils", are also not always satisfactory in terms of their lubricity, viscosity-temperature characteristics and heat and oxidation stability. The methods relying on optimization of additive formulations as described in Patent documents 7 and 8 mentioned above are therefore limited in their ability to provide reduced viscosity within a range that does not impair the properties such as antiwear property, anti-seizing property and fatigue life. Moreover, conventional lubricating oils are also unsatisfactory from the standpoint of shear stability, and prolonged use of lubricating oils containing such lubricating base oils results in impaired lubricity due to viscosity reduction.

The present invention has been accomplished in light of these circumstances, and its object is to provide a lubricating base oil having excellent viscosity-temperature characteristic and heat and oxidation stability, while also allowing additives to exhibit their function to a greater extent when additives are included, as well as a lubricating oil composition comprising the lubricating base oil. It is another object of the invention to provide an internal combustion engine lubricating oil composition with excellent heat and oxidation stability, that allows an adequate "long drain" property to be achieved. It is yet another object of the invention to provide a lubricating oil composition that, even when having a low viscosity, can exhibit a high level of antiwear property, anti-seizing property and fatigue life for long periods, and can provide both fuel savings and durability for power train devices.

Means for Solving the Problems

In order to solve the problems described above, the invention provides a lubricating base oil characterized by having a saturated compound content of at least 95% by mass, wherein the proportion of cyclic saturated compounds among the saturated compounds is 0.1-10% by mass.

If the saturated compound content and the proportion of cyclic saturated compounds of the saturated compounds in the lubricating base oil of the invention satisfy the conditions described above, it is possible to achieve an excellent viscosity-temperature characteristic and excellent heat and oxidation stability. Moreover, when additives have been added to the lubricating base oil, it can exhibit an even higher level of function for the additives while maintaining dissolution of the additives in the lubricating base oil with satisfactory stability.

The lubricating base oil of the invention can also lower the viscous resistance and stirring resistance in a practical temperature range due to the aforementioned viscosity-temperature characteristic, and thereby maximize the effect obtained by addition of friction modifiers and the like. Thus, the lubricating base oil of the invention reduces energy loss in devices in which the lubricating base oil is used, and is therefore extremely useful for achieving energy savings.

The invention further provides a lubricating base oil characterized by satisfying the condition represented by the following formula (1):

$$1.435 \leq n_{20} - 0.002 \times kv100 \leq 1.450 \quad (1)$$

wherein $n_{20}$ represents the refractive index of the lubricating base oil at 20° C., and kv100 represents the kinematic viscosity at 100° C. ($mm^2/s$) of the lubricating base oil.

Thus, a lubricating base oil satisfying the condition represented by formula (1) above can also provide an excellent viscosity-temperature characteristic and excellent heat and oxidation stability, and addition of additives to the lubricating base oil can result in a higher level of function of the additives while sufficiently maintaining stable dissolution of the additives in the lubricating base oil.

The effect of the lubricating base oil satisfying the condition represented by formula (1) above is based on the knowledge of the present inventors that the middle term in formula (1) ($n_{20}-0.002\times kv100$) represents a satisfactory correlation between the saturated compound content of the lubricating base oil and the proportion of cyclic saturated compounds among the saturated compounds, and the properties of the lubricating base oil can be improved if its value is in the range of 1.435-1.450.

The invention further provides a lubricating base oil characterized by having a saturated compound content of 95% by mass or greater wherein the proportion of cyclic saturated compounds among the saturated compounds is 0.1-10% by mass, and/or a lubricating oil composition characterized by comprising a lubricating base oil that satisfies the condition represented by formula (1) above.

Since the lubricating base oil composition of the invention contains a lubricating base oil according to the invention, it has excellent viscosity-temperature characteristic and excellent heat and oxidation stability, while exhibiting a high level of function of additives when additives are included.

The invention still further provides a lubricating oil composition for an internal combustion engine, characterized by containing a lubricating base oil having a saturated compound content of 95% by mass or greater wherein the proportion of cyclic saturated compounds among the saturated compounds is 0.1-10% by mass, an ashless antioxidant which contains no sulfur as a constituent element, and at least one compound selected from among ashless antioxidants comprising sulfur as a constituent element and organic molybdenum compounds.

Since the lubricating base oil in the lubricating oil composition for an internal combustion engine according to the invention has a saturated compound content and a proportion of cyclic saturated compounds among the saturated compounds that satisfy the conditions mentioned above, the oil itself has excellent heat and oxidation stability and low volatility. Moreover, when additives have been added to the lubricating base oil, it can exhibit an even higher level of function for the additives while stably maintaining dissolution of the additives. Also, by adding both an ashless antioxidant containing no sulfur as a constituent element (hereinafter also referred to as "component (A-1)") and at least one compound selected from among ashless antioxidants comprising sulfur as a constituent element and organic molybdenum compounds (hereinafter also referred to as "component (B-1)") to a lubricating base oil having such excellent properties, it is possible to maximize the effect of improvement on the heat and oxidation stability due to synergistic action of components (A-1) and (B-1). Thus, with a lubricating oil composition for an internal combustion engine according to the invention it is possible to achieve a sufficient long drain property.

Since the lubricating base oil in the composition for an internal combustion engine according to the invention has a saturated compound content and a proportion of cyclic saturated compounds among the saturated compounds that satisfy the conditions mentioned above, the oil itself has a superior viscosity-temperature characteristic and excellent frictional properties. The lubricating base oil is also superior in terms of the solubility and effectiveness of additives as mentioned above, and can therefore exhibit a high level of friction reduction when a friction modifier is added. A lubricating oil composition for an internal combustion engine of the invention which contains such a superior lubricating base oil can therefore reduce energy loss caused by friction resistance and stirring resistance at sliding sections, in order to achieve satisfactory energy savings.

Whereas it has been difficult to both improve the low temperature viscosity characteristic and ensure low volatility with conventional lubricating base oils, the lubricating base oil of the invention can achieve a superior balance between both the low temperature viscosity characteristic and low volatility. Consequently, the lubricating oil composition for an internal combustion engine according to the invention is also useful from the viewpoint of improving the cold startability in addition to the long drain property and energy savings in internal combustion engines.

The invention still further provides a lubricating oil composition for an internal combustion engine, characterized by containing a lubricating base oil that satisfies the condition represented by formula (1) below, an ashless antioxidant which contains no sulfur as a constituent element, and at least one compound selected from among ashless antioxidants comprising sulfur as a constituent element and organic molybdenum compounds.

$$1.435 \leq n_{20} - 0.002 \times kv100 \leq 1.450 \quad (1)$$

wherein $n_{20}$ represents the refractive index of the lubricating base oil at 20° C., and kv100 represents the kinematic viscosity at 100° C. ($mm^2/s$) of the lubricating base oil at.

A lubricating base oil satisfying the condition represented by formula (1) above also has excellent heat and oxidation stability, as well as a superior viscosity-temperature characteristic (including low temperature viscosity characteristic), excellent frictional properties and high low volatility, and can exhibit a higher level of function by additives while stably maintaining dissolution of the additives, when additives are included. Thus, a lubricating oil composition for an internal combustion engine which comprises a lubricating base oil satisfying the condition represented by formula (1) above, an ashless antioxidant which contains no sulfur as a constituent element, and at least one compound selected from among ashless antioxidants comprising sulfur as a constituent element and organic molybdenum compounds, can also provide improvement in the long drain property, energy savings and cold startability.

The invention still further provides a lubricating oil composition for a power train device, characterized by comprising a lubricating base oil having a saturated compound content of at least 95% by mass, wherein the proportion of cyclic saturated compounds among the saturated compounds is 0.1-10% by mass, a poly(meth)acrylate-based viscosity index improver, and a phosphorus-containing compound.

Since the lubricating base oil in the lubricating oil composition for a power train device according to the invention has a saturated compound content and a proportion of cyclic saturated compounds among the saturated compounds that satisfy the conditions mentioned above, the oil has an excellent viscosity-temperature characteristic as well as superior heat and oxidation stability and frictional properties, compared to conventional lubricating base oils of similar viscosity grade. Moreover, when additives have been added to the lubricating base oil, it can exhibit an even higher level of function for the additives while stably maintaining dissolution of the additives. Also, by adding both a poly(meth)acrylate-based viscosity index improver (hereinafter also referred to as "component (A-2)") and a phosphorus-containing compound (hereinafter also referred to as component "(B-2)") to a lubricating base oil having such excellent properties, it is possible to maximize the effect of improvement of the antiwear property, frictional properties, anti-seizing property and fatigue life, as well as the effect of improvement of the shear stability, due to their synergistic action, even when the oil has low viscosity. Consequently, a lubricating oil composition for a power train device according to the invention can provide both fuel savings and durability for the power train device.

Whereas it has been difficult to both improve the low temperature viscosity characteristic and ensure low volatility with conventional lubricating base oils, the lubricating base oil of the invention can achieve a superior balance between both the low temperature viscosity characteristic and low volatility. Thus, the lubricating oil composition for a power train device according to the invention is useful for improving the cold startability, in addition to providing both fuel savings and durability for the power train device.

The invention still further provides a lubricating oil composition for a power train device, characterized by comprising a lubricating base oil satisfying the condition represented by formula (1) below, and a poly(meth)acrylate-based viscosity index improver.

$$1.435 \leq n_{20} - 0.002 \times kv100 \leq 1.450 \quad (1)$$

wherein $n_{20}$ represents the refractive index of the lubricating base oil at 20° C., and kv100 represents the kinematic viscosity at 100° C. ($mm^2/s$) of the lubricating base oil.

A lubricating base oil satisfying the condition represented by formula (1) above also has an excellent viscosity-temperature characteristic, excellent heat and oxidation stability and frictional properties, and can exhibit a higher level of function for additives while stably maintaining dissolution of the additives, when additives are included. Thus, a lubricating oil composition for a power train device containing a lubricating base oil satisfying the condition represented by formula (1) above, the aforementioned specific poly(meth)acrylate-based viscosity index improver and a phosphorus-containing compound can also provide both fuel savings and durability for the power train device, while also improving the cold startability.

Effect of the Invention

According to the invention, there is provided a lubricating base oil and a lubricating oil composition which exhibit an excellent viscosity-temperature characteristic and excellent heat and oxidation stability, while also allowing additives to exhibit their function to a greater extent when additives are included. The lubricating base oil and lubricating oil composition of the invention can be suitably used in a variety of lubricating oil fields, and are especially useful for reducing energy loss and providing energy savings in devices in which the lubricating base oil and lubricating oil composition are applied.

According to the invention, it is possible to realize a lubricating oil composition for an internal combustion engine having excellent heat and oxidation stability and exhibiting superiority in terms of viscosity-temperature characteristic, frictional properties and low volatility. Applying the lubricating oil composition for an internal combustion engine according to the invention in an internal combustion engine can achieve a long drain property and energy savings, as well as improve the cold startability.

According to the invention it is also possible to realize a lubricating oil composition for a power train device that, even when having a low viscosity, can exhibit a high level of antiwear property, anti-seizing property and fatigue life for long periods. Consequently, using a lubricating oil composition for a power train device according to the invention can result in both fuel savings and durability for the power train device, while also improving the cold startability.

BEST MODE FOR CARRYING OUT THE INVENTION

Preferred embodiments of the invention will now be described in detail.

(Lubricating Base Oil)

The lubricating base oil of the invention is characterized by satisfying at least one of the following conditions (a) or (b). The lubricating base oil of the invention preferably satisfies both conditions (a) and (b), although it is sufficient if it satisfies at least one of conditions (a) and (b).

(a) A saturated compound content of 95% by mass or greater, and a proportion of 0.1-10% by mass of cyclic saturated compounds among the saturated compounds.

(B) The condition represented by the following formula (1).

$$1.435 \leq n_{20} - 0.002 \times kv100 \leq 1.450 \quad (1)$$

wherein $n_{20}$ represents the refractive index of the lubricating base oil at 20° C., and kv100 represents the kinematic viscosity at 100° C. ($mm^2/s$) of the lubricating base oil.

The lubricating base oil of the invention is not particularly restricted so long as it satisfies at least one of conditions (a) and (b) above. Specifically, there may be mentioned paraffinic mineral oils prepared by subjecting a lube-oil fraction obtained by atmospheric distillation and/or vacuum distillation of crude oil to refining involving one or a combination of refining treatments such as solvent deasphalting, solvent extraction, hydrocracking, solvent dewaxing, catalytic dewaxing, hydrorefining, sulfuric acid treatment and white clay treatment, or normal paraffinic base oils or isoparaffinic base oils, which satisfy at least one of the aforementioned conditions (a) or (b). Such lubricating base oils may be used alone, or a combination of two or more thereof may be used.

As a preferred example of a lubricating base oil for the invention there may be mentioned a base oil obtained using one of the base oils (1)-(8) mentioned hereunder as the starting material, and refining the feed stock oil and/or the lube-oil fraction recovered from the feed stock oil, by a prescribed refining process, and recovering the resulting lube-oil fraction.

(1) Distilled oil obtained by atmospheric distillation of a paraffinic crude oil and/or a mixed-based crude oil.

(2) Distilled oil obtained by vacuum distillation of the residue from atmospheric distillation of a paraffinic crude oil and/or a mixed-based crude oil (WVGO).

(3) Wax obtained by a lubricating oil dewaxing step (slack wax or the like) and/or synthetic wax obtained by a gas-to-liquid (GTL) process (Fischer-Tropsch wax, GTL wax or the like).

(4) Blended oil consisting of one or more selected from among base oils (1)-(3), and/or mildly hydrocracked oil obtained from the blended oil.

(5) Blended oil consisting of two or more selected from among base oils (1)-(4).

(6) Deasphalted oil (DAO) from base oil (1), (2), (3), (4) or (5).

(7) Mildly hydrocracked oil (MHC) of base oil (6).

(8) Blended oil consisting of two or more selected from base oils (1)-(7).

The specific refining process described above is preferably hydrorefining such as hydrocracking or hydrofinishing; solvent-refining such as furfural solvent extraction; dewaxing such as solvent dewaxing or catalytic dewaxing; white clay refining with acidic white clay or active white clay; or chemical (acid or alkali) washing such as sulfuric acid washing or caustic soda washing. According to the invention, any one of these refining processes may be used alone, or a combination of two or more thereof may be used in combination. When a combination of two or more refining processes is used, the order is not particularly restricted and may be selected as appropriate.

The lubricating base oil of the invention is most preferably one of the following base oils (9) or (10) obtained by the prescribed treatment of a base oil selected from among base oils (1)-(8) above or a lube-oil fraction recovered from the base oil.

(9) A hydrotreated mineral oil obtained by hydrocracking of a base oil selected from among base oils (1)-(8) above or a lube-oil fraction recovered from the base oil, and dewaxing treatment such as solvent dewaxing or catalytic dewaxing of the product or a lube-oil fraction recovered from distillation of the product, or further distillation after the dewaxing treatment.

(10) A hydroisomerized mineral oil obtained by hydroisomerization of a base oil selected from among base oils (1)-(8) above or a lube-oil fraction recovered from the base oil, and dewaxing treatment such as solvent dewaxing or catalytic dewaxing of the product or a lube-oil fraction recovered from distillation of the product, or further distillation after the dewaxing treatment.

When obtaining the lubricating base oil of (9) or (10) above, a solvent refining treatment or hydrofinishing treatment step may also be carried out if necessary in a convenient step.

There are no particular restrictions on the catalyst used for the hydrocracking or hydroisomerization, but there may be suitably used hydrocracking catalysts comprising a hydrogenating metal (for example, one or more metals of Group VIa or metals of Group VIII of the Periodic Table) supported on a carrier which is a complex oxide with decomposing activity (for example, silica-alumina, alumina-boria, silica-zirconia or the like) or a combination of one or more of such complex oxides bound with a binder, or hydroisomerization catalysts obtained by loading one or more metals of Group VIII having hydrogenating activity on a carrier comprising zeolite (for example, ZSM-5, zeolite beta, SAPO-11 or the like). The hydrocracking catalyst or hydroisomerization catalyst may be used as a combination of layers or a mixture.

The reaction conditions for the hydrocracking/hydroisomerization are not particularly restricted, but a hydrogen partial pressure of 0.1-20 MPa, a mean reaction temperature of 150-450° C., an LHSV of 0.1-3.0 $hr^{-1}$ and a hydrogen/oil ratio of 50-20,000 scf/bbl are preferred.

The following production process A may be mentioned as a preferred example of a production process for a lubricating base oil according to the invention.

Specifically, production process A of the invention comprises: a first step in which a hydrocracking catalyst is prepared having at least one metal of Group VIa of the Periodic Table and at least one metal of Group VIII supported on a carrier having an $NH_3$ desorption percentage at 300-800° C. of no greater than 80% with respect to the total $NH_3$ desorption, in $NH_3$ desorption temperature dependence evaluation;

a second step in which a feed stock oil comprising a slack wax of 50% by volume or greater is subjected to hydrocracking in the presence of a hydrocracking catalyst, at a hydrogen partial pressure of 0.1-14 MPa, a mean reaction temperature of 230-430° C., an LHSV of 0.3-3.0 $hr^{-1}$ and a hydrogen/oil ratio of 50-14000 scf/b;

a third step in which the hydrogenolysis product oil obtained in the second step is subjected to distilling separation to obtain a lube-oil fraction; and a fourth step in which the lube-oil fraction obtained in the third step is subjected to dewaxing treatment.

The aforementioned production process A will now be explained in detail.

(Feed Stock Oil)

A feed stock oil with a slack wax content of 50% by volume or greater is used for production process A. The condition a "feed stock oil with a slack wax content of 50% by volume or greater" according to the invention includes both feed stock oil composed entirely of slack wax, and feed stock oil which is a blended oil of slack wax and another feed stock oil and contains at least 50% by volume slack wax.

Slack wax is a wax-containing component which is a by-product of the solvent dewaxing step in production of a lubricating base oil from a paraffinic lube-oil fraction, and according to the invention this also includes slack wax obtained by further subjecting the wax-containing component to deoiling treatment. The major components of slack wax are n-paraffins and branched paraffins (isoparaffins) with few side chains, and it has low naphthene and aromatic contents. The kinematic viscosity of the slack wax used for preparation of the feed stock oil may be appropriately selected depending on the intended kinematic viscosity of the lubricating base oil, but for production of a low-viscosity base oil as a lubricating base oil for the invention, it is preferred to use a relatively low viscosity slack wax having a kinematic viscosity at 100° C. of about 2-25 $mm^2/s$, preferably about 2.5-20 $mm^2/s$ and more preferably about 3-15 $mm^2/s$. The other properties of the slack wax may be as desired, but the melting point is preferably 35-80° C., more preferably 45-70° C. and even more preferably 50-60° C. The oil portion of the slack wax is preferably no greater than 50% by mass, more preferably no greater than 25% by mass and even more preferably no greater than 10% by mass, and preferably at least 0.5% by mass and more preferably at least 1% by mass. The sulfur content of the slack wax is preferably no greater than 1% by mass and more preferably no greater than 0.5% by mass, and preferably at least 0.001% by mass.

The oil portion of the slack wax that has been thoroughly subjected to deoiling treatment (hereinafter, "slack wax A") is preferably 0.5-10% by mass and more preferably 1-8% by mass. The sulfur content of slack wax A is preferably 0.001-0.2% by mass, more preferably 0.01-0.15% by mass, and even more preferably 0.05-0.12% by mass. On the other hand, the oil portion of the slack wax that has either not been deoiled or has not sufficiently been deoiled (hereinafter, "slack wax B") is preferably 10-50% by mass and more preferably 15-25% by mass. The sulfur content of slack wax B is preferably 0.05-1 by mass %, more preferably 0.1-0.5% by mass, and even more preferably 0.15-0.25% by mass.

Using the slack wax A as the starting material in production process A described above can suitably yield a lubricating base oil of the invention that satisfies at least one of conditions (a) or (b) above. Production process A can also yield a lubricating base oil with high added value, exhibiting a high viscosity index and excellent cold characteristics and heat and oxidation stability, even when using as the starting material slack wax B which has a relatively high oil portion and sulfur content and is relatively poor-quality and cheap.

When the feed stock oil is a blended oil comprising slack wax and another feed stock oil, the other feed stock oil is not particularly restricted so long as it has a slack wax proportion of at least 50% by volume of the total blended oil, but it is preferably a blended oil comprising a heavy atmospheric distilled oil and/or a vacuum distilled oil from crude oil.

When the feed stock oil is a blended oil comprising slack wax and another feed stock oil, the proportion of slack wax of the total blended oil is preferably at least 70% by volume and more preferably at least 75% by volume, from the standpoint of producing a base oil with a high viscosity index. If the proportion is less than 50% by volume, the oil portion including aromatic and naphthene components will be increased in the lubricating base oil, thus tending to lower the viscosity index of the lubricating base oil.

On the other hand, heavy atmospheric distilled oil and/or vacuum distilled oil from crude oil used in combination with slack wax is preferably the fraction with a run-off of 60% by volume or greater in the distillation temperature range of 300-570° C. in order to maintain a high viscosity index of the lubricating base oil product.

(Hydrocracking Catalyst)

In production process A, the hydrocracking catalyst used is one having at least one metal of Group VIa of the Periodic Table and at least one metal of Group VIII supported on a carrier having an $NH_3$ desorption percentage at 300-800° C. of no greater than 80% with respect to the total $NH_3$ desorption, in $NH_3$ desorption temperature dependence evaluation.

The "$NH_3$ desorption temperature dependence evaluation" referred to here is the method that has been introduced in the literature (Sawa M., Niwa M., Murakami Y., Zeolites 1990, 10, 532, Karge H. G., Dondur V., J. Phys. Chem. 1990, 94, 765, and elsewhere), and it is carried out in the following manner. First, the catalyst carrier is pretreated for 30 minutes or longer at a temperature of at least 400° C. under a nitrogen stream to remove the adsorbed molecules, and then adsorption is performed at 100° C. until $NH_3$ saturation. Next, the temperature of the catalyst carrier is raised to 100-800° C. at a temperature-elevating rate of no more than 10° C./min for $NH_3$ desorption, and the $NH_3$ separated by desorption is monitored at each prescribed temperature. The desorption percentage of $NH_3$ at 300° C.-800° C. with respect to the total $NH_3$ desorption (desorption at 100-800° C.) is then calculated.

The catalyst carrier used in production process A has an $NH_3$ desorption percentage at 300-800° C. of no greater than 80%, preferably no greater than 70% and more preferably no greater than 60% with respect to the total $NH_3$ desorption in the $NH_3$ desorption temperature dependence evaluation described above. By using such a carrier to construct the hydrocracking catalyst, acidic substances that govern the decomposition activity are sufficiently inhibited, so that it is possible to efficiently and reliably produce isoparaffins by decomposing isomerization of high-molecular-weight n-paraffins that derive from the slack wax in the feed stock oil by hydrocracking, and to satisfactorily inhibit excess decomposition of the produced isoparaffin compounds. As a result, it is possible to obtain a sufficient amount of molecules having a high viscosity index and a suitably branched chemical structure, within a suitable molecular weight range.

As such carriers there are preferred two-element oxides which are amorphous and acidic, and as examples there may be mentioned the two-element oxides cited in the literature (for example, "Metal Oxides and Their Catalytic Functions", Shimizu, T., Kodansha, 1978).

Preferred among these are amorphous complex oxides that contain acidic two-element oxides obtained as complexes of two oxides of elements selected from among Al, B, Ba, Bi, Cd, Ga, La, Mg, Si, Ti, W, Y, Zn Zr and Zr. The proportion of each oxide in such acidic two-element oxides can be adjusted to obtain an acidic carrier suitable for the purpose in the aforementioned $NH_3$ adsorption/desorption evaluation. The acidic two-element oxide composing the carrier may be any one of the above, or a mixture of two or more thereof. The carrier may also be composed of the aforementioned acidic two-element oxide, or it may be a carrier obtained by binding acidic two-element oxide with a binder.

The carrier is preferably one containing at least one acidic two-element oxide selected from among amorphous silica-alumina, amorphous silica-zirconia, amorphous silica-magnesia, amorphous silica-titania, amorphous silica-boria, amorphous alumina-zirconia, amorphous alumina-magnesia, amorphous alumina-titania, amorphous alumina-boria, amorphous zirconia-magnesia, amorphous zirconia-titania, amorphous zirconia-boria, amorphous magnesia-titania, amorphous magnesia-boria and amorphous titania-boria. The acidic two-element oxide composing the carrier may be any one of the above, or a mixture of two or more thereof. The carrier may also be composed of the aforementioned acidic two-element oxide, or it may be a carrier obtained by binding an acidic two-element oxide with a binder. The binder is not particularly restricted so long as it is one commonly used for catalyst preparation, but those selected from among silica, alumina, magnesia, titania, zirconia and clay and mixtures thereof are preferred.

For production process A, the hydrocracking catalyst has a structure wherein at least one metal of Group VIa of the Periodic Table (molybdenum, chromium, tungsten or the like) and at least one metal of Group VIII (nickel, cobalt, palladium, platinum or the like) are loaded on the aforementioned carrier. These metals have a hydrogenating function, and on the acidic carrier completes a reaction which causes decomposition or branching of the paraffin compound, thus performing an important role for production of isoparaffins with a suitable molecular weight and branching structure.

As the loading amounts of the metals in the hydrocracking catalyst, the loading amount of metals of Group VIa is preferably 5-30% by mass for each metal, and the loading amount of metals of Group VIII is preferably 0.2-10% by mass for each metal.

The hydrocracking catalyst used for production process A more preferably comprises molybdenum in a range of 5-30% by mass as the one or more metals of Group VIa, and nickel in a range of 0.2-10% by mass as the one or more metals of Group VIII.

The hydrocracking catalyst composed of the carrier, at least one metal of Group VIa and at least one metal of Group VIII is preferably used in a sulfurized state for hydrocracking. The sulfidizing treatment may be carried out by a publicly known method.

(Hydrocracking Step)

For production process A, the feed stock oil containing slack wax of at least 50% by volume is hydrocracked in the presence of the hydrocracking catalyst, at a hydrogen partial pressure of 0.1-14 MPa, preferably 1-14 MPa and more preferably 2-7 MPa; a mean reaction temperature of 230-430° C., preferably 330-400° C. and more preferably 350-390° C.; an LHSV of 0.3-3.0 $hr^{-1}$ and preferably 0.5-2.0 $hr^{-1}$ and a hydrogen/oil ratio of 50-14000 scf/b and preferably 100-5000 scf/b.

In the hydrocracking step, the n-paraffins derived from the slack wax in the feed stock oil are isomerized to isoparaffins during decomposition, producing isoparaffin components with a low pour point and a high viscosity index, but it is possible to simultaneously decompose the aromatic compounds in the feed stock oil, which are responsible for increasing viscosity index, to monocyclic aromatic compounds, naphthene compounds and paraffin compounds, and to decompose the polycyclic naphthene compounds which are responsible for increased viscosity index to monocyclic naphthene compounds or paraffin compounds. From the viewpoint of increasing the viscosity index, it is preferred to minimize the high boiling point and low viscosity index compounds in the feed stock oil.

If the cracking severity as an evaluation of the extent of reaction is defined by the following formula:

(cracking severity (% by volume))=100−(proportion (% by volume) of fraction with boiling point of 360° C. or higher in product)

then the cracking severity is preferably 3-90% by volume. A cracking severity of less than 3% by volume is not preferred because it will result in insufficient production of isoparaffins by decomposing isomerization of high-molecular-weight n-paraffins with a high pour point in the feed stock oil and insufficient hydrocracking of the aromatic or polycyclic naphthene components with an inferior viscosity index, while a cracking severity of greater than 90% by volume is not preferred because it will reduce the lube-oil fraction yield.

(Distilling Separation Step)

The lube-oil fraction is then subjected to distilling separation from the decomposition product oil obtained from the hydrocracking step described above. A fuel oil fraction is also sometimes obtained as the light fraction.

The fuel oil fraction is the fraction obtained as a result of thorough desulfurization and denitrogenization, and thorough hydrogenation of the aromatic components. The naphtha fraction with a high isoparaffin content, the kerosene fraction with a high smoke point and the light oil fraction with a high cetane number are all high quality products suitable as fuel oils.

On the other hand, even with insufficient hydrocracking of the lube-oil fraction a portion thereof may be supplied for repeat of the hydrocraking step. In order to obtain a lube-oil fraction with the desired kinematic viscosity, the lube-oil fraction may then be subjected to vacuum distillation. The vacuum distillation separation may be carried out after the dewaxing treatment described below.

In the evaporating separation step, the decomposition product oil obtained from the hydrocracking step may be subjected to vacuum distillation to satisfactorily obtain a lubricating base oil such as 70 Pale, SAE10 or SAE20.

A system using a lower viscosity slack wax as the feed stock oil is suitable for producing a greater 70 Pale or SAE10 fraction, while a system using a high viscosity slack wax in the range mentioned above as the feed stock oil is suitable for obtaining more SAE20. However even with high viscosity slack wax, conditions for producing significant amounts of 70 Pale and SAE10 may be selected depending on the extent of the decomposition reaction.

(Dewaxing Step)

The lube-oil fraction obtained by fractional distillation from the decomposition product oil in the distilling separation step has a high pour point, and therefore dewaxing is carried out to obtain a lubricating base oil with the desired pour point. The dewaxing treatment may be carried out by an ordinary method such as a solvent dewaxing method or catalytic dewaxing method. Solvent dewaxing methods generally employ MEK and toluene mixed solvents, but solvents such as benzene, acetone or MIBK may also be used. In order to achieve a dewaxing oil pour point of −10° C. or below, the dewaxing is preferably carried out under conditions with a solvent/oil ratio of 1-6 and a filtration temperature of −5 to −45° C. and preferably −10 to −40° C. The portion removed by filtration may be supplied again as slack wax to a hydrocracking step.

In this production process, solvent refining treatment and/or hydrorefining treatment may be combined with the dewaxing treatment. Such additional treatment is performed to improve the ultraviolet stability or oxidation stability of the lubricating base oil, and may be carried out by methods ordinarily used for lubricating oil refining steps.

The solvent used for solvent refining will usually be furfural, phenol, N-methylpyrrolidone or the like, and the small amounts of aromatic compounds remaining in the lube-oil fraction, and especially polycyclic aromatic compounds, are removed.

The hydrorefining is carried out for hydrogenation of the olefin compounds and aromatic compounds, and the catalyst therefor is not particularly restricted, but there may be used alumina catalysts supporting at least one metal from among Group VIa metals such as molybdenum and at least one metal from among Group VIII metals such as cobalt and nickel, under conditions with a reaction pressure (hydrogen partial pressure) of 7-16 MPa, a mean reaction temperature of 300-390° C. and an LHSV of 0.5-4.0 $hr^{-1}$.

The following production process B may be mentioned as a preferred example of a production process for a lubricating base oil according to the invention.

Specifically, production process B of the invention comprises:

a fifth step in which a feed stock oil containing paraffinic hydrocarbons is subjected to hydrocracking and/or hydroisomerization in the presence of the catalyst, and a sixth step in which the product obtained from the fifth step or the lube-oil fraction recovered by distillation of the product is subjected to dewaxing treatment.

This production process B will now be explained in detail.

(Feed Stock Oil)

A feed stock oil containing paraffinic hydrocarbons is used for production process B. The term "paraffinic hydrocarbons" according to the invention refers to hydrocarbons with a paraffin molecule content of 70% by mass or greater. The number of carbons of the paraffinic hydrocarbons is not particularly restricted but will normally be about 10-100. The method for producing the paraffinic hydrocarbons is not particularly restricted, and various petroleum-based and synthetic paraffinic hydrocarbons may be used, but as especially preferred paraffinic hydrocarbons there may be mentioned synthetic waxes (Fischer-Tropsch wax (FT wax), GTL wax, etc.) obtained by gas-to-liquid (GTL) processes, among which FT wax is preferred. Synthetic wax is preferably wax composed mainly of normal paraffins with 15-80 and more preferably 20-50 carbon atoms.

The kinematic viscosity of the paraffinic hydrocarbons used for preparation of the feed stock oil may be appropriately selected according to the desired kinematic viscosity of the lubricating base oil, but for production of a low-viscosity base oil as a lubricating base oil of the invention, relatively low viscosity paraffinic hydrocarbons with a kinematic viscosity at 100° C. of about 2-25 $mm^2/s$, preferably about 2.5-20 $mm^2/s$ and more preferably about 3-15 $mm^2/s$, are preferred. The other properties of the paraffinic hydrocarbons may be as desired, but when the paraffinic hydrocarbons are in synthetic wax such as FT wax, the melting point is preferably 35-80° C., more preferably 50-80° C. and even more preferably 60-80° C. The oil portion of the synthetic wax is preferably no greater than 10% by mass, more preferably no greater than 5% by mass and even more preferably no greater than 2% by mass. The sulfur content of the synthetic wax is preferably no greater than 0.01% by mass, more preferably no greater than 0.001% by mass and even more preferably no greater than 0.0001% by mass.

When the feed stock oil is a blended oil comprising the aforementioned synthetic wax and another feed stock oil, the other feed stock oil is not particularly restricted so long as it has a synthetic wax proportion of at least 50% by volume of the total blended oil, but it is preferably a blended oil comprising a heavy atmospheric distilled oil and/or a vacuum distilled oil from crude oil.

When the feed stock oil is a blended oil comprising the synthetic wax and another feed stock oil, the proportion of synthetic wax of the total blended oil is preferably at least 70% by volume and more preferably at least 75% by volume, from the standpoint of producing a base oil with a high viscosity index. If the proportion is less than 70% by volume, the oil portion including aromatic and naphthene components will be increased in the lubricating base oil, thus tending to lower the viscosity index of the lubricating base oil.

On the other hand, heavy atmospheric distilled oil and/or vacuum distilled oil from crude oil used in combination with synthetic wax is preferably a fraction with a run-off of 60% by volume or greater in the distillation temperature range of 300-570° C. in order to maintain a high viscosity index of the lubricating base oil product.

(Catalyst)

There are no particular restrictions on the catalyst used for production process B, but it is preferably a catalyst comprising at least one metal selected from metals of Group VIb and Group VIII of the Periodic Table as an active metal component supported on a carrier containing an aluminosilicate.

An aluminosilicate is a metal oxide composed of the three elements aluminum, silicon and oxygen. Other metal elements may also be included in a range that does not interfere with the effect of the invention. In this case, the amount of other metal elements is preferably no greater than 5% by mass and more preferably no greater than 3% by mass of the total of alumina and silica in terms of their oxides. As examples of metal elements to be included there may be mentioned titanium, lanthanum and manganese.

The crystallinity of the aluminosilicate can be estimated by the proportion of tetracoordinated aluminum atoms among the total aluminum atoms, and the proportion can be measured by $^{27}Al$ solid NMR. The aluminosilicate used for the invention has a tetracoordinated aluminum content of preferably at least 50% by mass, more preferably at least 70% by mass and even more preferably at least 80% by mass of the total aluminum. Aluminosilicates with tetracoordinated aluminum contents of greater than 50% by mass of the total aluminum are known as "crystalline aluminosilicates".

Zeolite may be used as a crystalline aluminosilicate. As preferred examples there may be mentioned Y-zeolite, ultra-stabilized Y-zeolite (USY-zeolite), β-zeolite, mordenite and ZSM-5, among which USY zeolite is particularly preferred. According to the invention, one type of crystalline aluminosilicate may be used alone, or two or more may be used in combination.

The method of preparing the carrier containing the crystalline aluminosilicate may be a method in which a mixture of the crystalline aluminosilicate and a binder is shaped and the shaped body is fired. There are no particular restrictions on the binder used, but alumina, silica, silica-alumina, titania and magnesia are preferred, and alumina is particularly preferred. There are also no particular restrictions on the proportion of binder used, but normally it will be preferably 5-99% by mass and more preferably 20-99% by mass based on the total amount of the shaped body. The firing temperature for the shaped body comprising the crystalline aluminosilicate and binder is preferably 430-470° C., more preferably 440-460° C. and even more preferably 445-455° C. The firing time is not particularly restricted but will normally be 1 minute-24 hours, preferably 10 minutes to 20 hours and more preferably 30 minutes-10 hours. The firing may be carried out in an air atmosphere, but is preferably carried out in an anoxic atmosphere such as a nitrogen atmosphere.

The Group VIb metal supported on the carrier may be chromium, molybdenum, tungsten or the like, and the Group VIII metal may be, specifically, cobalt, nickel, rhodium, palladium, iridium, platinum or the like. These metals may be used as single metals alone, or two or more thereof may be used in combination. For a combination of two or more metals, two precious metals such as platinum and palladium may be combined, two base metals such as nickel, cobalt, tungsten and molybdenum may be combined, or a precious metal and a base metal may be combined.

The metal may be loaded onto the carrier by impregnation of the carrier with a solution containing the metal, or by a method such as ion exchange. The loading amount of the metal may be selected as appropriate, but it will usually be 0.05-2% by mass and preferably 0.1-1% by mass based on the total catalyst.

(Hydrocracking/Hydroisomerization Step)

In production process B, a feed stock oil containing paraffinic hydrocarbons is subjected to hydrocracking/hydroisomerization in the presence of the aforementioned catalyst. The hydrocracking/hydroisomerization step may be carried out using a fixed bed reactor. The conditions for the hydrocracking/hydroisomerization are preferably, for example, a temperature of 250-400° C., a hydrogen pressure of 0.5-10 MPa and a liquid hourly space velocity (LHSV) of feed stock oil of 0.5-10 $h^{-1}$.

(Distillation Separation Step)

The lube-oil fraction is then subjected to distillation separation from the decomposition product oil obtained from the hydrocracking/hydroisomerization step described above. The distillation separation step in production process B is the same as the distillation separation step in production process A, and it will not be explained again here.

(Dewaxing Step)

The lube-oil fraction obtained by fractional distillation from the decomposition product oil in the distillation separation step described above is then subjected to dewaxing. The dewaxing step may be carried out by a conventionally known dewaxing process such as solvent dewaxing or catalytic dewaxing. When the substances with a boiling point of 370° C. or below in the decomposition/isomerization product oil have not been separated from the high boiling point substances before dewaxing, the entire hydroisomerization product may be dewaxed, or the fraction with a boiling point of 370° C. and above may be dewaxed, depending on the intended purpose of the decomposition/isomerization product oil.

For solvent dewaxing, the hydroisomerization product is contacted with cool ketone and acetone and another solvent such as MEK or MIBK, and then cooled for precipitation of the high pour point substances as solid wax, and the precipitate is separated from the solvent-containing lube-oil fraction (raffinate). The raffinate is then cooled with a scraped surface chiller for removal of the solid wax. Low molecular hydrocarbons such as propane can also be used for the dewaxing, in which case the decomposition/isomerization product oil and low molecular hydrocarbons are combined and at least a portion thereof is gasified to further cool the decomposition/isomerization product oil and precipitate the wax. The wax is separated from the raffinate by filtration, membrane or centrifugal separation. The solvent is then removed from the raffinate and the raffinate is subjected to fractional distillation to obtain the target lubricating base oil.

In the case of catalytic dewaxing (catalyst dewaxing), the decomposition/isomerization product oil is reacted with hydrogen in the presence of a suitable dewaxing catalyst under conditions effective for lowering the pour point. For catalytic dewaxing, some of the high-boiling-point substances in the decomposition/isomerization product are converted to low-boiling-point substances, and then the low-boiling-point substances are separated from the heavy base oil fraction and the base oil fraction is subjected to fractional distillation to obtain two or more lubricating base oils. The low-boiling-point substances may be separated either before obtaining the target lubricating base oil or during the fractional distillation.

The dewaxing catalyst is not particularly restricted so long as it can lower the pour point of the decomposition/isomerization product oil, but it is preferably one that can yield the target lubricating base oil at a high yield from the decomposition/isomerization product oil. As such dewaxing catalysts there are preferred shape-selective molecular sieves, and specifically there may be mentioned ferrierite, mordenite, ZSM-5, ZSM-11, ZSM-23, ZSM-35 and ZSM-22 (also known as theta-1 or TON) and silicoaluminophosphates (SAPO). Such molecular sieves are preferably used in combination with catalytic metal components, and more preferably are used in combination with precious metals. As an example of a preferred combination there may be mentioned a complex of platinum and H-mordenite.

The dewaxing conditions are not particularly restricted, but preferably the temperature is 200-500° C. and the hydrogen pressure is 10-200 bar (1 MPa-20 MPa). In the case of a flow-through reactor, the $H_2$ treatment rate is preferably 0.1-10 kg/l/hr, and the LHSV is preferably 0.1-$10^{-1}$ and more preferably 0.2-2.0 $h^{-1}$. The dewaxing is preferably accomplished by converting the substances with an initial boiling point of 350-400° C. which are usually present at no greater than 40% by mass and preferably no greater than 30% by mass in the decomposition/isomerization product oil, to substances with a boiling point below this initial boiling point.

Production process A and production process B have been explained above as preferred production processes for the lubricating base oil of the invention, but the production process for the lubricating base oil according to the invention is not limited to these. For example, a synthetic wax such as FT wax or GT wax may be used instead of slack wax in production process A. Also, a feed stock oil containing slack wax (preferably slack wax A or B) may be used in production process B. In addition, slack wax (preferably slack wax A or B) and a synthetic wax (preferably FT wax or GT wax) may be used in combination for production processes A and B.

When the feed stock oil used for production of the lubricating base oil of the invention is a blended oil comprising a slack wax and/or synthetic wax and a feed stock oil other than such a wax, the content of the slack wax and/or synthetic wax is preferably at least 50% by mass based on the total feed stock oil.

When producing a lubricating base oil satisfying condition (a) above, the feed stock oil is preferably a feed stock oil comprising a slack wax and/or synthetic wax wherein the feed stock oil has an oil portion of no greater than 10% by mass; more preferably a feed stock oil comprising slack wax A and/or slack wax B wherein the feed stock oil has an oil portion of no greater than 10%; and most preferably a feed stock oil comprising slack wax A wherein the feed stock oil has an oil portion of no greater than 10% by mass.

When the lubricating base oil of the invention satisfies condition (a) above, the content of saturated compounds in the lubricating base oil is at least 95% by mass, preferably at least 97% by mass and more preferably at least 98% by mass based on the total weight of the lubricating base oil as mentioned above, and the proportion of cyclic saturated compounds among the saturated compounds is 0.1-10% by mass, preferably 0.5-5% by mass and more preferably 0.8-3% by mass, as mentioned above. If the saturated compound content and the proportion of cyclic saturated compounds among the saturated compounds satisfy these conditions, it will be possible to achieve a satisfactory viscosity-temperature characteristic and heat and oxidation stability, and when additives are added to the lubricating base oil, the functions of the additives can be exhibited at a higher level while sufficiently maintaining stable dissolution of the additives in the lubricating base oil. In addition, if the saturated compound content and the proportion of cyclic saturated compounds among the saturated compounds satisfy these conditions, it will be possible to improve the frictional properties of the lubricating base oil itself, thereby achieving an improved effect of reducing friction and providing greater energy savings.

If the saturated compound content is less than 95% by mass, the viscosity-temperature characteristic, heat and oxidation stability and frictional properties will be inadequate. If the proportion of cyclic saturated compounds among the saturated compounds is less than 0.1% by mass, the solubility of additives will be insufficient when additives are included in the lubricating base oil, and the effective amount of the additives kept dissolved in the lubricating base oil will be reduced, thus making it impossible to effectively obtain the functions of the additives. If the proportion of cyclic saturated compounds among the saturated compounds exceeds 10% by mass, the efficacy of additives will be reduced when additives are included in the lubricating base oil.

If the lubricating base oil of the invention is one satisfying condition (a) above, a proportion of cyclic saturated compounds among the saturated compounds of 0.1-10% by mass is equivalent to 99.9-90% by mass of non-cyclic saturated compounds among the saturated compounds. Non-cyclic saturated compounds include both straight-chain paraffins and branched paraffins. The proportion of each type of paraffin in the lubricating base oil of the invention is not particularly restricted, but the proportion of branched paraffins is preferably 90-99.9% by mass, more preferably 95-99.5% by mass and even more preferably 97-99% by mass based on the total lubricating base oil. If the proportion of branched paraffins in the lubricating base oil satisfies this condition, the viscosity-temperature characteristic and heat and oxidation stability can be further improved, and when additives are added to the lubricating base oil, the functions of the additives can be exhibited at an even higher level while sufficiently maintaining stable dissolution of the additives.

The saturated compound content according to the invention is the value measured based on ASTM D 2007-93 (units: % by mass).

The proportion of cyclic saturated compounds and non-cyclic saturated compounds among the saturated compounds, according to the invention, is the naphthene portion (monocyclic to hexacyclic naphthenes, units: % by mass) and alkane portion (units: % by mass), each measured based on ASTM D 2786-91.

The straight-chain paraffin content of the lubricating base oil according to the invention is that obtained by subjecting the saturated compound portion that has been separated and fractionated by the method described in ASTM D 2007-93 mentioned above, to gas chromatography under the conditions described below, in order to identify and quantify the straight-chain paraffin content of the saturated compound, and expressing the measured value with respect to the total weight of the lubricating base oil. For identification and quantitation, a C5-50 straight-chain paraffin mixture sample is used as the standard sample, and the straight-chain paraffin content among the saturated compounds is determined as the proportion of the total of the peak areas corresponding to each straight-chain paraffin, with respect to the total peak area of the chromatogram (subtracting the peak area from the diluent).

(Gas Chromatography Conditions)

Column: Liquid phase nonpolar column (length: 25 mm, inner diameter: 0.3 mmϕ, liquid phase film thickness: 0.1 μm)

Temperature elevating conditions: 50° C.-400° C. (temperature-elevating rate: 10° C./min)

Carrier gas: Helium (linear speed: 40 cm/min)

Split ratio: 90/1

Sample injection rate: 0.5 μL (injection rate of sample diluted 20-fold with carbon disulfide)

The proportion of branched paraffins in the lubricating base oil is the difference between the non-cyclic saturated compound content of the saturated compounds and the straight-chain paraffin content of the saturated compounds, and it is a value expressed with respect to the weight of the lubricating base oil.

Separation of the saturated compound or composition analysis of the cyclic saturated compounds and non-cyclic saturated compounds may be accomplished using similar methods that give comparable results. For example, in addition to the methods described above, there may be mentioned the method of ASTM D 2425-93, the method of ASTM D 2549-91, high performance liquid chromatography (HPLC) methods and modified forms of these methods.

When the lubricating base oil of the invention is one satisfying condition (b) above, $n_{20}-0.002\times kv100$ is 1.435-1.450 as mentioned above, preferably 1.440-1.449, more preferably 1.442-1.448 and even more preferably 1.444-1.447. If $n_{20}-0.002\times kv100$ is within this range, superiority can be achieved in terms of the viscosity-temperature characteristic and heat and oxidation stability, and when additives are added to the lubricating base oil, the functions of the additives can be exhibited at an even higher level while sufficiently maintaining stable dissolution of the additives in the lubricating base oil. Also, if $n_{20}$-0.002×kv100 is within the aforementioned range it is possible to improve the frictional properties of the lubricating base oil itself, thus resulting in an enhanced effect of reduced friction and therefore increased energy savings.

If $n_{20}-0.002\times kv100$ exceeds the aforementioned upper limit, the viscosity-temperature characteristic, heat and oxidation stability and frictional properties will be insufficient, and the efficacy of additives will be reduced when additives are included in the lubricating base oil. If $n_{20}-0.002\times kv100$ is below the aforementioned lower limit, the solubility of the additives will be insufficient when additives are included in the lubricating base oil, while the effective amount of the additives kept dissolved in the lubricating base oil will be reduced, thereby preventing the functions of the additives from being effectively exhibited.

The 20° C. refractive index ($n_{20}$) according to the invention is the refractive index measured at 20° C. according to ASTM D1218-92. The kinematic viscosity at 100° C. (kv100) according to the invention is the kinematic viscosity measured at 100° C. according to JIS K 2283-1993.

The aromatic content of the lubricating base oil of the invention is not particularly restricted so long as the lubricating base oil satisfies at least condition (a) or (b), but it is preferably no greater than 5% by mass, more preferably 0.1-3% by mass and even more preferably 0.3-1% by mass based on the total weight of the lubricating base oil. If the aromatic content exceeds the aforementioned upper limit, the viscosity-temperature characteristic, heat and oxidation stability and frictional properties, as well as the low volatility and low temperature viscosity characteristic, will tend to be reduced, and the efficacy of additives will be reduced when additives are included in the lubricating base oil. The lubricating base oil of the invention may be free of aromatic components, but an aromatic content of 0.1% by mass or greater can further increase the solubility of additives.

The aromatic content referred to here is the value measured according to ASTM D 2007-93. The aromatic components normally include alkylbenzene and alkylnaphthalene, as well as anthracene, phenanthrene and their alkylated forms, and compounds with four or more fused benzene rings, aromatic compounds with heteroatoms such as pyridines, quinolines, phenols and naphthols, and the like.

The % $C_p$ value of the lubricating base oil of the invention is not particularly restricted so long as the lubricating base oil satisfies at least condition (a) or (b), but it is preferably 80 or greater, more preferably 82-99, even more preferably 85-98 and most preferably 90-97. If the % $C_p$ of the lubricating base oil is less than 80, the viscosity-temperature characteristic, heat and oxidation stability and frictional properties will tend to be reduced, and the efficacy of additives will tend to be reduced when additives are included in the lubricating base oil. If the % $C_p$ of the lubricating base oil exceeds 99, the solubility of additives will tend to be lower.

The % $C_N$ of the lubricating base oil of the invention is not particularly restricted so long as the lubricating base oil satisfies at least condition (a) or (b), but it is preferably no greater than 15, more preferably 1-12 and even more preferably 3-10. If the % $C_N$ of the lubricating base oil is greater than 15, the viscosity-temperature characteristic, heat and oxidation stability and frictional properties will tend to be reduced. If % $C_N$ is less than 1, the solubility of additives will tend to be lower.

The % $C_A$ of the lubricating base oil of the invention is not particularly restricted so long as the lubricating base oil satisfies at least condition (a) or (b), but it is preferably no greater than 0.7, more preferably no greater than 0.6 and even more preferably 0.1-0.5. If the % $C_A$ of the lubricating base oil is greater than 0.7, the viscosity-temperature characteristic, heat and oxidation stability and frictional properties will tend to be reduced. The % $C_A$ of the lubricating base oil of the invention may be 0, but a % $C_A$ of 0.1 or greater can further increase the solubility of additives.

The proportion of % $C_P$ and % $C_N$ in the lubricating base oil of the invention is not particularly restricted so long as the lubricating base oil satisfies at least condition (a) or (b), but % $C_P$/% $C_N$ is preferably 7 or greater, more preferably 7.5 or greater and even more preferably 8 or greater. If % $C_P$/% $C_N$ is less than 7, the viscosity-temperature characteristic, heat and oxidation stability and frictional properties will tend to be reduced, and the efficacy of additives will tend to be reduced when additives are included in the lubricating base oil. Also, % $C_P$/% $C_N$ is preferably no greater than 200, more preferably no greater than 100, even more preferably no greater than 50 and most preferably no greater than 25. A % $C_P$/% $C_N$ ratio of 200 or smaller can further increase the solubility of additives.

The values of % $C_P$, % $C_N$ and % $C_A$ according to the invention are, respectively, the percentage of the number of paraffin carbon atoms with respect to the total number of carbon atoms, the percentage of naphthene carbon atoms with respect to the total number of carbon atoms and the percentage of aromatic carbon atoms with respect to the total number of carbon atoms, as determined by the method of ASTM D 3238-85 (n-d-M ring analysis). That is, the preferred ranges for % $C_P$, % $C_N$ and % $C_A$ are based on values determined by this method, and for example, % $C_N$ determined by the method may be a value exceeding zero even when the lubricating base oil contains no naphthene components.

The sulfur content of the lubricating base oil of the invention depends on the sulfur content of the starting material. For example, when using a starting material containing essentially no sulfur, such as a synthetic wax component obtained by Fischer-Tropsch reaction, it is possible to obtain a lubricating base oil containing essentially no sulfur. Or, when using a starting material that contains sulfur, such as slack wax obtained by a lubricating base oil refining process or a microwax obtained by a wax refining process, the sulfur content of the obtained lubricating base oil will usually be 100 ppm by mass or greater. From the viewpoint of further improving the heat and oxidation stability and lowering the sulfur content, the sulfur content of the lubricating base oil of the invention is preferably no greater than 100 ppm by mass, more preferably no greater than 50 ppm by mass, even more preferably no greater than 10 ppm by mass and most preferably no greater than 5 ppm by mass.

From the viewpoint of cost reduction, the starting material used is preferably slack wax, in which case the sulfur content of the obtained lubricating base oil is preferably no greater than 50 ppm by mass and more preferably no greater than 10 ppm by mass. The sulfur content for the invention is the sulfur content measured according to JIS K 2541-1996.

The nitrogen content of the lubricating base oil of the invention is not particularly restricted, but it is preferably no greater than 5 ppm by mass, more preferably no greater than 3 ppm by mass and even more preferably no greater than 1 ppm by mass. If the nitrogen content is greater than 5 ppm by mass, the heat and oxidation stability will tend to be reduced. The nitrogen content for the invention is the nitrogen content measured according to JIS K 2609-1990.

The kinematic viscosity of the lubricating base oil of the invention is not particularly restricted so long as the lubricating base oil satisfies at least condition (a) or (b), but the kinematic viscosity at 100° C. is preferably 1.5-20 $mm^2/s$ and more preferably 2.0-11 $mm^2/s$. The kinematic viscosity at 100° C. for the lubricating base oil of less than 1.5 $mm^2/s$ is not preferred from the standpoint of evaporation loss. It is not preferred to attempt to obtain a lubricating base oil with a kinematic viscosity at 100° C. exceeding 20 $mm^2/s$, because the yield will be low and it will be difficult to increase the cracking severity even if heavy wax is used as the starting material.

According to the invention, a lubricating base oil with a kinematic viscosity at 100° C. in one of the following ranges is preferably fractionated by distillation or the like for use.

(I) A lubricating base oil with a kinematic viscosity at 100° C. of at least 1.5 $mm^2/s$ and less than 3.5 $mm^2/s$, and more preferably 2.0-3.0 $mm^2/s$.

(II) A lubricating base oil with a kinematic viscosity at 100° C. of at least 3.0 $mm^2/s$ and less than 4.5 $mm^2/s$, and more preferably 3.5-4.1 $mm^2/s$.

(III) A lubricating base oil with a kinematic viscosity at 100° C. of 4.5-20 $mm^2/s$, more preferably 4.8-11 $mm^2/s$ and most preferably 5.5-8.0 $mm^2/s$.

The kinematic viscosity at 40° C. of the lubricating base oil of the invention is preferably 6.0-80 $mm^2/s$ and more preferably 8.0-50 $mm^2/s$. According to the invention, a lube-oil fraction with a kinematic viscosity at 40° C. in one of the following ranges is preferably fractionated by distillation or the like for use.

(IV) A lubricating base oil with a kinematic viscosity at 40° C. of at least 6.0 $mm^2/s$ and less than 12 $mm^2/s$, and more preferably 8.0-12 $mm^2/s$.

(V) A lubricating base oil with a kinematic viscosity at 40° C. of at least 12 $mm^2/s$ and less than 28 $mm^2/s$, and more preferably 13-19 $mm^2/s$.

(VI) A lubricating base oil with a kinematic viscosity at 40° C. of 28-50 $mm^2/s$, more preferably 29-45 $mm^2/s$ and most preferably 30-40 $mm^2/s$.

The above-mentioned lubricating base oils (I) and (IV), which satisfy at least one of the aforementioned conditions (a) and (b), have excellent low temperature viscosity characteristics and can significantly reduce viscous resistance and stirring resistance compared to conventional lubricating base oils of the same viscosity grade. Also, by including a pour point depressant it is possible to reduce the BF viscosity at −40° C. to 2000 mPa·s or lower. The BF viscosity at −40° C. is the viscosity measured according to JPI-5S-26-99.

The above-mentioned lubricating base oils (II) and (V), which satisfy at least one of the aforementioned conditions (a) and (b), have particularly excellent low temperature viscosity characteristics, low volatility and lubricity compared to conventional lubricating base oils of the same viscosity grade. For example, for lubricating base oils (II) and (V) it is possible to reduce the −35° C. CCS viscosity to 3000 mPa·s or lower.

The above-mentioned lubricating base oils (III) and (VI), which satisfy at least one of the aforementioned conditions (a) and (b), have excellent low temperature viscosity characteristics, low volatility, heat and oxidation stability and lubricity compared to conventional lubricating base oils of the same viscosity grade.

The viscosity index of the lubricating base oil of the invention will depend on the viscosity grade of the lubricating base oil, and for example, the viscosity index of the lubricating oils (I) and (IV) is preferably 105-130, more preferably 110-125 and even more preferably 120-125. Also, the viscosity index of the lubricating base oils (II) and (V) is preferably 125-160, more preferably 130-150 and even more preferably 135-150. The viscosity index of the lubricating base oils (III) and (VI) is preferably 135-180 and more preferably 140-160. If the viscosity index is below the aforementioned lower limit, the viscosity-temperature characteristic, heat and oxidation stability and low volatility will tend to be reduced. If the viscosity index is greater than the aforementioned upper limits, the low temperature viscosity characteristic will tend to be reduced.

The "viscosity index" for the invention is the viscosity index measured according to JIS K 2283-1993.

The 20° C. refractive index of the lubricating base oil of the invention will depend on the viscosity grade of the lubricating base oil, and for example, the 20° C. refractive index of the aforementioned lubricating base oils (I) and (IV) is preferably no greater than 1.455, more preferably no greater than 1.453 and even more preferably no greater than 1.451. The 20° C. refractive index of the lubricating base oils (II) and (V) is preferably no greater than 1.460, more preferably no greater than 1.457 and even more preferably no greater than 1.455. Also, the 20° C. refractive index of the lubricating base oils (III) and (VI) is preferably no greater than 1.465, more preferably no greater than 1.463 and even more preferably no greater than 1.460. If the refractive index exceeds the aforementioned upper limits, the viscosity-temperature characteristic, heat and oxidation stability, low volatility and low temperature viscosity characteristic of the lubricating base oil will tend to be reduced, and the efficacy of additives will tend to be lower when additives are included in the lubricating base oil.

The pour point of the lubricating base oil of the invention will depend on the viscosity grade of the lubricating base oil, and for example, the pour point of the lubricating base oils (I) and (IV) is preferably no higher than −10° C., more preferably no higher than −12.5° C. and even more preferably no higher than −15° C. The pour point of the lubricating base oils (II) and (V) is preferably no higher than −10° C., more preferably no higher than −15° C. and even more preferably no higher than −17.5° C. The pour point of the lubricating base oils (III) and (VI) is preferably no higher than −10° C., more preferably no higher than −12.5° C. and even more preferably no higher than −15° C. If the pour point is above the aforementioned upper limits, the cold flow property of the lubricating oil as a whole including the lubricating base oil will tend to be reduced. The pour point for the invention is the pour point measured according to JIS K 2269-1987.

The −35° C. CCS viscosity of the lubricating base oil of the invention will depend on the viscosity grade of the lubricating base oil, and for example, the −35° C. CCS viscosity of the lubricating base oils (I) and (IV) is preferably no greater than 1000 mPa·s. The −35° C. CCS viscosity of the lubricating base oils (II) and (V) is preferably no greater than 3000 mPa·s, more preferably no greater than 2400 mPa·s and even more preferably no greater than 2000 mPa·s. The −35° C. CCS viscosity of the lubricating base oils (III) and (VI) is preferably no greater than 15,000 mPa·s and more preferably no greater than 10,000 mPa·s. If the −35° C. CCS viscosity is greater than the aforementioned upper limits, the cold flow property of the lubricating oil as a whole including the lubricating base oil will tend to be reduced. The −35° C. CCS viscosity for the invention is the viscosity measured according to JIS K 2010-1993.

The 15° C. density ($\rho_{15}$) of the lubricating base oil of the invention will depend on the viscosity grade of the lubricating base oil, but it is preferably no greater than the value of ρ represented by formula (2) below, i.e. $\rho_{15} \leq \rho$.

$$\rho = 0.0025 \times kv100 + 0.816 \quad (2)$$

[wherein kv100 represents the kinematic viscosity ($mm^2/S$) at 100° C. of the lubricating base oil]

If $\rho_{15} > \rho$, the viscosity-temperature characteristic, heat and oxidation stability, low volatility and low temperature viscosity characteristic will tend to be reduced, and the efficacy of additives will tend to be lower when additives are included in the lubricating base oil.

For example, the $\rho_{15}$ value for lubricating base oils (I) and (IV) is preferably no greater than 0.825 and more preferably no greater than 0.820. The $\rho_{15}$ value for lubricating base oils (II) and (V) is preferably no greater than 0.835 and more preferably no greater than 0.830. The $\rho_{15}$ value for lubricating base oils (III) and (VI) is preferably no greater than 0.840 and more preferably no greater than 0.835.

The 15° C. density for the invention is the density measured at 15° C. according to JIS K 2249-1995.

The aniline point (AP (° C.)) of the lubricating base oil of the invention will depend on the viscosity grade of the lubricating base oil, but it is preferably equal to or greater than A represented by formula (3) below, i.e. AP>A.

$$A = 4.3 \times kv100 + 100 \quad (3)$$

[wherein kv100 represents the kinematic viscosity ($mm^2/s$) at 100° C. of the lubricating base oil]

If AP<A, the viscosity-temperature characteristic, heat and oxidation stability, low volatility and low temperature viscosity characteristic will tend to be reduced, and the efficacy of additives will tend to be lower when additives are included in the lubricating base oil.

For example, the AP value of lubricating base oils (I) and (IV) is preferably 108° C. or higher and more preferably 10° C. or higher. The AP value of lubricating base oils (II) and (V) is preferably 113° C. or higher and more preferably 119° C. or higher. The AP value of lubricating base oils (III) and (VI) is preferably 125° C. or higher and more preferably 128° C. or higher. The aniline point for the invention is the aniline point measured according to JIS K 2256-1985.

The NOACK evaporation loss of the lubricating base oil of the invention is not particularly restricted, and for example, the NOACK evaporation loss of lubricating base oils (I) and (IV) is preferably at least 20% by mass, more preferably at least 25% by mass and even more preferably 30% by mass or greater, and preferably no greater than 50% by mass, more preferably no greater than 45% by mass and even more preferably no greater than 40% by mass. The NOACK evaporation loss of lubricating base oils (II) and (V) is preferably at least 6% by mass, more preferably at least 8% by mass and even more preferably at least 10% by mass, and preferably no greater than 20% by mass, more preferably no greater than 16% by mass and even more preferably no greater than 15% by mass. The NOACK evaporation loss of lubricating base oils (III) and (VI) is preferably at least 0% by mass and more preferably at least 1% by mass, and preferably no greater than 5% by mass, more preferably no greater than 4% by mass and even more preferably no greater than 3% by mass. If the NOACK evaporation loss is below the aforementioned lower limits, it will tend to be difficult to achieve improvement in the low temperature viscosity characteristic. The NOACK evaporation loss is preferably not above the aforementioned upper limits, because the evaporation loss of the lubricating oil will become considerable and catalyst poisoning will be accelerated, when the lubricating base oil is used as an internal combustion engine lubricating oil. The NOACK evaporation loss for the invention is the evaporation loss measured according to ASTM D 5800-95.

The distillation properties of the lubricating base oil of the invention are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For example, as a distillation property of lubricating base oils (I) and (IV), the initial boiling point (IBP) is preferably 260-360° C., more preferably 300-350° C. and even more preferably 310-350° C. The 10% distillation temperature (T10) is preferably 320-400° C., more preferably 340-390° C. and even more preferably 350-380° C. The 50% distillation temperature (T50) is preferably 350-430° C., more preferably 360-410° C. and even more preferably 370-400° C. The 90% distillation temperature (T90) is preferably 380-460° C., more preferably 390-450° C. and even more preferably 400-440° C. The final boiling point (FBP) is preferably 420-520° C., more preferably 430-500° C. and even more preferably 440-480° C. T90-T10 is preferably 50-100° C., more preferably 55-85° C. and even more preferably 60-70° C. FBP-IBP is preferably 100-250° C., more preferably 110-220° C. and even more preferably 120-200° C. T10-IBP is preferably 10-80° C., more preferably 15-60° C. and even more preferably 20-50° C. FBP-T90 is preferably 10-80° C., more preferably 15-70° C. and even more preferably 20-60° C.

As a distillation property of lubricating base oils (II) and (V), the initial boiling point (IBP) is preferably 300-380° C., more preferably 320-370° C. and even more preferably 330-360° C. The 10% distillation temperature (T10) is preferably 340-420° C., more preferably 350-410° C. and even more preferably 360-400° C. The 50% distillation temperature (T50) is preferably 380-460° C., more preferably 390-450° C. and even more preferably 400-460° C. The 90% distillation temperature (T90) is preferably 440-500° C., more preferably 450-490° C. and even more preferably 460-480° C. The final boiling point (FBP) is preferably 460-540° C., more preferably 470-530° C. and even more preferably 480-520° C. T90-T10 is preferably 50-100° C., more preferably 60-95° C. and even more preferably 80-90° C. FBP-IBP is preferably 100-250° C., more preferably 120-180° C. and even more preferably 130-160° C. T10-IBP is preferably 10-70° C., more preferably 15-60° C. and even more preferably 20-50° C. FBP-T90 is preferably 10-50° C., more preferably 20-40° C. and even more preferably 25-35° C.

As a distillation property of lubricating base oils (III) and (VI), the initial boiling point (IBP) is preferably 320-480° C., more preferably 350-460° C. and even more preferably 380-440° C. The 10% distillation temperature (T10) is preferably 420-500° C., more preferably 430-480° C. and even more preferably 440-460° C. The 50% distillation temperature (T50) is preferably 440-520° C., more preferably 450-510° C. and even more preferably 460-490° C. The 90% distillation temperature (T90) is preferably 470-550° C., more preferably 480-540° C. and even more preferably 490-520° C. The final boiling point (FBP) is preferably 500-580° C., more preferably 510-570° C. and even more preferably 520-560° C. T90-T10 is preferably 50-120° C., more preferably 55-100° C. and even more preferably 55-90° C. FBP-IBP is preferably 100-250° C., more preferably 110-220° C. and even more preferably 115-200° C. T10-IBP is preferably 10-100° C., more preferably 15-90° C. and even more preferably 20-50° C. FBP-T90 is preferably 10-50° C., more preferably 20-40° C. and even more preferably 25-35° C.

If IBP, T10, T50, T90, FBP, T90-T10, FBP-IBP, T10-IBP and FBP-T90 of lubricating base oils (I)-(VI) are set to be within the aforementioned preferred ranges, it will be possible to achieve further improvement in the low temperature viscosity and further reduce evaporation loss. From the standpoint of economy, the distillation ranges for T90-T10, FBP-IBP, T10-IBP and FBP-T90 are preferably not too narrow because this can result in a poor lubricating base oil yield.

IBP, T10, T50, T90 and FBP for the invention are the distillation temperature measured according to ASTM D 2887-97.

The residual metal content of the lubricating base oil of the invention is a result of the metal content in the catalyst and starting material that reflects inevitable contamination during the production process, and sufficient removal of the residual metals is preferred. For example, the Al, Mo and Ni contents are each preferably no greater than 1 ppm by mass. If the contents of these metals are greater than the aforementioned upper limit, the functions of the additives included in the lubricating base oil will tend to be inhibited.

The residual metal content of the invention is the metal content measured according to JPI-5S-38-2003.

According to the lubricating base oil of the invention, satisfying at least condition (a) or (b) can result in excellent heat and oxidation stability, and preferably the RBOT life corresponding to the kinematic viscosity is as described below. For example, the RBOT life of lubricating base oils (I) and (IV) is preferably 290 min or longer, more preferably 300 min or longer and even more preferably 310 min or longer. The RBOT life of lubricating base oils (II) and (V) is preferably 350 min or longer, more preferably 360 min or longer and even more preferably 370 min or longer. The RBOT life of lubricating base oils (III) and (VI) is preferably 400 min or longer, more preferably 410 min or longer and even more preferably 420 min or longer. If the RBOT life is shorter than the aforementioned lower limits, the viscosity-temperature characteristic and heat and oxidation stability of the lubricating base oil will tend to be reduced, and the efficacy of additives will tend to be lower when additives are included in the lubricating base oil.

The RBOT life for the invention is the RBOT value measured according to JIS K 2514-1996, for a composition obtained by adding a phenolic antioxidant (2,6-di-tert-butyl-p-cresol; DBPC) at 0.2% by mass to the lubricating base oil.

The lubricating base oil of the invention having a structure as described above has an excellent viscosity-temperature characteristic and excellent heat and oxidation stability, as well as improved frictional properties of the lubricating base oil itself and an enhanced friction reducing effect, thus allowing increased energy savings. Also, when additives have been included in the lubricating base oil of the invention it is possible to exhibit a higher level of function of the additives (effect of improving heat and oxidation stability by antioxidants, friction reducing effect by friction modifiers, antiwear property improving effect by antiwear agents, etc.). Thus, the lubricating base oil of the invention can be suitably used as a base oil for various types of lubricating oils. As specific uses for the lubricating base oil of the invention, there may be mentioned lubricating oils (internal combustion engine lubricating oils) used in internal combustion engines such as passenger vehicle gasoline engines, two-wheeler gasoline engines, diesel engines, gas engines, gas heat pump engines, marine engines, electric power engines and the like, lubricating oils (power train device oils) used in power train devices such as automatic transmissions, manual transmissions, continuously variable transmissions, final reduction gears and the like, hydraulic oils used in hydraulic power units such as dampers, construction equipment and the like, as well as compressor oils, turbine oils, industrial gear oil, refrigeration oils, rust preventing oils, heating medium oils, gas holder seal oils, bearing oils, paper machine oils, machine tool oils, sliding guide surface oils, electrical insulation oils, cutting oils, press oils, rolling oils, heat treatment oils and the like, and using a lubricating base oil of the invention for such uses can improve the properties of lubricating oils including the viscosity-temperature characteristic, heat and oxidation stability, energy savings and fuel savings, while lengthening the lubricating oil life and achieving a higher level of reduction in the environmentally detrimental substances.

When a lubricating base oil of the invention is used as a base oil in a lubricating oil, the lubricating base oil of the invention may be used alone, or the lubricating base oil of the invention may be used in combination with one or more other base oils. When the lubricating base oil of the invention is used in combination with another base oil, the proportion of the lubricating base oil of the invention in the mixed base oil is preferably at least 30% by mass, more preferably at least 50% by mass and even more preferably at least at least 70% by mass.

There are no particular restrictions on other base oils to be used in combination with the lubricating base oil of the invention, and as examples of mineral base oils there may be mentioned solvent refined mineral oils, hydrocracked mineral oils, hydrorefined mineral oils and solvent dewaxed base oils with kinematic viscosities at 100° C. of 1-100 $mm^2/s$.

As synthetic base oils there may be mentioned poly-α-olefins and their hydrogenated compounds, isobutene oligomers and their hydrogenated compounds, isoparaffins, alkylbenzenes, alkylnaphthalenes, diesters (ditridecyl glutarates, di-2-ethylhexyl adipates, diisodecyl adipate, ditridecyl adipate, di-2-ethylhexyl sebacate and the like), polyol esters (trimethylolpropane caprylate, trimethylolpropane pelargonate, pentaerythritol 2-ethyl hexanoate, pentaerythritol pelargonate and the like), polyoxyalkylene glycols, dialkyldiphenyl ethers, polyphenyl ethers, and the like, among which poly α-olefins are preferred. As typical poly α-olefins there may be mentioned C2-32 and preferably C6-16 α-olefin oligomers or co-oligomers (1-octene oligomers, decene oligomers, ethylene-propylene co-oligomers and the like), and their hydrogenated compounds.

There are no particular restrictions on the method of preparing the poly α-olefins, and for example, there may be mentioned a method of polymerizing an α-olefin in the presence of a polymerization catalyst such as a Friedel-Crafts catalyst comprising a complex of aluminum trichloride or boron trifluoride with water, an alcohol (ethanol, propanol, butanol or the like), a carboxylic acid or an ester.

The additives to be included in the lubricating base oil of the invention are not particularly limited, and any desired additives that are commonly used in the field of lubricating oils may be included. As such lubricating oil additives there may be mentioned, specifically, antioxidants, ashless dispersants, metallic detergent, extreme-pressure agents, antiwear agents, viscosity index improvers, pour point depressants, friction modifiers, oiliness agents, corrosion inhibitors, rust-preventive agents, demulsifiers, metal deactivating agents, seal swelling agents, antifoaming agents, coloring agents and the like. These additives may be used alone or in combinations of two or more.

(Lubricating Oil Composition for Internal Combustion Engine)

In a lubricating oil composition for an internal combustion engine according to the invention, the aforementioned lubricating base oil of the invention may be used alone, or one or more other base oils may be used in combination with the lubricating base oil of the invention. When the lubricating base oil of the invention is used in combination with another base oil, the proportion of the lubricating base oil of the invention in the mixed base oil is preferably at least 30% by mass, more preferably at least 50% by mass and even more preferably at least 70% by mass.

As other base oils to be used in combination with the lubricating base oil of the invention there may be mentioned the mineral base oils and synthetic base oils cited above in explaining the lubricating base oil.

A lubricating oil composition for an internal combustion engine according to the invention comprises as component (A-1) an ashless antioxidant containing no sulfur as a constituent element. Suitable as component (A-1) are phenolic and amine ashless antioxidants containing no sulfur as a constituent element.

As specific examples of phenolic ashless antioxidants containing no sulfur as a constituent element there may be mentioned 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), octyl-3-(3,5-di-tert-butyl-4-hydroxyphenyl)propionate, tridecyl-3-(3,5-di-tert-butyl-4-hydroxyphenyl)propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate, octyl-3-(3-methyl-5-tert-butyl-4-hydroxyphenyl)propionate, and mixtures of the above. Preferred among these are hydroxyphenyl-substituted esteric antioxidants which are esters of hydroxyphenyl-substituted fatty acids and C4-12 alcohols (octyl-3-(3,5-di-tert-butyl-4-hydroxyphenyl)propionate, octyl-3-(3-methyl-5-tert-butyl-4-hydroxyphenyl)propionate and the like), and bisphenolic antioxidants, with hydroxyphenyl-substituted esteric antioxidants being more preferred. Phenolic compounds of molecular weight 240 and greater are also preferred because of their high decomposition temperature which allows them to exhibit their effects under higher temperature conditions.

As amine ashless antioxidants containing no sulfur as a constituent element there may be mentioned, specifically, phenyl-α-naphthylamine, alkylphenyl-α-naphthylamines, alkyldiphenylamines, dialkyldiphenylamines, N,N'-diphenyl-p-phenylenediamine and mixtures thereof. The alkyl groups of these amine ashless antioxidants are preferably C1-20 straight-chain or branched alkyl groups and more preferably C4-12 straight-chain or branched alkyl groups.

There are no particular restrictions on the content of component (A-1) according to the invention, but it is preferably at least 0.01% by mass, more preferably at least 0.1% by mass, even more preferably at least 0.5% by mass and most preferably at least 1.0% by mass, and preferably no greater than 5% by mass, more preferably no greater than 3% by mass and most preferably no greater than 2% by mass, based on the total weight of the composition. If the content is less than 0.01% by mass, the heat and oxidation stability of the lubricating oil composition will be insufficient, tending to prevent maintenance of satisfactory cleanability over prolonged period, in particular. On the other hand, if the content of component (A-1) is greater than 5% by mass, the storage stability of the lubricating oil composition will tend to be reduced.

According to the invention, component (A-1) is most preferably a combination of 0.4-2% by mass of a phenolic ashless antioxidant and 0.4-2% by mass of an amine ashless antioxidant, based on the total weight of the composition, or 0.5-2% by mass and more preferably 0.6-1.5% by mass of an amine antioxidant alone, in order to maintain satisfactory cleanability for long periods.

The lubricating oil composition for an internal combustion engine according to the invention contains as component (B-1) at least one compound selected from among (B-1-1) ashless antioxidants comprising sulfur as a constituent element, and (B-1-2) organic molybdenum compounds.

As (B-1-1) ashless antioxidants comprising sulfur as a constituent element there are preferred sulfurized fats and oils, dihydrocarbyl polysulfide, dithiocarbamates, thiadiazoles and phenolic ashless antioxidants comprising sulfur as a constituent element.

As examples of sulfurized fats and oils there may be mentioned oils such as sulfurized lard, sulfurized rapeseed oil, sulfurized castor oil, sulfurized soybean oil and sulfurized rice bran oil; disulfide fatty acids such as sulfurized oleic acid; and sulfurized esters such as sulfurized methyl oleate.

As examples of sulfurized olefins there may be mentioned the compound represented by the following general formula (4).

$$R^{11}—S_x—R^{12} \quad (4)$$

In general formula (4), $R^{11}$ represents a $C_{2-15}$ alkenyl group, $R^{12}$ represents a C2-15 alkyl group or alkenyl group, and x represents an integer of 1-8.

The compounds represented by general formula (4) above can be obtained by reacting a C2-15 olefin or its 2-4-mer with a sulfurizing agent such as sulfur or sulfur chloride. As examples of olefins, there are preferably used propylene, isobutene, diisobutene and the like.

A dihydrocarbyl polysulfide is a compound represented by the following general formula (5).

$$R^{13}—S_y—R^{14} \quad (5)$$

In general formula (5), $R^{13}$ and $R^{14}$ each separately represent a C1-20 alkyl (including cycloalkyl), C6-20 aryl or C7-20 arylalkyl group, and may be the same or different, while y represents an integer of 2-8.

As specific examples of $R^{13}$ and $R^{14}$ there may be mentioned methyl, ethyl, n-propyl, isopropyl, n-butyl, isobutyl, sec-butyl, tert-butyl, pentyls, hexyls, heptyls, octyls, nonyls, decyls, dodecyls, cyclohexyl, phenyl, naphthyl, tolyl, xylyl, benzyl and phenethyl.

As specific preferred examples of dihydrocarbyl polysulfides there may be mentioned dibenzylpolysulfide, di-tert-nonylpolysulfide, didodecylpolysulfide, di-tert-butylpolysulfide, dioctylpolysulfide, diphenylpolysulfide and dicyclohexylpolysulfide.

As preferred examples of dithiocarbamates there may be mentioned compounds represented by the following general formula (6) or (7).

[Chemical Formula 1]

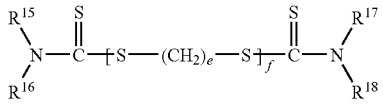

(6)

[Chemical Formula 2]

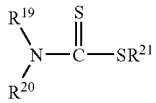

(7)

In general formulas (6) and (7), $R^{15}$, $R^{16}$, $R^{17}$, $R^{18}$, $R^{19}$ and $R^{20}$ each separately represent a C1-30 and preferably 1-20 hydrocarbon group, $R^{21}$ represents hydrogen or a C1-30 hydrocarbon group, and preferably hydrogen or a C1-20 hydrocarbon group, e represents an integer of 0-4 and f represents an integer of 0-6.

As examples of C1-30 hydrocarbon groups there may be mentioned alkyl, cycloalkyl, alkylcycloalkyl, alkenyl, aryl, alkylaryl and arylalkyl groups.

As examples of thiadiazoles there may be mentioned the 1,3,4-thiadiazole compounds represented by general formula (8) below, the 1,2,4-thiadiazole compounds represented by general formula (9) and the 1,4,5-thiadiazole compounds represented by general formula (10).

[Chemical Formula 3]

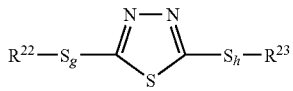

(8)

[Chemical Formula 4]

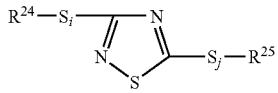

(9)

[Chemical Formula 5]

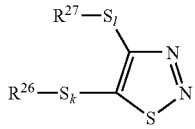

(10)

In general formulas (8)-(10), $R^{22}$, $R^{23}$, $R^{24}$, $R^{25}$, $R^{26}$ and $R^{27}$ may be the same or different and each separately represents hydrogen or a C1-30 hydrocarbon group, and g, h, i, j, k and l each separately represent an integer of 0-8.

As examples of C1-30 hydrocarbon groups there may be mentioned alkyl, cycloalkyl, alkylcycloalkyl, alkenyl, aryl, alkylaryl and arylalkyl groups.

As phenolic ashless antioxidants containing sulfur as a constituent element there may be mentioned 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide and 2,2'-thiodiethylenebis[3-(3,5-di-tert-butyl-4-hydroxyphenyl) propionate].

Of these (B-1-1) components there are preferably used dihydrocarbyl polysulfide, dithiocarbamates and thiadiazoles, from the viewpoint of obtaining more excellent heat and oxidation stability.

When a (B-1-1) ashless antioxidant containing sulfur as a constituent element is used as component (B-1) for the invention, the content is not particularly restricted, but it is preferably at least 0.001% by mass, more preferably at least 0.005% by mass and even more preferably at least 0.01% by mass, and preferably no greater than 0.2% by mass, more preferably no greater than 0.1% by mass and especially no greater than 0.04% by mass, in terms of sulfur element based on the total weight of the composition. If the content is less than the aforementioned lower limit, the heat and oxidation stability of the lubricating oil composition will be insufficient, especially tending to prevent maintenance of satisfactory cleanability over prolonged period. On the other hand, if it is greater than the aforementioned upper limit, the adverse effects of high sulfurization of the lubricating oil composition on exhaust gas purification devices will tend to be increased.

The (B-1-2) organic molybdenum compounds used as component (B-1) include (B-1-2-1) organic molybdenum compounds containing sulfur as a constituent element and (B-1-2-2) organic molybdenum compound containing no sulfur as a constituent element.

As examples of (B-1-2-1) organic molybdenum compounds containing sulfur as a constituent element there may be mentioned organic molybdenum complexes such as molybdenum dithiophosphate and molybdenum dithiocarbamate.

As specific examples of molybdenum dithiophosphates there may be mentioned compounds represented by the following general formula (11).

[Chemical Formula 6]

(11)

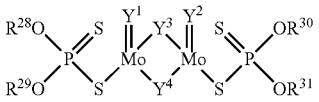

In general formula (11), $R^{28}$, $R^{29}$, $R^{30}$ and $R^{31}$ may be the same or different and each represents a C2-30, preferably C5-18 and more preferably C5-12 alkyl, or C6-18 and preferably C10-15 (alkyl)aryl hydrocarbon group. $Y^1$, $Y^2$, $Y^3$ and $Y^4$ each represent a sulfur atom or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, which may be primary alkyl, secondary alkyl or tertiary alkyl groups, and may be straight-chain or branched.

As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, where the alkyl groups may be primary alkyl, secondary alkyl or tertiary alkyl groups, and may be straight-chain or branched. These (alkyl)aryl groups also include all substituted isomers having different substitution positions of the alkyl groups on the aryl groups.

As specific examples of preferred molybdenum dithiophosphates there may be mentioned molybdenum sulfide diethyl dithiophosphate, molybdenum sulfide dipropyl dithiophosphate, molybdenum sulfide dibutyl dithiophosphate, molybdenum sulfide dipentyl dithiophosphate, molybdenum sulfide dihexyl dithiophosphate, molybdenum sulfide dioctyl dithiophosphate, molybdenum sulfide didecyl dithiophosphate, molybdenum sulfide didodecyl dithiophosphate, molybdenum sulfide di(butylphenyl)dithiophosphate, molybdenum sulfide di(nonylphenyl)dithiophosphate, oxymolybdenum sulfide diethyl dithiophosphate, oxymolybdenum sulfide dipropyl dithiophosphate, oxymolybdenum sulfide dibutyl dithiophosphate, oxymolybdenum sulfide dipentyl dithiophosphate, oxymolybdenum sulfide dihexyl dithiophosphate, oxymolybdenum sulfide dioctyl dithiophosphate, oxymolybdenum sulfide didecyl dithiophosphate, oxymolybdenum sulfide didodecyl dithiophosphate, oxymolybdenum sulfide di(butylphenyl)dithiophosphate and oxymolybdenum sulfide di(nonylphenyl)dithiophosphate (where the alkyl groups may be straight-chain or branched, and the alkyl groups may be bonded at any positions on the alkylphenyl groups), as well as mixtures of the above. Preferred for use as such molybdenum dithiophosphates are compounds having hydrocarbon groups with different number of carbons and/or different structures in the molecule.

As specific examples of molybdenum dithiocarbamates there may be mentioned compounds represented by the following general formula (12).

[Chemical Formula 7]

(12)

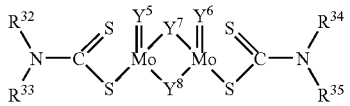

In general formula (12), $R^{32}$, $R^{33}$, $R^{34}$ and $R^{35}$ may be the same or different and each represents a C2-24 and preferably C4-13 alkyl, or a C6-24 and preferably C10-15 (alkyl)aryl hydrocarbon group. $Y^5$, $Y^6$, $Y^7$ and $Y^8$ each represent a sulfur atom or oxygen atom.

As preferred examples of alkyl groups there may be mentioned ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, which may be primary alkyl, secondary alkyl or tertiary alkyl groups, and may be straight-chain or branched.

As preferred examples of (alkyl)aryl groups there may be mentioned phenyl, tolyl, ethylphenyl, propylphenyl, butylphenyl, pentylphenyl, hexylphenyl, octylphenyl, nonylphenyl, decylphenyl, undecylphenyl and dodecylphenyl, where the alkyl groups may be primary alkyl, secondary alkyl or tertiary alkyl groups, and may be straight-chain or branched. These (alkyl)aryl groups also include all substituted isomers having different substitution positions of the alkyl groups on the aryl groups. As molybdenum dithiocarbamates other those having the structures described above, there may be mentioned those having structures with the dithiocarbamate group coordinated with thio- or polythiotrinuclear molybdenum, as disclosed in WO98/26030 or WO99/31113.

As preferred molybdenum dithiocarbamates there may be mentioned, specifically, molybdenum sulfide diethyl dithiocarbamate, molybdenum sulfide dipropyl dithiocarbamate, molybdenum sulfide dibutyl dithiocarbamate, molybdenum sulfide dipentyl dithiocarbamate, molybdenum sulfide dihexyl dithiocarbamate, molybdenum sulfide dioctyl dithiocarbamate, molybdenum sulfide didecyl dithiocarbamate, molybdenum sulfide didodecyl dithiocarbamate, molybdenum sulfide di(butylphenyl) dithiocarbamate, molybdenum sulfide di(nonylphenyl) dithiocarbamate, oxymolybdenum sulfide diethyl dithiocarbamate, oxymolybdenum sulfide dipropyl dithiocarbamate, oxymolybdenum sulfide dibutyl dithiocarbamate, oxymolybdenum sulfide dipentyl dithiocarbamate, oxymolybdenum sulfide dihexyl dithiocarbamate, oxymolybdenum sulfide dioctyl dithiocarbamate, oxymolybdenum sulfide didecyl dithiocarbamate, oxymolybdenum sulfide didodecyl dithiocarbamate, oxymolybdenum sulfide di(butylphenyl) dithiocarbamate, oxymolybdenum sulfide di(nonylphenyl) dithiocarbamate (where the alkyl groups may be straight-chain or branched, and the alkyl groups may be bonded at any positions on the alkylphenyl groups), as well as mixtures of the above. Preferred for use as such molybdenum dithiocarbamates are compounds having hydrocarbon groups with different number of carbons and/or different structures in the molecule.

As sulfur-containing organic molybdenum complexes other than these there may be mentioned complexes of molybdenum compounds (for example, molybdenum oxides such as molybdenum dioxide and molybdenum trioxide; molybdenum acids such as orthomolybdic acid, paramolybdic acid and (poly)sulfurized molybdic acid; molybdic acid salts such as metal and ammonium salts of these molybdic acids; molybdenum sulfides such as molybdenum disulfide, molybdenum trisulfide, molybdenum pentasulfide and molybdenum polysulfides; molybdenum halides such as sulfurized molybdic acid metal or amine salts, molybdenum chloride, and the like), with sulfur-containing organic compounds ((for example, alkyl(thio)xanthates, thiadiazoles, mercaptothiadiazoles, thiocarbonates, tetrahydrocarbylthiuram disulfide, bis(di(thio)hydrocarbyl dithiophosphonate) disulfide, organic (poly)sulfides sulfurized esters and the like) or other organic compounds, or complexes of sulfur-containing molybdenum compounds such as the aforementioned molybdenum sulfide, sulfurized molybdic acids and the like with alkenylsucciniimides.

A (B-1-2-1) organic molybdenum compound containing sulfur as a constituent element is preferably used as component (B-1) for the invention, with molybdenum dithiocarbamate being particularly preferred, to obtain a friction reducing effect in addition to improvement in heat and oxidation stability.

As (B-1-2-2) organic molybdenum compounds containing no sulfur as a constituent element there may be mentioned, specifically, molybdenum-amine complexes, molybdenum-succiniimide complexes, organic acid molybdenum salts, alcohol molybdenum salts and the like, among which molybdenum-amine complexes, organic acid molybdenum salts and alcohol molybdenum salts are preferred.

As molybdenum compounds in molybdenum-amine complexes, there may be mentioned sulfur-free molybdenum compounds such as molybdenum trioxide or hydrated compounds ($MoO_3.nH_2O$), molybdic acid ($H_2MoO_4$), molybdic acid alkali metal salts ($M_2MoO_4$; where M is an alkali metal), ammonium molybdate ($(NH_4)2MoO_4$ or $(H)_6[Mo_7O_{24}].4H_2O$), $MoCl_5$, $MoOCl_4$, $MoO_2Cl_2$, $MoO_2Br_2$, $Mo_2O_3Cl_6$, and the like. Preferred among these molybdenum compounds are hexavalent molybdenum compounds, from the viewpoint of the yield of the molybdenum-amine complex. From the viewpoint of availability, preferred hexavalent molybdenum compounds are molybdenum trioxide or hydrated compounds, molybdic acid, molybdic acid alkali metal salts and ammonium molybdate.

There are no particular restrictions on the nitrogen compounds in the molybdenum-amine complexes, and there may be mentioned ammonia, monoamines, diamines, polyamines and the like. More specific examples include alkylamines with C1-30 alkyl groups (where the alkyl groups may be straight-chain or branched) such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine and propylbutylamine; alkenylamines with C2-30 alkenyl groups (where the alkenyl groups may be straight-chain or branched), such as ethenylamine, propenylamine, butenylamine, octenylamine and oleylamine; alkanolamines with C1-30 alkanol groups (where the alkanol groups may be straight-chain or branched), such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine and propanolbutanolamine; alkylenediamines with C1-30 alkylene groups, such as methylenediamine, ethylenediamine, propylenediamine and butylenediamine; polyamines such as diethylenetriamine, triethylenetetramine, tetraethylenepentamine and pentaethylenehexamine; compounds which are the aforementioned monoamines, diamines or polyamines with C8-20 alkyl or alkenyl groups, such as undecyldiethylamine, undecyldiethanolamine, dodecyldipropanolamine, oleyldiethanolamine, oleylpropylenediamine and stearyltetraethylenepentamine, or heterocyclic compounds such as N-hydroxyethyloleylimidazoline; alkylene oxide addition products of the above compounds; and mixtures of the above. Preferred among these are primary amines, secondary amines and alkanolamines.

The number of carbon atoms of the hydrocarbon groups in the amine compounds of a molybdenum-amine complex is preferably 4 or greater, more preferably 4-30 and most preferably 8-18. If the number of carbon atoms of the hydrocarbon group in the amine compound is less than 4, the solubility will tend to be inferior. If the number of carbon atoms of the amine compound is 30 or less, it will be possible to relatively increase the molybdenum content of the molybdenum-amine complex, thereby allowing the effect of the invention to be increased with a smaller amount.

As molybdenum-succiniimide complexes there may be mentioned complexes with the sulfur-free molybdenum compounds that were cited above in explaining the molybdenum-amine complex, and with succiniimides having C4 or greater alkyl or alkenyl groups. As succiniimides there may be mentioned succiniimides having at least one C40-400 alkyl or alkenyl group in the molecule, or their derivatives, and succiniimides having C4-39 and preferably C8-18 alkyl or alkenyl groups. If the number of carbon atoms of the alkyl or alkenyl group in the succiniimide is less than 4, the solubility will tend to be inferior. Succiniimides having alkyl or alkenyl groups with greater than 30 and no more than 400 carbon atoms may be used, but by using alkyl or alkenyl groups with 30 or fewer carbon atoms it is possible to relatively increase the molybdenum content of the molybdenum-succiniimide complex, and allow the effect of the invention to be increased with a smaller amount.

As molybdenum salts of organic acids there may be mentioned salts of organic acids with molybdenum bases such as the molybdenum oxides or molybdenum hydroxides, molybdenum carbonic acid salts or molybdenum chlorides cited above in explaining the molybdenum-amine complex. As organic acids there are preferred phosphorus compounds represented by the following general formula (P-1) or (P-2) and carboxylic acids.

[Chemical Formula 8]

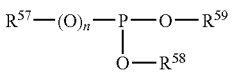

(P-1)

[wherein $R^{57}$ represents a C1-30 hydrocarbon group, $R^{58}$ and $R^{59}$ may be the same or different and each represents hydrogen or a C1-30 hydrocarbon group, and n represents 0 or 1]

[Chemical Formula 9]

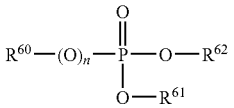

(P-2)

[wherein $R^{60}$, $R^{61}$ and $R^{62}$ may be the same or different and each represents hydrogen or a C1-30 hydrocarbon group, and n represents 0 or 1]

The carboxylic acids in carboxylic acid molybdenum salts may be monobasic acids or polybasic acids.

As monobasic acids there may usually be used C2-30 and preferably C4-24 fatty acids, where the fatty acids may be either straight-chain or branched, and either saturated or unsaturated. As specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid and straight-chain or branched tetracosanoic acid; unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid; as well as mixtures of the above.

As monobasic acids there may be used the aforementioned fatty acids, as well as monocyclic or polycyclic carboxylic acids (optionally containing hydroxyl groups), with preferably 4-30 and more preferably 7-30 carbon atoms. As monocyclic or polycyclic carboxylic acids there may be mentioned aromatic carboxylic acids or cycloalkylcarboxylic acids having 0-3 and preferably 1-2 C1-30 and preferably C1-20 straight-chain or branched alkyl groups, and more specifically, (alkyl)benzenecarboxylic acids, (alkyl)naphthalenecarboxylic acids, (alkyl)cycloalkylcarboxylic acids and the like. As preferred examples of monocyclic or polycyclic carboxylic acids there may be mentioned benzoic acid, salicylic acid, alkylbenzoic acids, alkylsalicylic acids, cyclohexanecarboxylic acid and the like.

As polybasic acids there may be mentioned dibasic acids, tribasic acids, tetrabasic acids and the like. The polybasic acids may be linear polybasic acids or cyclic polybasic acids. In the case of linear polybasic acids, they may be either straight-chain or branched, and either saturated or unsaturated. As linear polybasic acids there are preferred C2-16 linear dibasic acids, and specifically there may be mentioned ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenylsuccinic acids, and mixtures of the above. As cyclic polybasic acids there may be mentioned alicyclic dicarboxylic acids such as 1,2-cyclohexanedicarboxylic acid and 4-cyclohexene-1,2-dicarboxylic acid, aromatic dicarboxylic acids such as phthalic acid, aromatic tricarboxylic acids such as trimellitic acid, and aromatic tetracarboxylic acids such as pyromellitic acid.

As the aforementioned alcohol molybdenum salts there may be mentioned salts of alcohols with the sulfur-free molybdenum compounds cited above in explaining the molybdenum-amine complex, where the alcohols may be monohydric alcohols, polyhydric alcohols, partial esters or partial ester compounds of polyhydric alcohols, or hydroxyl group-containing nitrogen compounds (alkanolamines and the like). Molybdic acid is a strong acid that forms esters by reaction with alcohols, and esters of molybdic acid and alcohols are also included in the term "alcohol molybdenum salts" according to the invention.

As monohydric alcohols there may be used those with 1-24, preferably 1-12, and more preferably 1-8 carbon atoms, and such alcohols may be either straight-chain or branched, and either saturated or unsaturated. As specific examples of C1-24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

Suitable polyhydric alcohols for use are generally 2-10 and preferably 2-6 hydric alcohols. As specific examples of 2-10 hydric polyhydric alcohols there may be mentioned ethylene glycol, diethylene glycol, polyethylene glycol (3-15 mers of ethylene glycol), propylene glycol, dipropylene glycol, polypropylene glycol (3-15 mers of propylene glycol), dihydric alcohols such as 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, neopentyl glycol and the like; polyhydric alcohols such as glycerin, polyglycerin (2-8mers of glycerin including diglycerin, triglycerin and tetraglycerin), trimethylolalkane (trimethylolethane, trimethylolpropane and trimethylolbutane) and their 2-8mers, pentaerythritols and their 2-4-mers, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, mannitol and the like; and sugars such as xylose, arabinose, ribose, rhamnose, glucose, fructose, galactose, mannose, sorbose, cellobiose, maltose, isomaltose, trehalose and sucrose, and mixtures thereof.

As partial esters of polyhydric alcohols there may be mentioned the polyhydric alcohols cited above in explaining the polyhydric alcohol, that have been subjected to hydrocarbylesterification of some of the hydroxyl groups, among which glycerin monooleate, glycerin dioleate, sorbitan monooleate, sorbitan dioleate, pentaerythritol monooleate, polyethyleneglycol monooleate and polyglycerin monooleate are preferred.

As partial ethers of polyhydric alcohols there may be mentioned the polyhydric alcohols cited above in explaining the polyhydric alcohol, that have been subjected to hydrocarbyletherification of some of the hydroxyl groups, and compounds obtained by forming ether bonds by condensation between polyhydric alcohols (sorbitan condensation products and the like), among which 3-octadecyloxy-1,2-propanediol, 3-octadecenyloxy-1,2-propanediol, polyethyleneglycol alkyl ethers and the like are preferred.

As hydroxyl group-containing nitrogen compounds there may be mentioned the alkanolamines cited above in explaining the molybdenum-amine complex, and alkanolamides (diethanolamides and the like) obtained by amidation of the amino groups of such alkanols, among which stearyldiethanolamine, polyethyleneglycolstearylamine, polyethyleneglycol dioleylamine, hydroxyethyllaurylamine, diethanolamide oleate and the like are preferred.

When a (B-1-2-2) organic molybdenum compound containing no sulfur as a constituent element is used as the component (B-1) of the invention, it is possible to increase the high-temperature cleanability and base number retention of the lubricating oil composition while also allowing maintenance of the initial friction reducing effect for long periods, and it is particularly preferred to use molybdenum-amine complexes.

According to the invention, there may be used a combination of (B-1-2-1) an organic molybdenum compound containing sulfur as a constituent element and (B-1-2-2) an organic molybdenum compound containing no sulfur as a constituent element.

When a (B-1-2) organic molybdenum compound is used as component (B-1) for the invention, the content is not particularly restricted, but it is preferably at least 0.001% by mass, more preferably at least 0.005% by mass and even more preferably at least 0.01% by mass, and preferably no greater than 0.2% by mass, more preferably no greater than 0.1% by mass and most preferably no greater than 0.04% by mass in terms of molybdenum element, based on the total weight of the composition. If the content is less than 0.001% by mass, the heat and oxidation stability of the lubricating oil composition will be insufficient, especially tending to prevent maintenance of satisfactory cleanability over prolonged period. On the other hand, if the content of component (B-1-2) is greater than 0.2% by mass, no effect commensurate with the increased content will be obtained, and instead the storage stability of the lubricating oil composition will tend to be reduced.

The lubricating oil composition for an internal combustion engine according to the invention may consist of only the aforementioned lubricating base oil, components (A-1) and (B-1), but for further enhanced performance it may also contain the various additives mentioned below as necessary.

The lubricating oil composition for an internal combustion engine according to the invention also preferably contains an antiwear agent, from the viewpoint of further enhancing the antiwear property. As extreme-pressure agents there are preferably used phosphorus-containing extreme-pressure agents and phosphorus-sulfur-containing extreme-pressure agents.

As phosphorus-containing extreme-pressure agents there may be mentioned phosphoric acid, phosphorous acid, phosphoric acid esters (including phosphoric acid monoesters, phosphoric acid diesters and phosphoric acid triesters), phosphorous acid esters (including phosphorous acid monoesters, phosphorous acid diesters and phosphorous acid triesters) and salts thereof (amine salts or metal salts). As phosphoric acid esters and phosphorous acid esters there may be used in most cases those having C2-30 and preferably C3-20 hydrocarbon groups.

As phosphorus-sulfur-containing extreme-pressure agents there may be mentioned thiophosphoric acid, thiophosphorous acid, thiophosphoric acid esters (including thiophosphoric acid monoesters, thiophosphoric acid diesters and thiophosphoric acid triesters), thiophosphorous acid esters (including thiophosphorous acid monoesters, thiophosphorous acid diesters and thiophosphorous acid triesters), and their salts, as well as zinc dithiophosphate and the like. As thiophosphoric acid esters and thiophosphorous acid esters there may be used in most cases those having C2-30 and preferably C3-20 hydrocarbon groups.

There are no particular restrictions on the content of the extreme-pressure agent, but it is preferably 0.01-5% by mass and more preferably 0.1-3% by mass, based on the total weight of the composition.

According to the invention, zinc dithiophosphates are particularly preferred among the aforementioned extreme-pressure agents. Examples of zinc dithiophosphates include compounds represented by the following general formula (13).

[Chemical Formula 10]

(13)

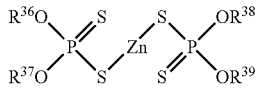

In general formula (13), $R^{36}$, $R^{37}$, $R^{38}$ and $R^{39}$ each separately represent a C1-24 hydrocarbon group. As such hydrocarbon groups there are preferred C1-24 straight chain or branched alkyl, C3-24 straight chain or branched alkenyl, C5-13 cycloalkyl or straight-chain or branched alkylcycloalkyl, C6-18 aryl or straight-chain or branched alkylaryl, and C7-19 arylalkyl. The alkyl groups or alkenyl groups may be primary, secondary or tertiary.

As specific examples of $R^{36}$, $R^{37}$, $R^{38}$ and $R^{39}$ there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl; alkenyl groups such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl (such as oleyl), nonadecenyl, eicosenyl, heneicosenyl, docosenyl, tricosenyl and tetracosenyl; cycloalkyl groups such as cyclopentyl, cyclohexyl and cycloheptyl; alkylcycloalkyl groups such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, di-propylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, di-propylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, di-propylcycloheptyl and propylethylmethylcycloheptyl; aryl groups such as phenyl and naphthyl; alkylaryl groups such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl and dodecylphenyl; and arylalkyl groups such as benzyl, methylbenzyl, dimethylbenzyl, phenethyl, methylphenethyl and dimethylphenethyl. These hydrocarbon groups include all possible linear structures and branched structures, with any desired positions of double bonds of the alkenyl groups, any desired bonding positions of alkyl groups on the cycloalkyl groups, any desired bonding positions of alkyl groups on the aryl groups, and any desired bonding positions of aryl groups on the alkyl groups.

As specific examples of preferred zinc dithiophosphates there may be mentioned zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate, zinc diisotridecyldithiophosphate, and any mixtures with any desired combinations thereof.

There are no particular restrictions on the method of producing the zinc dithiophosphate, and any conventional method may be employed. Specifically, for example, an alcohol or phenol having a hydrocarbon group corresponding to $R^{36}$, $R^{37}$, $R^{38}$ and $R^{39}$ in formula (13) above may be reacted with diphosphorus pentasulfide to produce dithiophosphoric acid, and the product neutralized with zinc oxide. The structure of the zinc dithiophosphate will differ depending on the starting alcohol used.

The content of the zinc dithiophosphate is not particularly restricted, but from the viewpoint of inhibiting catalyst poisoning in the exhaust gas purification device, it is preferably no greater than 0.2% by mass, more preferably no greater than 0.1% by mass, even more preferably no greater than 0.08% by mass and most preferably no greater than 0.06% by mass, in terms of phosphorus element based on the total weight of the composition. From the viewpoint of forming a phosphoric acid metal salt having an effect as an antiwear agent, the zinc dithiophosphate content is preferably at least 0.01% by mass, more preferably at least 0.02% by mass and even more preferably at least 0.04% by mass in terms of phosphorus element based on the total weight of the composition. If the zinc dithiophosphate content is below the aforementioned lower limit, the effect of improved antiwear property by the addition will tend to be insufficient.

The lubricating oil composition for an internal combustion engine according to the invention preferably further comprises an ashless dispersant from the viewpoint of cleanability and sludge dispersibility. As ashless dispersants there may be mentioned polyolefin-derived alkenylsucciniimides, alkylsucciniimides and their derivatives. A typical succiniimide can be obtained by reacting succinic anhydride substituted with a high-molecular-weight alkenyl group or alkyl group, with a polyalkylenepolyamine containing an average of 4-10 (preferably 5-7) nitrogen atoms per molecule. The high-molecular-weight alkenyl group or alkyl group is preferably polybutene (polyisobutene) with a number-average molecular weight of 700-5000, and more preferably polybutene (polyisobutene) with a number-average molecular weight of 900-3000.

As examples of polybutenylsucciniimides that may be suitably used in a lubricating oil composition for an internal combustion engine according to the invention, there may be mentioned compounds represented by the following general formula (14) or (15).

[Chemical Formula 11]

(14)

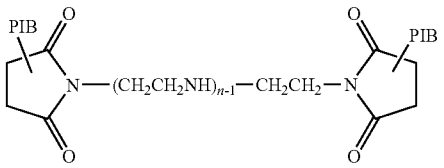

-continued

[Chemical Formula 12]

(15)

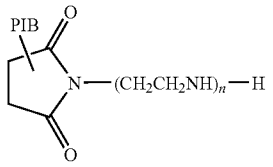

PIB in general formula (14) or (15) represents a polybutenyl group, and it is obtained from polybutene produced by polymerization of high-purity isobutene or a mixture of 1-butene and isobutene with a boron fluoride-based catalyst or aluminum chloride-based catalyst, and in a polybutene mixture the content of compounds with a terminal vinylidene structure is usually 5-100 mol %. From the viewpoint of the sludge-inhibiting effect, n is preferably an integer of 2-5 and more preferably an integer of 3-4.

There are no particular restrictions on the process for production of a succiniimide represented by general formula (14) or (15), and for example, it may be obtained by reacting a polyamine such as diethylenetriamine, triethylenetetramine, tetraethylenepentamine or pentaethylenehexamine, with a chlorinated compound of aforementioned polybutene, preferably highly-reactive polybutene (polyisobutene), which has been obtained by polymerization of aforementuioned high-purity isobutene by using a boron fluoride-based catalyst and more preferably a polybutenylsuccinic acid obtained by reacting polybutene, from which the chlorine or fluorine has been thoroughly removed, with maleic acid anhydride at 100-200° C. For production of a bis-succiniimide, the polybutenylsuccinic acid may be reacted with a two-fold amount (molar ratio) of the polyamine, and for production of a mono-succiniimide, the polybutenylsuccinic acid may be reacted with an equivalent amount (molar ratio) of the polyamine. From the standpoint of achieving excellent sludge dispersibility, a polybutenyl bis-succiniimide is preferred.

The polybutene used for the production process described above may contain trace amounts of residual fluorine or chlorine from the catalyst used in the production process, and the polybutene used preferably has the fluorine and chlorine adequately removed by an appropriate method such as adsorption or thorough water washing. The fluorine and chlorine contents are preferably no greater than 50 ppm by mass, more preferably no greater than 10 ppm by mass, even more preferably no greater than 5 ppm by mass and most preferably no greater than 1 ppm by mass.

During reaction of the polybutene with maleic anhydride to obtain polybutenylsuccinic anhydride, it is common in the prior art to apply a chlorination method using chlorine. However, the final succiniimide product obtained by this process contains a large amount of residual chlorine (for example, about 2000-3000 ppm). In methods using no chlorine, such as methods using highly-reactive polybutene and/or thermal reaction methods, it is possible to minimize residual chlorine in the final product to a very low level (for example, 0-30 ppm). Thus, the chlorine content of the lubricating oil composition is preferably kept to within a range of 0-30 ppm by mass by using polybutenylsuccinic anhydride obtained by a method employing highly-reactive polybutene and/or a thermal reaction method, instead of using the aforementioned chlorination method.

As polybutenylsuccinimide derivatives there may be used "modified succiniimides" obtained by reacting a boron compound such as boric acid or an oxygen-containing organic compound such as an alcohol, aldehyde, ketone, alkylphenol, cyclic carbonate, organic acid or the like with a compound represented by general formula (14) or (15) above for neutralization or amidation of all or a part of the residual amino and/or imino groups. Boron-containing alkenyl (or alkyl) succiniimides obtained by reaction with a boron compound such as boric acid are particularly useful from the standpoint of heat and oxidation stability.

As boron compounds to be reacted with the compound represented by general formula (14) or (15) there may be mentioned boric acid, boric acid salts, boric acid esters and the like. As examples of boric acids there may be mentioned, specifically, orthoboric acid, metaboric acid and tetraboric acid. As boric acid salts there may be mentioned alkali metal salts, alkaline earth metal salts or ammonium salts of boric acid, and more specifically there may be mentioned lithium borates such as lithium metaborate, lithium tetraborate, lithium pentaborate and lithium perborate; sodium borates such as sodium metaborate, sodium diborate, sodium tetraborate, sodium pentaborate, sodium hexaborate and sodium octaborate; potassium borates such as potassium metaborate, potassium tetraborate, potassium pentaborate, potassium hexaborate and potassium octaborate; calcium borates such as calcium metaborate, calcium diborate, tricalcium tetraborate, pentacalcium tetraborate and calcium hexaborate; magnesium borates such as magnesium metaborate, magnesium diborate, trimagnesium tetraborate, pentamagnesium tetraborate and magnesium hexaborate; and ammonium borates such as ammonium metaborate, ammonium tetraborate, ammonium pentaborate and ammonium octaborate. As boric acid esters there are preferred esters of boric acid and C1-6 alkyl alcohols, and more specifically there may be mentioned monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate and the like. A succiniimide derivative obtained by reaction with the boron compound is preferably used for excellent heat resistance and oxidation stability.

As examples of oxygen-containing organic compounds to be reacted with the compound represented by general formula (14) or (15) there may be mentioned, specifically, C1-30 monocarboxylic acids such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid, and C2-30 polycarboxylic acids such as oxalic acid, phthalic acid, trimellitic acid and pyromellitic acid or their anhydrides or ester compounds, C2-6 alkylene oxides, hydroxy(poly)oxyalkylene carbonates and the like. Reaction with such oxygen-containing organic compounds presumably converts all or a portion of the amino or imino groups in the compound represented by general formula (14) or (15) to the structure represented by the following general formula (16).

[Chemical Formula 13]

(16)

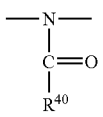

In general formula (16), $R^{40}$ represents hydrogen, C1-24 alkyl, C1-24 alkenyl, C1-24 alkoxy or a hydroxy(poly)oxyalkylene group represented by —O—$(R^{41}O)_m$H, $R^{41}$ represents a C1-4 alkylene group and m represents an integer of 1-5. Preferred among these for their excellent sludge dispersibility are polybutenyl bis-succiniimides that for the most part have these oxygen-containing organic compounds reacted with all of the amino or imino groups. Such compounds are obtained by reacting the oxygen-containing organic compounds with (n−1) mole with respect to 1 mol of the compound of formula (11), for example. A succiniimide derivative obtained by such reaction with an oxygen-containing organic compound has excellent sludge dispersibility, and reaction with hydroxy(poly)oxyalkylene carbonates is particularly preferred.

The weight-average molecular weight of the polybutenylsucciniimide and/or its derivative as the ashless dispersant used for the invention is preferably 5000 or greater, more preferably 6500 or greater, even more preferably 7000 or greater and most preferably 8000 or greater. If the weight-average molecular weight is less than 5000, the molecular weight of the non-polar polybutenyl group will be low resulting in inferior sludge dispersibility, while a relatively greater number of polar amine groups will be present that may act as active sites for oxidative degradation, thus impairing the oxidation stability and possibly preventing the life-lengthening effect of the invention from being realized. From the viewpoint of preventing deterioration of the low temperature viscosity property, the weight-average molecular weight of the polybutenylsucciniimide and/or its derivative is preferably no greater than 20,000 and most preferably no greater than 15,000. The weight-average molecular weight referred to here is the weight-average molecular weight in terms of polystyrene, measured using a series of two GMHHR-M (7.8 mmID×30 cm) columns by Tosoh Corp. in a 150-C ALC/GPC apparatus by Japan Waters Co., using a differential refractometer (R1) detector with tetrahydrofuran as the solvent, at a temperature of 23° C., a flow rate of 1 mL/min, a sample concentration of 1% by mass and a sample injection volume of 75 μL.

According to the invention, the ashless dispersant may be the aforementioned succiniimide and/or its derivative, an alkyl or alkenylpolyamine, an alkyl or alkenylbenzylamine, an alkyl or alkenylsuccinic acid ester, or a Mannich base or its derivative.

The content of the ashless dispersant in the lubricating oil composition for an internal combustion engine according to the invention is preferably at least 0.005% by mass, more preferably at least 0.01% by mass and even more preferably at least 0.05% by mass, and preferably no greater than 0.3% by mass, more preferably no greater than 0.2% by mass and even more preferably no greater than 0.15% by mass, in terms of nitrogen element based on the total weight of the composition. If the ashless dispersant content is not above the aforementioned lower limit a sufficient cleanability effect will not be exhibited, while if the content exceeds the aforementioned upper limit, the low temperature viscosity property and demulsifying property will be impaired. When a succiniimide ashless dispersant with a weight-average molecular weight of 6500 or greater is used, the content is preferably 0.005-0.05% by mass and more preferably 0.01-0.04% by mass in terms of nitrogen element based on the total weight of the composition, from the viewpoint of exhibiting sufficient sludge dispersibility and achieving an excellent low temperature viscosity property.

When a high-molecular-weight ashless dispersant is used, the content is preferably at least 0.005% by mass and more preferably at least 0.01% by mass, and preferably no greater than 0.1% by mass and more preferably no greater than 0.05% by mass, in terms of nitrogen element based on the total weight of the composition. If the high-molecular-weight ashless dispersant content is not above the aforementioned lower limit a sufficient cleanability effect will not be exhibited, while if the content exceeds the aforementioned upper limit, the low temperature viscosity property and demulsifying property will be impaired.

When a boron compound-modified ashless dispersant is used, the content is preferably at least 0.005% by mass, more preferably at least 0.01% by mass and even more preferably at least 0.02% by mass, and preferably no greater than 0.2% by mass and more preferably no greater than 0.1% by mass, in terms of boron element based on the total weight of the composition. If the content of the boron compound-modified ashless dispersant is not above the aforementioned lower limit a sufficient cleanability effect will not be exhibited, while if the content exceeds the aforementioned upper limit, the low temperature viscosity property and demulsifying property will be impaired.

The lubricating oil composition for an internal combustion engine according to the invention preferably also contains an ashless friction modifier from the viewpoint of further improvement in the frictional properties. As ashless friction modifiers there may be used any of the compounds ordinarily used as friction modifiers for lubricating oils, among which there may be mentioned, for example, ashless friction modifiers such as amine compounds, fatty acid esters, fatty acid amides, fatty acids, aliphatic alcohols, aliphatic ethers, hydrazides (oleyl hydrazides and the like), semicarbazides, ureas, ureido compounds and biurets that have at least one C6-30 alkyl or alkenyl group, and especially C6-30 straight-chain alkyl or straight-chain alkenyl group, in the molecule.

The content of the friction modifier in the lubricating oil composition for an internal combustion engine according to the invention is preferably at least 0.01% by mass, more preferably at least 0.1% by mass and even more preferably at least 0.3% by mass, and preferably no greater than 3% by mass, more preferably no greater than 2% by mass and even more preferably no greater than 1% by mass, based on the total weight of the composition. If the friction modifier content is less than the aforementioned lower limit, the friction reducing effect achieved by its addition will tend to be insufficient, while if it exceeds the aforementioned upper limit, the effects of the antiwear agents and other additives will be inhibited, or the solubility of the additives will tend to be reduced.

The lubricating oil composition for an internal combustion engine according to the invention preferably further comprises a metallic detergent from the viewpoint of cleanability. As metallic detergents there are preferred one or more alkaline earth metallic detergents selected from among alkaline earth metal sulfonates, alkaline earth metal phenates and alkaline earth metal salicylates.

As alkaline earth metal sulfonates there may be used alkaline earth metal salts, especially magnesium and/or calcium salts and especially calcium salts, of alkyl aromatic sulfonic acids obtained by sulfonation of alkyl aromatic compounds with molecular weights of 300-1,500 and preferably 400-700. As alkyl aromatic sulfonic acids there may be mentioned, specifically, petroleum sulfonic acids and synthetic sulfonic acids. As "petroleum sulfonic acids" there may be used sulfonated alkyl aromatic compounds of ordinary mineral lube-oil fractions, and "mahogany acids" which are by-products of white oil production. As synthetic sulfonic acids there may be used sulfonated products of alkylbenzene compounds with straight-chain or branched alkyl groups, obtained as by-products from production plants for alkylbenzenes used as detergent starting materials or obtained by alkylation of polyolefins into benzene, and sulfonated alkylnaphthalenes such as dinonylnaphthalene. There are no particular restrictions on the sulfonating agent used for sulfonation of these alkyl aromatic compounds, but normally fuming sulfuric acid or anhydrous sulfuric acid is used.

As alkaline earth metal phenates there may be mentioned alkaline earth metal salts, and especially magnesium and/or calcium salts, of Mannich reaction products of alkylphenols, alkylphenol sulfides and alkylphenols, and as examples there may be mentioned the compounds represented by the following general formulas (17)-(19).

[Chemical Formula 14]

(17)

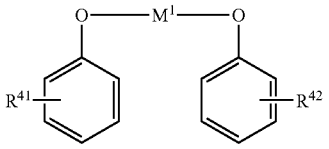

[Chemical Formula 15]

(18)

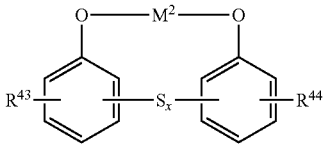

[Chemical Formula 16]

(19)

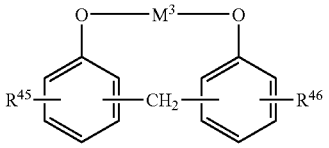

In general formulas (17)-(19), $R^{41}$, $R^{42}$, $R^{43}$, $R^{44}$, $R^{45}$ and $R^{46}$ may be the same or different and each represents a C4-30 and preferably 6-18 straight-chain or branched alkyl group, $M^1$, $M^2$ and $M^3$ each represent an alkaline earth metal, preferably calcium and/or magnesium, and x represents 1 or 2. As $R^{41}$, $R^{42}$, $R^{43}$, $R^{44}$, $R^{45}$ and $R^{46}$ in these formulas there may be mentioned, specifically, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl, which may be straight-chain or branched. These may be primary alkyl, secondary alkyl or tertiary alkyl groups.

As alkaline earth metal salicylates there may be mentioned alkaline earth metal salts, and especially magnesium and/or calcium salts, of alkylsalicylic acids, and as examples there may be mentioned the compounds represented by the following general formula (20).

[Chemical Formula 17]

(20)

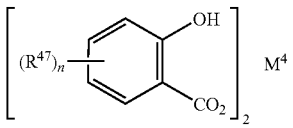

In general formula (20), $R^{47}$ represents a C1-30 and preferably 6-18 straight-chain or branched alkyl group, n is an integer of 1-4 and preferably 1 or 2, and $M^4$ represents an alkaline earth metal, preferably calcium and/or magnesium. As $R^{47}$ there may be mentioned, specifically, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl, which may be straight-chain or branched. These may be primary alkyl, secondary alkyl or tertiary alkyl groups.

Alkaline earth metal sulfonates, alkaline earth metal phenates and alkaline earth metal salicylates also include overbased (superbasic) alkaline earth metal sulfonates, overbased (superbasic) alkaline earth metal phenates and overbased (superbasic) alkaline earth metal salicylates, obtained by reaction of the aforementioned alkylaromatic sulfonic acids, alkylphenols, alkylphenol sulfides, alkylphenol Mannich reaction products, alkylsalicylic acids and the like directly with alkaline earth metal bases such as oxides or hydroxides of alkaline earth metals such as magnesium and/or calcium, or by reaction of alkaline earth metal hydroxides and carbon dioxide gas or boric acid in the presence of not only neutral (normal) alkaline earth metal sulfonates, neutral (normal salt) alkaline earth metal phenates and neutral (normal salt) alkaline earth metal salicylates obtained by first forming an alkali metal salt such as a sodium salt or potassium salt and then replacing it with an alkaline earth metal salt, but also basic alkaline earth metal sulfonates, basic alkaline earth metal phenates and basic alkaline earth metal salicylates obtained by heating neutral alkaline earth metal sulfonates, neutral alkaline earth metal phenates and neutral alkaline earth metal salicylates with excesses of alkaline earth metal salts or alkaline earth metal bases in the presence of water, or neutral alkaline earth metal sulfonates, neutral alkaline earth metal phenates and neutral alkaline earth metal salicylates.

According to the invention, the aforementioned neutral alkaline earth metal salts, basic alkaline earth metal salts, overbased (superbasic) alkaline earth metal salts and their mixtures may be used. Preferred among them from the viewpoint of maintaining cleanability for long periods are combinations of overbased calcium sulfonate and overbased calcium phenate, or overbased calcium salicylate, with overbased calcium salicylate being particularly preferred. Metallic detergents are generally sold as solutions with light lubricating base oils and the like and are therefore available, and for most purposes the metal content is 1.0-20% by mass and preferably 2.0-16% by mass. The total base number of the alkaline earth metallic detergent used for the invention may be as desired, but normally the total base number will be no greater than 500 mgKOH/g, though it is preferably 150-450 mgKOH/g. The total base number referred to here is the total base number determined based on the perchloric acid method and measured according to JIS K2501 (1992): "Petroleum Products and Lubricating Oils—Neutralization Number Test Method", Section 7.

The lubricating oil composition for an internal combustion engine according to the invention may have any desired metallic detergent content, but a content of 0.1-10% by mass, preferably 0.5-8% by mass and more preferably 1-5% by mass based on the total weight of the composition is preferred. A content exceeding 10% by mass is not preferred because an effect commensurate with the increased content will not be achieved.

The lubricating oil composition for an internal combustion engine according to the invention preferably also contains a viscosity index improver from the viewpoint of further improvement in the viscosity-temperature characteristic. As specific examples of viscosity index improvers there may be mentioned non-dispersant or dispersant polymethacrylates, dispersant ethylene-α-olefin copolymers or their hydrogenated compounds, polyisobutylene or its hydrogenated compound, styrene-diene hydrogenation copolymer, styrene-maleic anhydride ester copolymer and polyalkylstyrenes, among which there are preferred non-dispersant viscosity index improvers and/or dispersant viscosity index improvers with weight-average molecular weights of 10,000-1,000,000, preferably 100,000-900,000, more preferably 150,000-500,000 and even more preferably 180,000-400,000.

Specific examples of non-dispersant viscosity index improvers include homopolymers of monomers selected from among compounds represented by the following general formulas (21), (22) and (23) (hereinafter referred to as "monomer (M-1)") or copolymers of two or more of monomer (M-1) or hydrogenated compounds thereof. Specific examples of dispersant viscosity index improvers include copolymers of two or more monomers selected from among compounds represented by general formulas (24) and (25) (hereinafter referred to as "monomer (M-2)") or its hydrogenated compounds, having oxygen-containing groups introduced therein, and copolymers of one or more of monomer (M-1) selected from among compounds represented by general formulas (21)-(23) and one or more of monomer (M-2) selected from among compounds represented by general formulas (24) and (25), or hydrogenated compounds thereof.

[Chemical Formula 18]

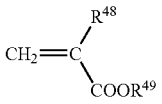

(21)

In general formula (21), $R^{48}$ represents hydrogen or a methyl group, and $R^{49}$ represents hydrogen or a C1-18 alkyl group. Specific examples of C1-18 alkyl groups represented by $R^{49}$ include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (where the alkyl groups may be straight-chain or branched).

[Chemical Formula 19]

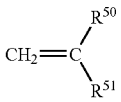

(22)

In general formula (22), $R^{50}$ represents hydrogen or a methyl group, and $R^{51}$ represents hydrogen or a C1-12 hydrocarbon group. Specific examples of C1-12 hydrocarbon groups represented by $R^{51}$ include alkyl groups such as methyl, ethyl, propyl, butyl, pentyl, hexyl, heptyl, octyl, nonyl, decyl, undecyl and dodecyl (where the alkyl groups may be straight-chain or branched); C5-7 cycloalkyl groups such as cyclopentyl, cyclohexyl and cycloheptyl; C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (where the alkyl groups may be substituted at any positions on the cycloalkyl groups); alkenyl groups such as butenyl, pentenyl, hexenyl, heptenyl, octenyl, nonenyl, decenyl, undecenyl and dodecenyl (where the alkenyl groups may be straight-chain or branched, and the double bonds may be at any desired positions); aryl groups such as phenyl and naphthyl; C7-12 alkylaryl groups such as tolyl, xylyl, ethylphenyl, propylphenyl, butylphenyl, pentylphenyl and hexylphenyl (where the alkyl groups may be straight-chain or branched, and substituted at any positions on the aryl groups); and C7-12 arylalkyl groups such as benzyl, phenylethyl, phenylpropyl, phenylbutyl, phenylpentyl and phenylhexyl (where the alkyl groups may be straight-chain or branched).

[Chemical Formula 20]

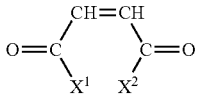

(23)

In general formula (23), $X^1$ and $X^2$ each separately represent hydrogen, a C1-18 alkoxy group (—$OR^{52}$: $R^{52}$ being a C1-18 alkyl group) or a C1-18 monoalkylamino group (—$NHR^{53}$: $R^{53}$ being a C1-18 alkyl group).

[Chemical Formula 21]

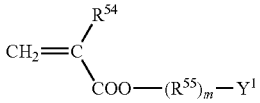

(24)

In general formula (23), $R^{54}$ represents hydrogen or a methyl group, $R^{55}$ represents a C1-18 alkylene group, $Y^1$ represents an amine residue or heterocyclic residue containing 1-2 nitrogen atoms and 0-2 oxygen atoms, and m is 0 or 1. Specific examples of C1-18 alkylene groups for $R^{55}$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene (where the alkylene groups may be straight-chain or branched). Specific examples of groups represented by $Y^1$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

[Chemical Formula 22]

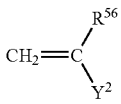

(25)

In general formula (25), $R^{56}$ represents hydrogen or a methyl group and $Y^2$ represents an amine residue or heterocyclic residue containing 1-2 nitrogen atoms and 0-2 oxygen atoms. Specific examples of groups represented by $Y^2$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

Preferred examples for monomer (M-1) include, specifically, C1-18 alkyl acrylates, C1-18 alkyl methacrylates, C2-20 olefins, styrene, methylstyrene, anhydrous maleic acid esters, anhydrous maleic acid amides, and mixtures thereof.

Preferred examples for monomer (M-2) include, specifically dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

The copolymerization molar ratio in the copolymer of one or more monomers selected from among the aforementioned (M-1) compounds and one or more monomers selected from among the aforementioned (M-2) compounds is generally in the range of monomer (M-1):monomer (M-2)=80:20-95:5. Any production process may be employed, but usually the copolymer can be easily obtained by radical solution polymerization of monomer (M-1) and monomer (M-2) in the presence of a polymerization initiator such as benzoyl peroxide.

Polymethacrylate viscosity index improvers are preferred among the viscosity index improvers mentioned above from the standpoint of achieving a more excellent cold flow property.

The viscosity index improver content in the lubricating oil composition for an internal combustion engine according to the invention is preferably 0.1-15% by mass and more preferably 0.5-5% by mass based on the total weight of the composition. If the viscosity index improver content is less than 0.1% by mass, the improving effect on the viscosity-temperature characteristic by the addition will tend to be insufficient, while if it is greater than 15% by mass, it will tend to be difficult to maintain the initial extreme-pressure property for long periods.

In addition to the additives mentioned above, the lubricating oil composition for an internal combustion engine according to the invention may also contain other additives as necessary, such as corrosion inhibitors, rust-preventive agents, demulsifiers, metal deactivating agents, pour point depressants, rubber swelling agents, antifoaming agents, coloring agents and the like, either alone or in combinations of more than one, in order to achieve even better performance.

As examples of corrosion inhibitors there may be mentioned benzotriazole-based, tolyltriazole-based, thiadiazole-based and imidazole-based compounds.

As examples of rust-preventive agents there may be mentioned petroleum sulfonates, alkylbenzene sulfonates, dinonylnaphthalene sulfonates, alkenylsuccinic acid esters and polyhydric alcohol esters.

As examples of demulsifiers there may be mentioned polyalkyleneglycol-based nonionic surfactants such as polyoxyethylenealkyl ethers, polyoxyethylenealkylphenyl ethers and polyoxyethylenealkylnaphthyl ethers.

As examples of metal deactivating agents there may be mentioned imidazolines, pyrimidine derivatives, alkylthiadiazoles, mercaptobenzothiazoles, benzotriazoles and their derivatives, 1,3,4-thiadiazole polysulfide, 1,3,4-thiadiazolyl-2,5-bisdialkyl dithiocarbamates, 2-(alkyldithio)benzoimidazoles and β-(o-carboxybenzylthio)propionitrile.

As pour point depressants there may be selected any known pour point depressants that are suitable for the properties of the lubricating base oil, but there are preferred polymethacrylates with weight-average molecular weights of greater than 50,000 and no greater than 150,000, and preferably 80,000-120,000.

As antifoaming agents there may be used any compounds normally used as antifoaming agents for lubricating oils, and as examples there may be mentioned silicones such as dimethylsilicone and fluorosilicone. One or more compounds selected as desired from among these may be added in any desired amounts.

As coloring agents there may be used any compounds that are ordinarily used, in any desired amounts, but the content will usually be 0.001-1.0% by mass based on the total weight of the composition.

When such additives are included in the lubricating oil composition of the invention, the contents will usually be selected in a range of 0.005-5% by mass for corrosion inhibitors, rust-preventive agents and demulsifiers, 0.005-1% by mass for metal deactivating agents, 0.05-1% by mass for pour point depressants, 0.0005-1% by mass for antifoaming agents and 0.001-1.0% by mass for coloring agents, based on the total weight of the composition.

The lubricating oil composition for an internal combustion engine according to the invention may also contain additives that comprise sulfur as a constituent element, as mentioned above, but from the standpoint of solubility of the additives and inhibiting depletion of the base number due to production of sulfur oxides under hot oxidation conditions, the total sulfur content of the lubricating oil composition (the total sulfur content from the lubricating base oil and additives) is preferably 0.05-0.3% by mass, more preferably 0.08-0.25% by mass, even more preferably 0.1-0.2% by mass and most preferably 0.12-0.18% by mass.

The kinematic viscosity at 100° C. of the lubricating oil composition for an internal combustion engine of the invention will usually be 4-24 $mm^2/s$, but from the standpoint of retaining the oil film thickness that inhibits seizure and wear, and preventing increase in stirring resistance, it is preferably 5-18 $mm^2/s$, more preferably 6-15 $mm^2/s$ and even more preferably 7-12 $mm^2/s$.

The lubricating oil composition for an internal combustion engine of the invention having the construction described above exhibits excellent heat and oxidation stability as well as superiority of the viscosity-temperature characteristic, frictional properties and low volatility, and when used as a lubricating oil for internal combustion engines such as gasoline engines, diesel engines, oxygen compound-containing fuel engines and gas engines for two-wheel vehicles, four-wheel vehicles, electricity generation, ships and the like, it can satisfactorily realize a long drain property and energy savings.

(Lubricating Oil Composition for Power Train Device)

The lubricating oil composition for a power train device according to the invention may employ a single lubricating base oil of the invention, or it may employ the lubricating base oil of the invention with one or more other base oils. When the lubricating base oil of the invention is used together with another base oil, the proportion of the lubricating base oil of the invention in the total mixed base oil is preferably at least 30% by mass, more preferably at least 50% by mass and even more preferably at least 70% by mass.

As other base oils to be used in combination with the lubricating base oil of the invention there may be mentioned the mineral base oils and synthetic base oils cited above in explaining the lubricating base oil.

The lubricating oil composition for a power train device of the invention comprises a poly(meth)acrylate-based viscosity index improver as component (A-2). By combining the poly(meth)acrylate-based viscosity index improver with a lubricating base oil of the invention, it is possible to effectively exhibit a viscosity index-improving effect, a low temperature viscosity-reducing effect and a pour point-lowering effect, in addition to the original excellent viscosity-temperature characteristic of the lubricating base oil, and therefore to achieve high level low temperature characteristics.

There are no particular restrictions on the poly(meth)acrylate-based viscosity index improver in the lubricating oil composition for a power train device according to the invention, and there may be used non-dispersant or dispersant poly(meth)acrylate compounds that are used as viscosity index improvers for lubricating oils. As non-dispersant poly (meth)acrylate-based viscosity index improvers there may be mentioned polymers of compounds represented by the following general formula (26).

[Chemical Formula 23]

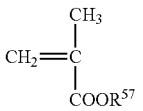

(26)

In general formula (26), $R^{57}$ represents a C1-30 alkyl group. The alkyl group represented by $R^{57}$ may be straight-chain or branched. Specific examples include methyl, ethyl, propyl, butyl, pentyl, hexyl, heptyl, octyl, nonyl, decyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl (which alkyl groups may be straight-chain or branched).

As specific preferred examples of dispersant poly(meth) acrylate-based viscosity index improvers there may be mentioned copolymers obtained by copolymerizing one or more monomers selected from among compounds represented by general formula (26) above and one or more nitrogen-containing monomers selected from among compounds represented by general formula (27) or (28) below.

[Chemical Formula 24]

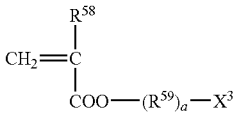

(27)

[Chemical Formula 25]

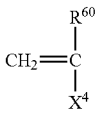

(28)

In general formulas (27) and (28), $R^{58}$ and $R^{60}$ each separately represent hydrogen or a methyl group. $R^{59}$ represents a C1-30 alkylene group, and specific examples thereof include methylene, ethylene, propylene, butylene, pentylene, hexylene, heptylene, octylene, nonylene, decylene, undecylene, dodecylene, tridecylene, tetradecylene, pentadecylene, hexadecylene, heptadecylene, octadecylene, nonadecylene, eicosylene, heneicosylene, docosylene, tricosylene, tetracosylene, pentacosylene, hexacosylene, heptacosylene, octacosylene, nonacosylene and triacontylene (which alkylene groups may be straight-chain or branched). The letter "a" represents an integer of 0 or 1, and $X^3$ and $X^4$ each separately represent an amine residue or heterocyclic residue with 1-2 nitrogen atoms and 0-2 oxygen atoms. Specific preferred examples of $X^3$ and $X^4$ include dimethylamino, diethylamino, dipropylamino, dibutylamino, anilino, toluidino, xylidino, acetylamino, benzoylamino, morpholino, pyrolyl, pyrrolino, pyridyl, methylpyridyl, pyrrolidinyl, piperidinyl, quinonyl, pyrrolidonyl, pyrrolidono, imidazolino and pyrazino.

Specific preferred examples of nitrogen-containing monomers represented by general formulas (27) and (28) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures thereof.

The poly(meth)acrylate-based viscosity index improver used for the invention may be either dispersant or non-dispersant as mentioned above, but preferably a non-dispersant poly(meth)acrylate-based viscosity index improver is used, and more preferably one of the following (A-2-1)-(A-2-3).

(A-2-1) A polymer composed mainly of a monomer of general formula (26) wherein $R^{57}$ is methyl or a C12-15 straight-chain alkyl group.

(A-2-2) A polymer composed mainly of a monomer of general formula (26) wherein $R^{57}$ is methyl or a C12-15, 16 or 18 straight-chain alkyl group.

(A-2-3) A polymer of a monomer of general formula (26) wherein $R^{57}$ is methyl or a C12-15, 16 or 18 straight-chain alkyl group and a monomer of general formula (26) wherein $R^{57}$ is a C20-30 straight-chain or branched alkyl group.

Among polymers (A-2-1)-(A-2-3) above there are particularly preferred polymers (A-2-2) and (A-2-3), from the standpoint of enhancing the fatigue life. Preferred for polymer (A-2-3) is one comprising as a constituent unit a monomer of general formula (26) wherein $R^{57}$ is a C22-28 branched alkyl group (more preferably 2-decyltetradecyl).

The weight-average molecular weight of the poly(meth) acrylate-based viscosity index improver in a lubricating oil composition for a power train device according to the invention is not particularly restricted, but it is preferably 5,000-100,000, more preferably 10,000-60,000 and even more preferably 15,000-24,000. If the weight-average molecular weight of the poly(meth)acrylate-based viscosity index improver is less than 5,000, the viscosity-increasing effect by addition of the viscosity index improver will be insufficient, and if it is greater than 100,000, the fatigue life, antiwear property and shear stability will be insufficient. Here, the weight-average molecular weight is the weight-average molecular weight in terms of polystyrene, measured using a series of two GMHHR-M (7.8 mmID×30 cm) columns by Tosoh Corp. in a 150-C ALC/GPC apparatus by Japan Waters Co., with tetrahydrofuran as the solvent, a differential refractometer (RI) detector as the detector, at a temperature of 23° C., a flow rate of 1 mL/min, a sample concentration of 1% by mass and a sample injection volume of 75 μL.

The content of the poly(meth)acrylate-based viscosity index improver in a lubricating oil composition for a power train device according to the invention is not particularly restricted, but it is preferably 0.1-20% by mass and more preferably 1-15% by mass. If the poly(meth)acrylate-based viscosity index improver content is less than 0.1% by mass, the viscosity-increasing effect and cold flow property-improving effect by the addition will tend to be insufficient, while if it is greater than 20% by mass, the viscosity of the lubricating oil composition will increase to prevent fuel savings, and the shear stability will tend to be reduced. When a poly(meth)acrylate-based viscosity index improver is added to the lubricating base oil, a mixture of the poly(meth)acrylate-based viscosity index improver dissolved in a diluent at 5-95% by mass is usually added to the lubricating base oil to improve the lubricity and handling property, and the poly (meth)acrylate-based viscosity index improver content in this case is the total of the poly(meth)acrylate-based viscosity index improver and the diluent.

The lubricating oil composition for a power train device according to the invention contains a phosphorus-containing compound as component (B-2). As such phosphorus-containing compounds there are preferably used phosphorus-containing extreme-pressure agents and phosphorus-sulfur-containing extreme-pressure agents. Specific examples and preferred embodiments of phosphorus-containing extreme-pressure agents and phosphorus-sulfur-containing extreme-pressure agents are the same phosphorus-containing extreme-pressure agents and phosphorus-sulfur-containing extreme-pressure agents used in the lubricating oil composition for an internal combustion engine of the invention, and therefore they will not be cited again here.

As phosphorus-containing compounds to be used in a lubricating oil composition for a power train device according to the invention there are preferably used phosphorous acid diester-containing extreme-pressure agents such as di-2-ethylhexyl phosphite from the viewpoint of improving the fatigue life and heat and oxidation stability, while trithiophosphorous acid triester-containing extreme-pressure agents such as trilauryl trithiophosphite are preferably used from the viewpoint of improving the fatigue life and zinc dialkyldithiophosphates are preferably used from the viewpoint of improving the antiwear property.

The content of the phosphorus-containing compound in the lubricating oil composition for a power train device according to the invention is not particularly restricted, but from the standpoint of fatigue life, extreme-pressure property, antiwear property and oxidation stability, it is preferably 0.01-0.2% by mass and more preferably 0.02-0.15% by mass in terms of phosphorus element based on the total weight of the composition. If the phosphorus-containing compound content is below this lower limit, the lubricity will tend to be insufficient. Also, when the lubricating oil composition is used as a lubricating oil for a manual transmission, the synchro property (the ability to accomplish lubrication permitting gears with different reduction gear ratios to interlock properly and function) will tend to be unsatisfactory. If the phosphorus-containing compound content is above the aforementioned upper limit, the fatigue life will tend to be insufficient. Also, when the lubricating oil composition is used as a lubricating oil for a manual transmission, the heat and oxidation stability will tend to be unsatisfactory.

The lubricating oil composition for a power train device according to the invention may consist entirely of the aforementioned lubricating base oil, poly(meth)acrylate-based viscosity index improver and phosphorus-containing compound, or if necessary it may also contain various additives as described below.

From the standpoint of further enhancing the fatigue life, extreme-pressure property and antiwear property, the lubricating oil composition for a power train device according to the invention preferably also contains a sulfur-containing extreme-pressure agent in addition to the aforementioned phosphorus-sulfur-containing extreme-pressure agent. As sulfur-containing extreme-pressure agents there may be mentioned sulfurized fats and oils, olefin sulfides, dihydrocarbyl polysulfides, dithiocarbamates, thiadiazoles, benzothiazoles and the like, among which one or more sulfur-containing extreme-pressure agents selected from among sulfurized fats and oils, olefin sulfides, dihydrocarbyl polysulfides, dithiocarbamates, thiadiazoles and benzothiazoles are preferred.

As sulfurized fats and oils, olefin sulfides, dihydrocarbyl polysulfides, dithiocarbamates and thiadiazoles to be used as sulfur-containing extreme-pressure agents in the lubricating oil composition for a power train device according to the invention there may be mentioned the sulfurized fats and oils, olefin sulfides, dihydrocarbyl polysulfides, dithiocarbamates and thiadiazoles mentioned for component (B-1-1) in explaining the lubricating oil composition for an internal combustion engine according to the invention.

The content of the sulfur-containing extreme-pressure agent in the lubricating oil composition for a power train device according to the invention is not particularly restricted, but from the standpoint of fatigue life, extreme-pressure property, antiwear property and oxidation stability, it is preferably 0.01-3% by mass, more preferably 0.1-3% by mass, even more preferably 0.5-2.5% by mass and most preferably 1.5-2.5% by mass, in terms of sulfur element based on the total weight of the composition. If the sulfur-containing extreme-pressure agent content is below this lower limit, the lubricity will tend to be insufficient. Also, when the lubricating oil composition is used as a lubricating oil for a manual transmission, the synchro property (the ability to accomplish lubrication that permits gears with different reduction gear ratios to interlock properly and function) will tend to be unsatisfactory. If the sulfur-containing extreme-pressure agent content is above the aforementioned upper limit, the fatigue life will tend to be insufficient. Also, when the lubricating oil composition is used as a lubricating oil for a manual transmission, the heat and oxidation stability will tend to be unsatisfactory. Since the extreme-pressure property must be increased when the lubricating oil composition for a power train device according to the invention is used as a lubricating oil for a final reduction gear, the sulfur-containing extreme-pressure agent content is preferably 0.5-3% by mass and more preferably 1.5-2.5% by mass in terms of sulfur element based on the total weight of the composition.

As mentioned above, the lubricating oil composition for a power train device according to the invention comprises a poly(meth)acrylate-based viscosity index improver, but it may further contain a viscosity index improver other than the poly(meth)acrylate-based viscosity index improver. As such viscosity index improvers there may be mentioned dispersant ethylene-α-olefin copolymers or their hydrogenated compounds, polyisobutylene or their hydrogenated compounds, styrene-diene hydrogenated copolymers, styrene-anhydrous maleic acid ester copolymers and polyalkylstyrenes.

When using these viscosity index improvers, the contents are normally selected within a range of 0.1-10% by mass based on the total weight of the composition.

The lubricating oil composition for a power train device according to the invention preferably also comprises an ashless dispersant from the viewpoint of improving the antiwear property, heat and oxidation stability and frictional properties. As examples of ashless dispersants there may be mentioned the following nitrogen compounds (D-1)-(D-3). These may be used alone or in combinations of two or more.

(D-1) Succiniimides with at least one C40-400 alkyl or alkenyl group in the molecule, or derivatives thereof.

(D-2) Benzylamines with at least one C40-400 alkyl or alkenyl group in the molecule, or derivatives thereof.

(D-3) Polyamines with at least one C40-400 alkyl or alkenyl group in the molecule, or derivatives thereof.

(D-1) More specific examples of succiniimides include compounds represented by the following general formulas (29) and (30).

[Chemical Formula 26]

(29)

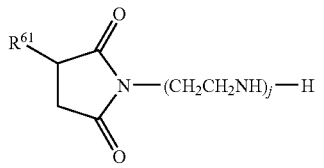

[Chemical Formula 27]

(30)

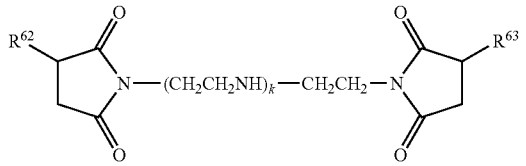

In general formula (29), $R^{61}$ represents a C40-400 and preferably 60-350 alkyl or alkenyl group, and j represents an integer of 1-5 and preferably 2-4.

In general formula (30), $R^{62}$ and $R^{63}$ each separately represent a C40-400 and preferably 60-350 alkyl or alkenyl group, and k represents an integer of 0-4 and preferably 1-3.

The aforementioned succiniimides include monotype succiniimides represented by general formula (29) which have succinic anhydride added to one end of the polyamine, and bis-type succiniimides represented by general formula (30) which have succinic anhydride added onto both ends of the polyamine, and the composition of the invention may be either of these forms or a combination of both.

More specific examples of the (D-2) benzylamines include compounds represented by the following general formula (31).

[Chemical Formula 28]

(31)

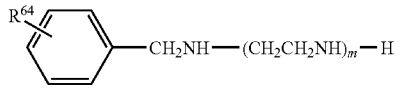

In general formula (31), $R^{25}$ represents a C40-400 and preferably 60-350 alkyl or alkenyl group, and m represents an integer of 1-5 and preferably 2-4.

Benzylamines may be obtained, for example, by reacting a polyolefin (for example, propylene oligomer, polybutene, ethylene-α-olefin copolymer or the like) with a phenol to produce an alkylphenol, and then reacting this with formaldehyde and a polyamine (for example, diethylenetriamine, triethylenetetramine, tetraethylenepentamine, pentaethylenehexamine or the like) by Mannich reaction.

More specific examples of (D-3) polyamines include compounds represented by the following general formula (32).

$$R^{65}—NH—(CH_2CH_2NH)_n—H \quad (32)$$

In general formula (32), $R^{26}$ represents a C40-400 and preferably 60-350 alkyl or alkenyl group, and m represents an integer of 1-5 and preferably 2-4.

Polyamines may be obtained, for example, by chlorinating a polyolefin (for example, propylene oligomer, polybutene, ethylene-α-olefin copolymer or the like), and then reacting the product with ammonia or a polyamine (for example, ethylenediamine, diethylenetriamine, triethylenetetramine, tetraethylenepentamine, pentaethylenehexamine or the like).

The nitrogen compound may have any desired nitrogen content, but from the viewpoint of antiwear property, oxidation stability and frictional properties, the nitrogen content is in most cases preferably 0.01-10% by mass and more preferably 0.1-10% by mass.

As examples of nitrogen compound derivatives there may be mentioned acid-modified compounds obtained by reacting C2-30 monocarboxylic acids (fatty acids and the like) or C2-30 polycarboxylic acids such as oxalic acid, phthalic acid, trimellitic acid or pyromellitic acid with the aforementioned nitrogen compounds, and then neutralizing or amidating all or a portion of the remaining amino and/or imino groups; boron-modified compounds obtained by reacting boric acid with the aforementioned nitrogen compounds and neutralizing or amidating all or a portion of the remaining amino and/or imino groups; sulfur-modified compounds obtained by reacting sulfur compounds with the aforementioned nitrogen compounds; and modified compounds obtained by a combination of two or more modifications selected from among acid-modification, boron modification and sulfur modification of the aforementioned nitrogen compounds.

When the lubricating oil composition for a power train device according to the invention comprises an ashless dispersant, the content thereof is not particularly restricted but is preferably 0.5-10.0% by mass and more preferably 1-8.0% by mass based on the total weight of the composition. If the ashless dispersant content is less than 0.5% by mass, the effects of improving the fatigue life and extreme-pressure property will be insufficient, while if it exceeds 10.0% by mass the cold flow property of the composition will be significantly impaired. When the lubricating oil composition for a power train device according to the invention is used as a lubricating oil especially for an automatic transmission or continuously variable transmission, the ashless dispersant content is preferably 1-6% by mass based on the total weight of the composition. When the lubricating oil composition for a power train device according to the invention is used as a lubricating oil especially for a manual transmission, the ashless dispersant content is preferably 0.5-6% by mass and more preferably 0.5-2% by mass based on the total weight of the composition.

The lubricating oil composition for a power train device according to the invention preferably also comprises a metallic detergent from the viewpoint of further improving the frictional properties. As specific examples of metallic detergents there may be mentioned alkaline earth metal sulfonates, alkaline earth metal phenates and alkaline earth metal salicylates, and any one or more than one of such metallic detergents may be used. Specific examples and preferred embodiments of metallic detergents to be used in the lubricating oil composition for a power train device according to the invention are the same as for metallic detergents to be used in the lubricating oil composition for an internal combustion engine according to the invention, and will not be explained again here.

When a metallic detergent is included in the lubricating oil composition for a power train device according to the invention, its content is not particularly restricted but is preferably 0.005-0.5% by mass, more preferably 0.008-0.3% by mass and even more preferably 0.01-0.2% by mass in terms of metal elements based on the total weight of the composition.

If the metallic detergent content is less than 0.005% by mass in terms of metal elements, the effect of improvement in the frictional properties will be insufficient, while if it exceeds 0.5% by mass an adverse effect may be exerted on the friction material of the wet clutch. When the lubricating oil composition for a power train device according to the invention is used as a lubricating oil especially for an automatic transmission or continuously variable transmission, the metallic detergent content is preferably 0.005-0.2% by mass and more preferably 0.008-0.02% by mass in terms of metal elements based on the total weight of the composition. When the lubricating oil composition for a power train device according to the invention is used as a lubricating oil especially for a manual transmission, the metallic detergent content is preferably 0.05-0.5% by mass, more preferably 0.1-0.4% by mass and even more preferably 0.2-0.35% by mass in terms of metal elements based on the total weight of the composition.

The lubricating oil composition for a power train device according to the invention preferably also comprises an antioxidant from the viewpoint of further improving the heat and oxidation stability. As antioxidants there may be used any of those ordinarily used in the field of lubricating oils, but phenolic antioxidants and/or amine antioxidants are preferred, and most preferred are combinations of phenolic antioxidants and amine antioxidants.

As antioxidants there may be mentioned, specifically, alkylphenols such as 2-6-di-tert-butyl-4-methylphenol, bisphenols such as methylene-4,4-bisphenol(2,6-di-tert-butyl-4-methylphenol), naphthylamines such as phenyl-α-naphthylamine, dialkyldiphenylamines, and esters of (3,5-di-tert-butyl-4-hydroxyphenyl) fatty acids, (propionic acid and the like) or (3-methyl-5-tertbutyl-4-hydroxyphenyl) fatty acids (propionic acid and the like) with monohydric or polyhydric alcohols such as methanol, octanol, octadecanol, 1,6hexadiol, neopentyl glycol, thiodiethyleneglycol, triethyleneglycol, pentaerythritol and the like. Zinc dialkyldithiophosphates such as zinc di-2-ethylhexyldithiophosphate may also be used as antioxidants.

The lubricating oil composition for a power train device according to the invention may comprise one or more compounds selected as desired from among the aforementioned antioxidants in any desired amounts. There are no particular restrictions on the antioxidant content, but it is preferably 0.01-5.0% by mass based on the total weight of the composition.

The lubricating oil composition for a power train device according to the invention preferably also comprises a friction modifier from the viewpoint of further improving the frictional properties in transmission wet clutches. As friction modifiers there may be used any compounds ordinarily used as friction modifiers in the field of lubricating oils, but preferred are amine compounds, imide compounds, fatty acid esters, fatty acid amides, fatty acid metal salts and the like having at least one C6-30 alkyl or alkenyl, and especially C6-30 straight-chain alkyl or straight-chain alkenyl group in the molecule.

Examples of amine compounds include C6-30 straight-chain or branched and preferably straight-chain aliphatic monoamines, straight-chain or branched and preferably straight-chain aliphatic polyamines, or alkylene oxide addition products of these aliphatic amines. As imide compounds there may be mentioned succiniimides with C6-30 straight chain or branched alkyl or alkenyl groups, and/or the same compounds modified by carboxylic acids, boric acid, phosphoric acid, sulfuric acid or the like. Examples of fatty acid esters include esters of C7-31 straight-chain or branched and preferably straight-chain fatty acids with aliphatic monohydric alcohols or aliphatic polyhydric alcohols. Examples of fatty acid amides include amides of C7-31 straight-chain or branched and preferably straight-chain fatty acids with aliphatic monoamines or aliphatic polyamines. As fatty acid metal salts there may be mentioned alkaline earth metal salts (magnesium salts, calcium salts and the like) or zinc salts of C7-31 straight-chain or branched and preferably straight-chain fatty acids.

The lubricating oil composition for a power train device according to the invention preferably comprises one or more selected from among amine friction modifiers, ester-based friction modifiers, amide friction modifiers and fatty acidic friction modifiers, and from the viewpoint of improving the fatigue life, it most preferably comprises one or more selected from among amine friction modifiers, fatty acidic friction modifiers and amide friction modifiers. When the lubricating oil composition for a power train device according to the invention is used as a lubricating oil especially for an automatic transmission or continuously variable transmission, it most preferably comprises an imide friction modifier from the viewpoint of achieving significant improvement in anti-shudder life.

The lubricating oil composition for a power train device according to the invention may contain any one or more selected from among the friction modifiers mentioned above in any desired amounts. The friction modifier content is preferably 0.01-5.0% by mass and more preferably 0.03-3.0% by mass based on the total weight of the composition. Since it is necessary to further improve the frictional properties when the lubricating oil composition for a power train device according to the invention is used as a lubricating oil for an automatic transmission or continuously variable transmission, the friction modifier content is preferably 0.5-5% by mass and more preferably 2-4% by mass based on the total weight of the composition. Also, when the lubricating oil composition for a power train device according to the invention is used as a lubricating oil for a manual transmission, the friction modifier content is preferably 0.1-3% by mass and more preferably 0.5-1.5% by mass based on the total weight of the composition.

In addition to the additives mentioned above, the lubricating oil composition for a power train device according to the invention may also contain other additives as necessary, such as corrosion inhibitors, rust-preventive agents, demulsifiers, metal deactivating agents, pour point depressants, rubber swelling agents, antifoaming agents, coloring agents and the like, either alone or in combinations of more than one, in order to achieve even better performance. Specific examples of these additives and their contents are the same as for the lubricating oil composition for an internal combustion engine according to the invention, and will not be explained again here.

The lubricating oil composition for a power train device according to the invention having the construction described above, even when having a low viscosity, can achieve a high level of antiwear property, anti-seizing property and fatigue life for long periods and exhibit both fuel savings and durability for power train devices while also providing improvement in the cold startability. There are no particular restrictions on the power train devices to which the lubricating oil composition for a power train device according to the invention may be applied, and specifically there may be mentioned transmissions such as automatic transmissions, continuously variable transmissions and manual transmissions, as well as final reduction gears, power distribution/regulating mechanisms and the like. Preferred embodiments of the invention will now be explained in detail, for (I) the lubricating oil composition for an automatic transmission or a continuously variable transmission, (II) the lubricating oil composition for a manual transmission and (III) the lubricating oil composition for a final reduction gear.

In the (I) lubricating oil composition for an automatic transmission or continuously variable transmission, the kinematic viscosity at 100° C. of the lubricating base oil of the invention is preferably 2-8 $mm^2/s$, more preferably 2.6-4.5 $mm^2/s$, even more preferably 2.8-4.3 $mm^2/s$ and most preferably 3.3-3.8 $mm^2/s$. If the kinematic viscosity is below the aforementioned lower limit the lubricity will tend to be insufficient, while if it is above the aforementioned upper limit the cold flow property will tend to be insufficient.

In the (I) lubricating oil composition for an automatic transmission or continuously variable transmission, the kinematic viscosity at 40° C. of the lubricating base oil of the invention is preferably 15-50 $mm^2/s$, more preferably 20-40 $mm^2/s$ and even more preferably 25-35 $mm^2/s$. If the kinematic viscosity is below the aforementioned lower limit the lubricity will tend to be insufficient, while if it is above the aforementioned upper limit the fuel savings will tend to be insufficient due to increased stirring resistance.

In the (I) lubricating oil composition for an automatic transmission or continuously variable transmission, the viscosity index of the lubricating base oil of the invention is preferably 120-160, more preferably 125-150 and even more preferably 130-145. If the viscosity index is within the aforementioned range, the viscosity-temperature characteristic will be improved to a superior degree.

As phosphorus-containing compounds in the (I) lubricating oil composition for an automatic transmission or continuously variable transmission there are preferred one or more selected from among phosphoric acid, phosphoric acid esters, phosphorous acid, phosphorous acid esters, thiophosphoric acid, thiophosphoric acid esters, thiophosphorous acid and thiophosphorous acid esters, as well as their salts, there are more preferred one or more selected from among phosphoric acid, phosphoric acid esters, phosphorous acid and phosphorous acid esters, as well as their salts, and there are even more preferred one or more selected from among phosphoric acid esters and phosphorous acid esters, as well as their salts.

The phosphorus-containing compound content in the (I) lubricating oil composition for an automatic transmission or continuously variable transmission is preferably 0.005-0.1% by mass, more preferably 0.01-0.05% by mass and even more preferably 0.02-0.04% by mass in terms of phosphorus element based on the total weight of the composition. If the phosphorus-containing compound content is below the aforementioned lower limit the lubricity will tend to be insufficient, while if it is above the aforementioned upper limit the wet frictional properties and fatigue life will tend to be insufficient.

The −40° C. Brookfield (BF) viscosity of the (I) lubricating oil composition for an automatic transmission or continuously variable transmission according to the invention is preferably no greater than 20,000 mPa·s, more preferably no greater than 15,000 mPa·s, even more preferably no greater than 10,000 mPa·s, yet more preferably no greater than 8,000 mPa·s and most preferably no greater than 7,000 mPa·s. If the BF viscosity is above the aforementioned upper limit, the cold startability will tend to be insufficient.

The viscosity index of the (I) lubricating oil composition for an automatic transmission or continuously variable transmission is preferably 100-250, more preferably 150-250 and even more preferably 170-250. If the viscosity index is below this lower limit, the fuel savings will tend to be insufficient. A composition exceeding the aforementioned upper limit will have an excessively high poly(meth)acrylate-based viscosity index improver content, and the shear stability will tend to be insufficient.

The kinematic viscosity at 100° C. of the lubricating base oil of the invention in the (II) lubricating oil composition for a manual transmission is preferably 3.0-20 $mm^2/s$, more preferably 3.3-15 $mm^2/s$, even more preferably 3.3-8 $mm^2/s$, yet more preferably 3.8-6 $mm^2/s$ and most preferably 4.3-5.5 $mm^2/s$. If the kinematic viscosity is below the aforementioned lower limit the lubricity will tend to be insufficient, while if it is above the aforementioned upper limit the cold flow property will tend to be insufficient.

The kinematic viscosity at 40° C. of the lubricating base oil of the invention in the (II) lubricating oil composition for a manual transmission is preferably 10-200 $mm^2/s$, more preferably 15-80 $mm^2/s$, even more preferably 20-70 $mm^2/s$ and most preferably 23-60 $mm^2/s$. If the kinematic viscosity is below the aforementioned lower limit the lubricity will tend to be insufficient, while if it is above the aforementioned upper limit the fuel savings will tend to be insufficient due to increased stirring resistance.

In the (II) lubricating oil composition for a manual transmission, the viscosity index of the lubricating base oil of the invention is preferably 130-170, more preferably 135-165 and even more preferably 140-160. If the viscosity index is within the aforementioned range, the viscosity-temperature characteristic will be improved to a superior degree.

As phosphorus-containing compounds in the (II) lubricating oil composition for a manual transmission there are preferred one or more selected from among thiophosphoric acid, thiophosphoric acid esters, thiophosphorous acid and thiophosphorous acid esters, there are more preferred one or more selected from among thiophosphoric acid esters and thiophosphorous acid esters, and zinc dithiophosphate is most preferred.

The phosphorus-containing compound content in the (II) lubricating oil composition for a manual transmission is preferably 0.01-0.2% by mass, more preferably 0.05-0.15% by mass and even more preferably 0.09-0.14% by mass in terms of phosphorus element based on the total weight of the composition. If the phosphorus-containing compound content is below the aforementioned lower limit the lubricity and synchro property will tend to be insufficient, while if it is above the aforementioned upper limit the heat and oxidation stability and fatigue life will tend to be insufficient.

The −40° C. BF viscosity of the (II) lubricating oil composition for a manual transmission is preferably no greater than 20,000 mPa·s, more preferably no greater than 15,000 mPa·s, even more preferably no greater than 10,000 mPa·s, yet more preferably no greater than 9,000 mPa·s and most preferably no greater than 8,000 mPa·s. If the BF viscosity is above the aforementioned upper limit, the cold startability will tend to be insufficient.

The viscosity index of the (II) lubricating oil composition for a manual transmission is preferably 100-250, more preferably 140-250 and even more preferably 150-250. If the viscosity index is below this lower limit, the fuel savings will tend to be insufficient. A composition exceeding the aforementioned upper limit will have an excessively high poly (meth)acrylate-based viscosity index improver content, and the shear stability will tend to be insufficient.

The kinematic viscosity at 100° C. of the lubricating base oil of the invention in the (III) lubricating oil composition for a final reduction gear is preferably 3.0-20 $mm^2/s$, more preferably 3.3-15 $mm^2/s$, even more preferably 3.3-8 $mm^2/s$, yet more preferably 3.8-6 $mm^2/s$ and most preferably 4.3-5.5 $mm^2/s$. If the kinematic viscosity is below the aforementioned lower limit the lubricity will tend to be insufficient, while if it is above the aforementioned upper limit the cold flow property will tend to be insufficient.

The kinematic viscosity at 40° C. of the lubricating base oil of the invention in the (III) lubricating oil composition for a final reduction gear is preferably 15-200 $mm^2/s$, more preferably 20-150 $mm^2/s$ and even more preferably 23-80 $mm^2/s$. If the kinematic viscosity is below the aforementioned lower limit the lubricity will tend to be insufficient, while if it is above the aforementioned upper limit the fuel savings will tend to be insufficient due to increased stirring resistance.

In the (III) lubricating oil composition for a final reduction gear, the viscosity index of the lubricating base oil of the invention is preferably 130-170, more preferably 135-165 and even more preferably 140-160. If the viscosity index is within the aforementioned range, the viscosity-temperature characteristic will be improved to a superior degree.

As phosphorus-containing compounds in the (III) lubricating oil composition for a final reduction gear there are preferred one or more selected from among phosphoric acid esters, phosphorous acid esters, thiophosphoric acid esters, thiophosphorous acid esters and their salts, there are more preferred one or more selected from among phosphoric acid esters, phosphorous acid esters and their amine salts, and there are even more preferred one or more selected from among phosphorous acid esters, their amine salts and phosphoric acid esters.

The phosphorus-containing compound content in the (III) lubricating oil composition for a final reduction gear is preferably 0.01-0.2% by mass, more preferably 0.05-0.15% by mass and even more preferably 0.1-0.14% by mass in terms of phosphorus element based on the total weight of the composition. If the phosphorus-containing compound content is below the aforementioned lower limit the lubricity will tend to be insufficient, while if it is above the aforementioned upper limit the fatigue life will tend to be insufficient.

The −40° C. BF viscosity of the (III) lubricating oil composition for a final reduction gear according to the invention is preferably no greater than 100,000 mPa·s, more preferably no greater than 50,000 mPa·s, even more preferably no greater than 20,000 mPa·s and yet more preferably no greater than 10,000 mPa·s. If the BF viscosity is above the aforementioned upper limit, the cold startability will tend to be insufficient.

The viscosity index of the (III) lubricating oil composition for a final reduction gear is preferably 100-250, more preferably 120-250 and even more preferably 125-250. If the viscosity index is below this lower limit, the fuel savings will tend to be insufficient. A composition exceeding the aforementioned upper limit will have an excessively high poly (meth)acrylate-based viscosity index improver content, and the shear stability will tend to be insufficient.

EXAMPLES

The present invention will now be explained in greater detail based on examples and comparative examples, with the understanding that these examples are in no way limitative on the invention.

Examples 1-3

The fraction separated by vacuum distillation in the step of refining a solvent refined base oil was subjected to solvent extraction with furfural and then to hydrocracking, after which solvent dewaxing was performed with a methyl ethyl ketone-toluene mixed solvent. The slack wax removed during the solvent dewaxing was deoiled to obtain a wax portion (hereinafter referred to as "WAX1") for use as a lubricating base oil starting material. The properties of WAX1 are shown in Table 1.

TABLE 1

| | |
|---|---|
| Starting material wax name | WAX1 |
| Kinematic viscosity at 100° C. ($mm^2/s$) | 6.8 |
| Melting point (° C.) | 58 |
| Oil portion (% by mass) | 6.3 |
| Sulfur content (ppm by mass) | 900 |

WAX1 was subjected to hydrocracking in the presence of a hydrocracking catalyst, under conditions with a hydrogen partial pressure of 5 MPa, a mean reaction temperature of 350° C. and an LHSV of 1 $hr^{-1}$. The hydrocracking catalyst used was a sulfurized catalyst comprising 3% by mass nickel and 15% by mass molybdenum supported on an amorphous silica-alumina carrier (silica:alumina=20:80 (weight ratio)).

The decomposition product obtained by the hydrocracking was then subjected to vacuum distillation to obtain a lube-oil fraction at 26% by volume with respect to the feed stock oil. The lube-oil fraction was subjected to solvent dewaxing using a methyl ethyl ketone-toluene mixed solvent under conditions with a solvent/oil ratio of 4 and a filtration temperature of −25° C., to obtain lubricating base oils for Examples 1-3 (D1-D3) having different viscosity grades.

The properties and the performance evaluation test results of the lubricating base oils of Examples 1-3 are shown in Tables 2 to 4. The properties and performance evaluation test results for conventional high viscosity index base oils R1-R9 as Comparative Examples 1-9 are also shown in Tables 2 to 4.

TABLE 2

| | | | Example 1 | Comp. Ex. 1 | Comp. Ex. 2 | Comp. Ex. 3 |
|---|---|---|---|---|---|---|
| Base oil name | | | D1 | R1 | R2 | R3 |
| Starting material wax name | | | WAX1 | — | — | — |
| Base oil composition (/total base oil) | Saturated compounds | % by mass | 99.1 | 93.8 | 99.3 | 99.6 |
| | Aromatic compounds | % by mass | 0.5 | 6.0 | 0.5 | 0.3 |
| | Polar compounds | % by mass | 0.4 | 0.2 | 0.2 | 0.1 |
| Saturated compounds (/total saturated content) | Cyclic saturated | % by mass | 1.0 | 46.5 | 42.1 | 45.7 |
| | Non-cyclic saturated | % by mass | 99.0 | 53.5 | 57.9 | 54.3 |
| Non-cyclic saturated content (/total base oil) | Straight-chain paraffins | % by mass | 0.1 | 0.4 | 0.1 | 0.1 |
| | Branched paraffins | % by mass | 98.0 | 49.8 | 57.4 | 54.0 |

TABLE 2-continued

| | | | Example 1 | Comp. Ex. 1 | Comp. Ex. 2 | Comp. Ex. 3 |
|---|---|---|---|---|---|---|
| n-d-M ring analysis | % $C_P$ | | 92.2 | 75.4 | 72.9 | 72.6 |
| | % $C_N$ | | 7.8 | 23.2 | 26.0 | 27.4 |
| | % $C_A$ | | 0.0 | 1.4 | 1.1 | 0.0 |
| | % $C_P$/% $C_N$ | | 11.8 | 3.3 | 2.8 | 2.7 |
| Sulfur content | | ppm by mass | <1 | <1 | <1 | <1 |
| Nitrogen content | | ppm by mass | <3 | <3 | <3 | <3 |
| Refractive index (20° C.) $n_{20}$ | | | 1.4497 | 1.4597 | 1.4606 | 1.4611 |
| Kinematic viscosity (40° C.) | | $mm^2/s$ | 10.4 | 9.4 | 9.7 | 12.6 |
| Kinematic viscosity (100° C.) kv100 | | $mm^2/s$ | 2.8 | 2.6 | 2.6 | 3.1 |
| Viscosity index | | | 125 | 109 | 98 | 105 |
| $n_{20}$-0.002 × kv100 | | | 1.444 | 1.455 | 1.455 | 1.455 |
| Density (15° C.) | | $g/cm^3$ | 0.809 | 0.829 | 0.831 | 0.835 |
| Pour point | | ° C. | −22.5 | −27.5 | −17.5 | −27.5 |
| Aniline point | | ° C. | 114 | 104 | 104 | 107 |
| Distillation properties | IBP [° C.] | ° C. | 336 | 243 | 249 | 288 |
| | T10 [° C.] | ° C. | 360 | 312 | 317 | 350 |
| | T50 [° C.] | ° C. | 388 | 377 | 386 | 389 |
| | T90 [° C.] | ° C. | 426 | 418 | 425 | 428 |
| | FBP [° C.] | ° C. | 467 | 492 | 499 | 529 |
| CCS viscosity (−35° C.) | | mPa · s | <1000 | <1000 | <1000 | <1000 |
| NOACK evaporation loss (250° C., 1 hour) | | % by mass | 35.7 | 51.9 | 62.7 | 58.7 |
| RBOT life (150° C.) | | min | 330 | 280 | 265 | 270 |
| Residual metals | Al | ppm by mass | <1 | <1 | <1 | <1 |
| | Mo | ppm by mass | <1 | <1 | <1 | <1 |
| | Ni | ppm by mass | <1 | <1 | <1 | <1 |

TABLE 3

| | | | Example 2 | Comp. Ex. 4 | Comp. Ex. 5 | Comp. Ex. 6 |
|---|---|---|---|---|---|---|
| Base oil name | | | D2 | R4 | R5 | R6 |
| Starting material wax name | | | WAX1 | — | — | — |
| Base oil composition (/total base oil) | Saturated compounds | % by mass | 98.9 | 94.8 | 94.8 | 99.9 |
| | Aromatic compounds | % by mass | 0.6 | 5.2 | 5.0 | 0.1 |
| | Polar compounds | % by mass | 0.5 | 0.0 | 0.2 | 0.0 |
| Saturated compounds (/total saturated content) | Cyclic saturated | % by mass | 1.4 | 46.8 | 42.3 | 46.0 |
| | Non-cyclic saturated | % by mass | 98.6 | 53.2 | 57.7 | 54.0 |
| Non-cyclic saturated content (/total base oil) | Straight-chain paraffins | % by mass | 0.1 | 0.1 | 0.1 | 0.1 |
| | Branched paraffins | % by mass | 97.4 | 50.3 | 54.6 | 53.8 |
| n-d-M ring analysis | % $C_P$ | 89.1 | 78.0 | 78.1 | 80.7 | |
| | % $C_N$ | 10.6 | 20.7 | 20.6 | 19.3 | |
| | % $C_A$ | 0.3 | 1.3 | 0.7 | 0.0 | |
| | % $C_P$/% $C_N$ | 8.4 | 3.8 | 3.8 | 4.2 | |
| Sulfur content | | ppm by mass | 2 | 2 | 1 | <1 |
| Nitrogen content | | ppm by mass | <3 | 4 | 3 | <3 |
| Refractive index (20° C.) $n_{20}$ | | | 1.4537 | 1.4640 | 1.4633 | 1.4625 |
| Kinematic viscosity (40° C.) | | $mm^2/s$ | 17.3 | 18.7 | 18.1 | 19.9 |
| Kinematic viscosity (100° C.) kv100 | | $mm^2/s$ | 4.1 | 4.1 | 4.0 | 4.3 |
| Viscosity index | | | 143 | 121 | 119 | 125 |
| $n_{20}$-0.002 × kv100 | | | 1.445 | 1.456 | 1.454 | 1.454 |
| Density (15° C.) | | $g/cm^3$ | 0.825 | 0.839 | 0.836 | 0.835 |
| Pour point | | ° C. | −20 | −22.5 | −27.5 | −17.5 |
| Aniline point | | ° C. | 120 | 112 | 112 | 116 |
| Distillation properties | IBP [° C.] | ° C. | 353 | 325 | 309 | 314 |
| | T10 [° C.] | ° C. | 386 | 383 | 385 | 393 |
| | T50 [° C.] | ° C. | 432 | 420 | 425 | 426 |
| | T90 [° C.] | ° C. | 470 | 458 | 449 | 459 |
| | FBP [° C.] | ° C. | 499 | 495 | 489 | 505 |
| CCS viscosity (−35° C.) | | mPa · s | 1890 | 3500 | 2900 | 3000 |
| NOACK evaporation loss (250° C., 1 hour) | | % by mass | 13.5 | 16.1 | 16.5 | 14.5 |
| RBOT life (150° C.) | | min | 380 | 300 | 330 | 340 |
| Residual metals | Al | ppm by mass | <1 | <1 | <1 | <1 |
| | Mo | ppm by mass | <1 | <1 | <1 | <1 |
| | Ni | ppm by mass | <1 | <1 | <1 | <1 |

TABLE 4

| | | | Example 3 | Comp. Ex. 7 | Comp. Ex. 8 | Comp. Ex. 9 |
|---|---|---|---|---|---|---|
| Base oil name | | | D3 | R7 | R8 | R9 |
| Starting material wax name | | | WAX1 | — | — | — |
| Base oil composition (/total base oil) | Saturated compounds | % by mass | 99.4 | 93.3 | 99.5 | 99.5 |
| | Aromatic compounds | % by mass | 0.4 | 6.6 | 0.4 | 0.4 |
| | Polar compounds | % by mass | 0.2 | 0.1 | 0.1 | 0.1 |
| Saturated compounds (/total saturated content) | Cyclic saturated | % by mass | 1.4 | 47.2 | 42.7 | 46.4 |
| | Non-cyclic saturated | % by mass | 98.6 | 52.8 | 57.3 | 53.6 |
| Non-cyclic saturated content (/total base oil) | Straight-chain paraffins | % by mass | 0.1 | 0.1 | 0.1 | 0.1 |
| | Branched paraffins | % by mass | 97.9 | 49.2 | 50.9 | 53.2 |
| n-d-M ring analysis | % $C_P$ | | 94.9 | 78.4 | 83.4 | 80.6 |
| | % $C_N$ | | 5.1 | 21.1 | 16.1 | 19.4 |
| | % $C_A$ | | 0.0 | 0.5 | 0.5 | 0.0 |
| | % $C_P$/% $C_N$ | | 18.6 | 3.7 | 5.2 | 4.2 |
| Sulfur content | | ppm by mass | 2 | <1 | <1 | <1 |
| Nitrogen content | | ppm by mass | <3 | <3 | <3 | <3 |
| Refractive index (20° C.) $n_{20}$ | | | 1.4583 | 1.4685 | 1.4659 | 1.4657 |
| Kinematic viscosity (40° C.) | | $mm^2/s$ | 38.2 | 37.9 | 32.7 | 33.9 |
| Kinematic viscosity (100° C.) kv100 | | $mm^2/s$ | 7.2 | 6.6 | 6.0 | 6.2 |
| Viscosity index | | | 155 | 129 | 131 | 133 |
| $n_{20}$-0.002 × kv100 | | | 1.444 | 1.455 | 1.454 | 1.453 |
| Density (15° C.) | | $g/cm^3$ | 0.826 | 0.847 | 0.838 | 0.841 |
| Pour point | | ° C. | −15 | −17.5 | −17.5 | −17.5 |
| Aniline point | | ° C. | 133 | 126 | 123 | 123 |
| Distillation properties | IBP [° C.] | ° C. | 424 | 317 | 308 | 310 |
| | T10 [° C.] | ° C. | 453 | 412 | 420 | 422 |
| | T50 [° C.] | ° C. | 485 | 477 | 469 | 472 |
| | T90 [° C.] | ° C. | 513 | 525 | 522 | 526 |
| | FBP [° C.] | ° C. | 541 | 576 | 566 | 583 |
| CCS viscosity (−35° C.) | | mPa · s | 9900 | >10,000 | >10,000 | >10,000 |
| NOACK evaporation loss (250° C., 1 hour) | | % by mass | 2.0 | 6.0 | 9.7 | 8.2 |
| RBOT life (150° C.) | | min | 440 | 380 | 390 | 370 |
| Residual metals | Al | ppm by mass | <1 | <1 | <1 | <1 |
| | Mo | ppm by mass | <1 | <1 | <1 | <1 |
| | Ni | ppm by mass | <1 | <1 | <1 | <1 |

[Light Stability Evaluation Test]

First, as measuring samples there were prepared each of the lubricating base oils of Examples 1-3 and Comparative Examples 1, 2, 4, 5, 7 and 8, and compositions comprising each of the lubricating base oils with addition of a phenolic antioxidant (2,6-di-tert-butyl-p-cresol; DBPC) at 0.2% by mass. A sunshine weather meter test device was used for 70 hours irradiation of each lubricating base oil or composition with light in a wavelength range of 400-750 nm to a mean temperature of 40° C. The color units of each lubricating base oil before and after light irradiation was evaluated with a Saybolt color units conforming to ASTM D 156-00. The results are shown in Tables 5-7.

TABLE 5

| | | | Example 1 | Comp. Ex. 1 | Comp. Ex. 2 |
|---|---|---|---|---|---|
| Base oil name | | | D1 | R1 | R2 |
| Saybolt color units | Before irradiation | | >+30 | +26 | >+30 |
| | After irradiation | DBPC non-added | <−16 | <−16 | <−16 |
| | | DBPC added | +28 | +5 | +11 |

TABLE 6

| | | | Example 2 | Comp. Ex. 4 | Comp. Ex. 5 |
|---|---|---|---|---|---|
| Base oil name | | | D2 | R4 | R5 |
| Saybolt color units | Before irradiation | | +26 | +24 | +25 |
| | After irradiation | DBPC non-added | <−16 | <−16 | <−16 |
| | | DBPC added | +23 | +6 | +5 |

TABLE 7

| | | | Example 3 | Comp. Ex. 7 | Comp. Ex. 8 |
|---|---|---|---|---|---|
| Base oil name | | | D3 | R7 | R8 |
| Saybolt color units | Before irradiation | | +24 | +22 | +23 |
| | After irradiation | DBPC non-added | <−16 | <−16 | <−16 |
| | | DBPC added | +20 | +6 | +9 |

The results shown in Tables 2 to 4 indicate that the lubricating base oils of Examples 1-3 had higher viscosity indexes and superior viscosity-temperature characteristics compared to the lubricating base oils of Comparative Examples 1-9. Upon comparing Example 1 with Comparative Examples 1-3, Example 2 with Comparative Examples 4-6 and Example 3 with Comparative Examples 7-9 based on the RBOT lives listed in Tables 2 to 4, and comparing Example 1 with Comparative Examples 1 and 2, Example 2 with Comparative Examples 4 and 5 and Example 3 with Comparative Examples 7 and 8 based on the light stability test results shown in Tables 5 to 7, it was found that the lubricating base oils of Examples 1-3 had longer lives at each viscosity grade, and were also superior in terms of heat and oxidation stability and antioxidant addition effects.

Example 4

A mixture of 800 g of USY-zeolite and 200 g of an alumina binder was kneaded and molded into a cylindrical shape with a diameter of 1/16 inch (approximately 1.6 mm) and a height of 6 mm. The obtained molded article was fired at 450° C. for 3 hours to obtain a carrier. The carrier was impregnated with an aqueous solution containing dichlorotetraamineplatinum (II) in an amount of 0.8% by mass of the carrier in terms of platinum, and then dried at 120° C. for 3 hours and fired at 400° C. for 1 hour to obtain the catalyst.

Next, 200 ml of the obtained catalyst was packed into a fixed-bed circulating reactor, and the reactor was used for hydrocracking/hydroisomerization of the paraffinic hydrocarbon-containing feed stock oil. The feed stock oil used in this step was FT wax with a paraffin content of 95% by mass and a carbon number distribution from 20 to 80 (hereinafter referred to as "WAX2"). The properties of WAX2 are shown in Table 8. The conditions for the hydrocracking were a hydrogen pressure of 3 MPa, a reaction temperature of 350° C. and an LHSV of 2.0 $h^{-1}$, and a decomposition/isomerization product oil was obtained comprising 30% by mass of the fraction with a boiling point of 380° C. and below (decomposition product) with respect to the starting material (30% cracking severity).

TABLE 8

| | |
|---|---|
| Starting material wax name | WAX2 |
| Kinematic viscosity at 100° C. ($mm^2/s$) | 5.8 |
| Melting point (° C.) | 70 |
| Oil portion (% by mass) | <1 |
| Sulfur content (ppm by mass) | <0.2 |

The decomposition/isomerization product oil obtained by the hydrocracking/hydroisomerization step described above was then subjected to vacuum distillation to obtain a lube-oil fraction. The lube-oil fraction was subjected to solvent dewaxing using a methyl ethyl ketone-toluene mixed solvent under conditions with a solvent/oil ratio of 4 and a filtration temperature of −25° C., to obtain lubricating base oils for Examples 4-6 (D4-D6) having different viscosity grades. The properties and performance evaluation test results for the lubricating base oils of Examples 4-6 are shown in Table 9.

TABLE 9

| | | | Example 4 | Example 5 | Example 6 |
|---|---|---|---|---|---|
| Base oil name | | | D4 | D5 | D6 |
| Starting material wax name | | | WAX2 | WAX2 | WAX2 |
| Base oil composition | Saturated compounds | % by mass | 99.2 | 99.5 | 99.3 |
| (/total base oil) | Aromatic compounds | % by mass | 0.3 | 0.3 | 0.2 |
| | Polar compounds | % by mass | 0.5 | 0.2 | 0.5 |
| Saturated compounds | Cyclic saturated | % by mass | 1.0 | 1.2 | 1.2 |
| (/total saturated content) | Non-cyclic saturated | % by mass | 99.0 | 98.8 | 98.8 |
| Non-cyclic saturated content | Straight-chain paraffins | % by mass | — | — | — |
| (/total base oil) | Branched paraffins | % by mass | — | — | — |
| n-d-M ring analysis | % $C_P$ | | 94.5 | 93.3 | 95.3 |
| | % $C_N$ | | 5.5 | 6.7 | 4.7 |
| | % $C_A$ | | 0.0 | 0.0 | 0.0 |
| | % $C_P$/% $C_N$ | | 17.2 | 13.9 | 20.3 |
| Sulfur content | | ppm by mass | <1 | <1 | <1 |
| Nitrogen content | | ppm by mass | <3 | <3 | <3 |
| Refractive index (20° C.) $n_{20}$ | | | 1.4502 | 1.4538 | 1.4593 |
| Kinematic viscosity (40° C.) | | $mm^2/s$ | 10.6 | 16.7 | 37.2 |
| Kinematic viscosity (100° C.) kv100 | | $mm^2/s$ | 2.8 | 3.9 | 7.0 |
| Viscosity index | | | 115 | 131 | 152 |
| $n_{20}$-0.002 × kv100 | | | 1.445 | 1.446 | 1.445 |
| Density (15° C.) | | $g/cm^3$ | 0.809 | 0.815 | 0.826 |
| Pour point | | ° C. | −22.5 | −20 | −15 |
| Aniline point | | ° C. | 114 | 121 | 133 |
| Distillation properties | IBP [° C.] | ° C. | 346 | 350 | 421 |
| | T10 [° C.] | ° C. | 362 | 384 | 450 |
| | T50 [° C.] | ° C. | 387 | 431 | 483 |
| | T90 [° C.] | ° C. | 423 | 467 | 510 |
| | FBP [° C.] | ° C. | 462 | 495 | 537 |
| CCS viscosity (−35° C.) | | mPa · s | — | 1970 | 14500 |
| NOACK evaporation loss (250° C., 1 hour) | | % by mass | 34.2 | 14.9 | 2.0 |
| RBOT life (150° C.) | | min | — | 398 | 433 |
| Residual metals | Al | ppm by mass | <1 | <1 | <1 |
| | Mo | ppm by mass | <1 | <1 | <1 |
| | Ni | ppm by mass | <1 | <1 | <1 |

The results shown in Table 9 indicate that the lubricating base oils of Examples 4-6 had higher viscosity indexes and superior viscosity-temperature characteristics compared to the lubricating base oils of Comparative Examples 1-9. Upon comparing Example 5 in Table 9 with Comparative Examples 4-6 in Table 3, and Example 6 in Table 9 with Comparative Examples 7-9 in Table 4, in terms of the RBOT lives, it was found that the lubricating base oils of Examples 4-6 had longer lives at each viscosity grade, and were also superior in terms of heat and oxidation stability and antioxidant addition effects.

Examples 7-15, Comparative Examples 10-13

Preparation of Internal Combustion Engine Lubricating Oil Compositions

For Examples 7-11 and 13-15, the lubricating base oil (D2) of Example 2 and the base oils and additives listed below were used to prepare internal combustion engine lubricating oil compositions having the compositions shown in Tables 10 and 12. For Example 12, the lubricating base oil (D5) of Example 5 and the base oils and additives listed below were used to prepare a lubricating oil composition having the composition shown in Table 11. For Comparative Examples 10-13, the base oils and additives listed below were used to prepare lubricating oil compositions having the compositions shown in Table 13. The sulfur contents, phosphorus contents, kinematic viscosities at 100° C., base numbers and acid numbers of the obtained compositions are shown in Tables 10 to 13.

(Base Oils)

Base oil 2: Paraffinic hydrotreated base oil (saturated content: 94.8% by mass, proportion of cyclic saturated compounds among saturated compounds: 46.8% by mass, sulfur content: <0.001% by mass, kinematic viscosity at 100° C.: 4.1 $mm^2/s$, viscosity index: 121, 20° C. refractive index: 1.4640, $n_{20}$−0.002×kv100: 1.456)

Base oil 3: Paraffinic solvent refined base oil (saturated content: 77% by mass, sulfur content: 0.12% by mass, kinematic viscosity at 100° C., 4.0 $mm^2/s$, viscosity index: 102)

(Ashless Antioxidants Containing no Sulfur as Constituent Element)

A1: Alkyldiphenylamine

A2: Octyl-3-(3,5-di-tert-butyl-4-hydroxyphenyl)propionate (Ash Antioxidant Containing Sulfur as Constituent Element, and Organic Molybdenum Compound)

B1: Ashless dithiocarbamate (sulfur content: 29.4% by mass)

B2: Molybdenum ditridecylamine complex (molybdenum content: 10.0% by mass)

(Antiwear Agent)

C1: Zinc dialkyldithiophosphate (phosphorus content: 7.4% by mass, alkyl group: primary octyl group)

C2: Zinc dialkyldithiophosphate (phosphorus content: 7.2% by mass, alkyl group: secondary butyl or secondary hexyl group mixture)

(Ashless Dispersant)

D1: Polybutenylsucciniimide (bis-type, weight-average molecular weight: 8,500, nitrogen content: 0.65% by mass)

(Ashless Friction Modifier)

E1: Glycerin fatty acid ester (MO50, product of Kao Corp.)

(Other Additives)

F1: Package containing metallic detergent, viscosity index improver, pour point depressant and antifoaming agent

[Heat and Oxidation Stability Evaluation Test]

The lubricating oil compositions of Examples 7-15 and Comparative Examples 10-13 were used for heat and oxidation stability testing (testing temperature: 165.5° C.) according to the method of JIS K 2514, Section 4 (ISOT), and the base number retention was determined after 24 and 72 hours. The results are shown in Tables 10-13.

[Frictional Property Evaluation Test: SRV (Translatory Oscillation Friction) Test]The lubricating oil compositions of Examples 7-15 and Comparative Examples 10-13 were subjected to the SRV test described hereunder, and the frictional properties were evaluated. A test piece (steel ball (diameter: 18 mm)/disc, SUJ-2) for an SRV tester by Optimol Co. was prepared and the surface was finished to a surface roughness (Ra) 0.2 μm. The test piece was mounted in the SRV tester by Optimol Co., each lubricating oil composition was dropped onto the sliding surface of the test piece for testing under conditions with a temperature of 80° C., a load of 30 N, an amplitude of 3 mm and a frequency of 50 Hz, and the mean frictional coefficient was measured from 15 minutes to 30 minutes after start of the test. The results are shown in Tables 10-13.

The lubricating oil compositions of Examples 7-15 and Comparative Examples 10-13 after 24 hours of the heat and oxidation stability evaluation test described above (hereinafter referred to as "used oils") were subjected to SRV testing in the same manner as above. The results are shown in Tables 10-13.

TABLE 10

| | | Example 7 | Example 8 | Example 9 | Example 10 | Example 11 |
|---|---|---|---|---|---|---|
| Components of lubricating base oil [% by mass] | D2 | 100 | 70 | 70 | 100 | 100 |
| | Base oil 2 | — | 30 | — | — | — |
| | Base oil 3 | — | — | 30 | — | — |
| Components of lubricating oil composition [% by mass] | Base oil | remainder | remainder | remainder | remainder | remainder |
| | A1 | 0.8 | 0.8 | 0.8 | 0.8 | 0.8 |
| | A2 | — | 0.5 | 0.5 | — | — |
| | B1 | — | — | — | — | 0.3 |
| | B2 (in terms of molybdenum) | (0.02) | (0.02) | (0.02) | (0.02) | — |
| | C1 | 0.1 | 0.1 | 0.1 | 0.2 | 0.1 |
| | C2 | 0.5 | 0.5 | 0.5 | 0.9 | 0.5 |
| | D1 | 4.0 | 4.0 | 4.0 | 4.0 | 4.0 |
| | E1 | 0.5 | 0.5 | 0.5 | 0.5 | 0.5 |
| | F1 | 10.0 | 10.0 | 10.0 | 10.0 | 10.0 |
| Sulfur content [% by mass] | | 0.13 | 0.13 | 0.17 | 0.19 | 0.22 |
| Phosphorus content [% by mass] | | 0.043 | 0.043 | 0.043 | 0.079 | 0.043 |
| Kinematic viscosity at 100° C. [$mm^2/s$] | | 10.2 | 10.2 | 10.2 | 10.2 | 10.2 |
| Base number (hydrochloric acid method) [mgKOH/g] | | 5.9 | 5.9 | 5.9 | 5.9 | 5.9 |
| Acid number[mgKOH/g] | | 2.4 | 2.4 | 2.4 | 2.4 | 2.4 |
| Heat and oxidation stability (Base number | After 24 hours | 81.4 | 74.6 | 76.3 | 81.4 | 78.0 |

TABLE 10-continued

| | | Example 7 | Example 8 | Example 9 | Example 10 | Example 11 |
|---|---|---|---|---|---|---|
| retention [%]) | After 72 hours | 52.5 | 40.7 | 44.1 | 47.5 | 59.3 |
| Frictional property (friction coefficient) | Fresh oil | 0.054 | 0.062 | 0.063 | 0.070 | 0.069 |
| | Used oil | 0.090 | 0.094 | 0.093 | 0.099 | 0.093 |

TABLE 11

| | | Example 12 |
|---|---|---|
| Components of lubricating base oil [% by mass] | D5 | 100 |
| | Base oil 2 | — |
| | Base oil 3 | — |
| Components of lubricating oil composition [% by mass] | Base oil | remainder |
| | A1 | 0.6 |
| | A2 | — |
| | B1 | — |
| | B2 (in terms of molybdenum) | (0.02) |
| | C1 | 0.1 |
| | C2 | 0.5 |
| | D1 | 4.0 |
| | E1 | 0.5 |
| | F1 | 10.0 |
| Sulfur content [% by mass] | | 0.13 |
| Phosphorus content [% by mass] | | 0.043 |
| Kinematic viscosity at 100° C. [$mm^2/s$] | | 10.2 |
| Base number (hydrochloric acid method) [mgKOH/g] | | 5.9 |
| Acid number [mgKOH/g] | | 2.4 |
| Heat and oxidation stability (Base number retention [%]) | After 24 hours | 81.4 |
| | After 72 hours | 55.9 |
| Frictional property (friction coefficient) | Fresh oil | 0.051 |
| | Used oil | 0.088 |

TABLE 12

| | | Example 13 | Example 14 | Example 15 |
|---|---|---|---|---|
| Components of lubricating base oil [% by mass] | D2 | 100 | 100 | 100 |
| | Base oil 2 | — | — | — |
| | Base oil 3 | — | — | — |
| Components of lubricating oil composition [% by mass] | Base oil | remainder | remainder | remainder |
| | A1 | 0.8 | — | — |
| | A2 | — | — | — |
| | B1 | — | 0.3 | — |
| | B2 (in terms of molybdenum) | — | (0.02) | — |
| | C1 | 0.1 | 0.1 | 0.1 |
| | C2 | 0.5 | 0.5 | 0.5 |
| | D1 | 4.0 | 4.0 | 4.0 |
| | E1 | 0.5 | 0.5 | 0.5 |
| | F1 | 10.0 | 10.0 | 10.0 |
| Sulfur content [% by mass] | | 0.13 | 0.22 | 0.13 |
| Phosphorus content [% by mass] | | 0.043 | 0.043 | 0.043 |
| Kinematic viscosity at 100° C. [$mm^2/s$] | | 10.2 | 10.2 | 10.2 |
| Base number (hydrochloric acid method) [mgKOH/g] | | 5.9 | 5.9 | 5.9 |
| Acid number [mgKOH/g] | | 2.4 | 2.4 | 2.4 |
| Heat and oxidation stability (Base number retention) | After 24 hours | 69.5 | 66.1 | 59.3 |
| | After 72 hours | 18.6 | 18.6 | 0.0 |
| Frictional property (friction coefficient) | Fresh oil | 0.078 | 0.065 | 0.063 |
| | Used oil | 0.125 | 0.120 | 0.130 |

TABLE 13

| | | Comp. Ex. 10 | Comp. Ex. 11 | Comp. Ex. 12 | Comp. Ex. 13 |
|---|---|---|---|---|---|
| Components of lubricating base oil [% by mass] | Base oil 2 | 100 | 70 | 100 | 100 |
| | Base oil 3 | — | 30 | — | — |
| Components of lubricating oil composition [% by mass] | Base oil | remainder | remainder | remainder | remainder |
| | A1 | 0.8 | 0.8 | 0.8 | — |
| | A2 | — | 0.5 | — | — |
| | B1 | 0.3 | — | — | — |
| | B2 (in terms of molybdenum) | (0.02) | (0.02) | — | — |
| | C1 | 0.1 | 0.1 | 0.1 | 0.1 |
| | C2 | 0.5 | 0.5 | 0.5 | 0.5 |
| | D1 | 4.0 | 4.0 | 4.0 | 4.0 |
| | E1 | 0.5 | 0.5 | 0.5 | 0.5 |
| | F1 | 10.0 | 10.0 | 10.0 | 10.0 |
| Sulfur content [% by mass] | | 0.22 | 0.17 | 0.13 | 0.13 |
| Phosphorus content [% by mass] | | 0.043 | 0.043 | 0.043 | 0.043 |
| Kinematic viscosity at 100° C. [$mm^2/s$] | | 10.2 | 10.2 | 10.2 | 10.2 |
| Base number (hydrochloric acid method) [mgKOH/g] | | 5.9 | 5.9 | 5.9 | 5.9 |
| Acid number [mgKOH/g] | | 2.4 | 2.4 | 2.4 | 2.4 |
| Heat and oxidation stability (Base number retention) | After 24 hours | 64.4 | 62.7 | 55.9 | 49.2 |
| | After 72 hours | 33.9 | 18.6 | 10.2 | 0.0 |

TABLE 13-continued

| | | Comp. Ex. 10 | Comp. Ex. 11 | Comp. Ex. 12 | Comp. Ex. 13 |
|---|---|---|---|---|---|
| Frictional property (friction coefficient) | Fresh oil | 0.070 | 0.082 | 0.085 | 0.070 |
| | Used oil | 0.101 | 0.125 | 0.133 | 0.152 |

As shown in Tables 10 and 11, the internal combustion engine lubricating oil compositions of Examples 7-15, and especially the internal combustion engine lubricating oil compositions of Examples 7-12, had low base number reduction rates after 24 hours in the oxidation stability test, and also had sufficient residual base numbers after 72 hours, and therefore exhibited excellent oxidation stability. The internal combustion engine lubricating oil compositions of Examples 7-15, and especially the internal combustion engine lubricating oil compositions of Examples 7-12, had low initial frictional coefficients, and also had frictional coefficients of less than 0.1 even after 24 hours in the oxidation stability test, and therefore exhibited excellent low friction retention.

On the other hand, the internal combustion engine lubricating oil compositions of Comparative Examples 10-13 had inferior base number retention, while the frictional coefficients were above 0.1 after 24 hours in the oxidation stability test, and therefore the low friction retention was poor.

Also, based on comparison of Examples 7 and 12 with Examples 13 and 15 and Comparative Example 10 with Comparative Examples 12 and 13, the internal combustion engine lubricating oil compositions of Examples 7 and 12 had notable improving effects on the base number retention, oxidation stability and low friction retention by addition of components (A) and (B).

Examples 16-19, Comparative Examples 20-22

Preparation of Automatic Transmission Lubricating Oil Compositions

For Examples 16-18, the aforementioned base oils D1 and D2 and base oil 4 and additives a1, a2, b1 and c1 described below were used to prepare lubricating oil compositions having the compositions listed in Table 14. For Example 19, the aforementioned base oils D4 and D5 and base oil 4 and additives a1, a2, b1 and c1 described below were used to prepare lubricating oil compositions having the compositions listed in Table 15. For Comparative Examples 20-22, the aforementioned base oils $R^1$ and $R^2$ and base oil 4 and additives a1, a2, b1, and c1 described below were used to prepare lubricating oil compositions having the compositions listed in Table 16. The kinematic viscosities at 40° C., viscosity indexes and phosphorus contents of the obtained lubricating oil compositions are shown in Tables 14-16.

(Base Oils)

Base oil 4: Paraffinic solvent refined base oil (saturated content: 60.1% by mass, aromatic portion: 35.7% by mass, resin portion: 4.2% by mass, sulfur content: 0.51% by mass, kinematic viscosity at 100° C.: 32 $mm^2/s$, viscosity index: 95)

(Viscosity Index Improver)

a1: Non-dispersant type polymethacrylate (copolymer of monomer mixture composed mainly of monomer wherein $R^{57}$ in general formula (26) is methyl or a C12-15 straight-chain alkyl group; weight-average molecular weight: 20,000)

a2: Dispersant type polymethacrylate (copolymer of monomer mixture composed mainly of monomer wherein $R^{57}$ in general formula (26) is methyl or a C12, 14, 16 or 18 straight-chain alkyl group, and including a nitrogen-containing monomer represented by general formula (27) or (28); weight-average molecular weight: 50,000)

(Phosphorus-Containing Compound)

b1: Mixture of phosphorous acid and phosphorous acid ester.

(Package Additive)

c1: Package additive (added to 12.0% by mass in lubricating oil composition, with the following contents in the lubricating oil composition: ashless dispersant: 4.0% by mass, alkaline earth metal sulfonate: 0.01% by mass (in terms of alkaline earth metal element), corrosion inhibitor: 0.1% by mass, antioxidant: 0.2% by mass, friction modifier: 3.5% by mass, rubber swelling agent: 1.0% by mass, antifoaming agent: 0.003% by mass, diluent: remainder).

The automatic transmission lubricating oil compositions of Examples 16-19 and Comparative Examples 20-22 were then used for the following evaluation test.

[Cold Flow Property Test]

The BF viscosities at −40° C. of the lubricating oil compositions were measured according to ASTM D 2983. The results are shown in Tables 14-16. In this test, a smaller BF viscosity value corresponds to a more excellent cold flow property.

[Shear Stability Test]

An ultrasonic shearing test was carried out under the following conditions according to JASO M347-95, and the kinematic viscosity at 100° C. of each lubricating oil composition after the test was measured. The results are shown in Tables 14-16. In this test, a smaller viscosity reduction after ultrasonic shearing and a higher value for the kinematic viscosity at 100° C. corresponds to more excellent shear stability.

(Test Conditions)

Test oil volume: 30 ml

Ultrasonic frequency: 10 kHz

Test oil temperature: 40° C.

Test time: 1 hour

[Wear Test]

A four ball test was conducted under the following conditions according to JPI-5S-32-90 and the wear scar diameter after the test was measured. The results are shown in Tables 14-16. In this test, a smaller wear scar diameter corresponds to more excellent antiwear property.

(Test Conditions)

Rotation rate: 1800 rpm

Load: 392 N

Test oil temperature: 75° C.

Test time: 1 hour

[Heat and Oxidation Stability Test]

First, the acid number of each lubricating oil composition was measured. Each lubricating oil composition was then subjected to forced aging by ISOT at 150° C. for 144 hours according to JIS K 2514, the acid number was measured, and the increase in acid number was determined from the measured acid numbers before and after the test. The results are shown in Tables 14-16. In this test, a smaller increase in acid number corresponds to more excellent heat and oxidation stability.

TABLE 14

| | | Example 16 | Example 17 | Example 18 |
|---|---|---|---|---|
| Components of lubricating base oil [% by mass] | D1 | 20 | 20 | 67 |
| | D2 | 80 | 80 | 23 |
| | Base oil 4 | — | — | 10 |
| Kinematic viscosity at 100° C. of lubricating oil base oil [$mm^2/s$] | | 3.8 | 3.8 | 3.7 |
| Viscosity index of lubricating oil base oil | | 140 | 140 | 129 |
| Components of lubricating oil composition [% by mass] | Base oil | remainder | remainder | remainder |
| | a1 | 7.0 | — | 6.0 |
| | a2 | — | 7.0 | — |
| | b1 (in terms of phosphorus element) | 0.03 | 0.03 | 0.03 |
| | c1 | 12.0 | 12.0 | 12.0 |
| Kinematic viscosity at 40° C. of lubricating oil composition [$mm^2/s$] | | 25 | 32 | 25 |
| Viscosity index of lubricating oil composition | | 184 | 215 | 180 |
| Phosphorus content of lubricating oil composition [% by mass] | | 0.03 | 0.03 | 0.03 |
| Cold flow property (BF viscosity at −40° C. [mPa · s]) | | 5900 | 7000 | 7500 |
| Shear stability (Kinematic viscosity at 100° C. [$mm^2/s$]) | | 5.6 | 6.7 | 5.6 |
| Antiwear property (Wear scar diameter [mm]) | | 0.45 | 0.44 | 0.45 |
| Heat and oxidation stability (Acid number increase [mgKOH/g]) | | −0.01 | −0.12 | −0.02 |

TABLE 15

| | | Example 20 |
|---|---|---|
| Components of lubricating base oil [% by mass] | D4 | 25 |
| | D5 | 75 |
| | Base oil 4 | — |
| Kinematic viscosity at 100° C. of lubricating base oil [$mm^2/s$] | | 3.6 |
| Viscosity index of lubricating base oil | | 127 |
| Components of lubricating oil composition [% by mass] | Base oil | remainder |
| | a1 | 6.7 |
| | a2 | — |
| | b1 (in terms of phosphorus element) | 0.03 |
| | c1 | 12.0 |
| Kinematic viscosity at 40° C. of lubricating oil composition [$mm^2/s$] | | 26 |
| Viscosity index of lubricating oil composition | | 172 |
| Phosphorus content of lubricating oil composition [% by mass] | | 0.03 |
| Cold flow property (BF viscosity at −40° C. [mPa · s]) | | 5600 |
| Shear stability (Kinematic viscosity at 100° C. [$mm^2/s$]) | | 5.6 |
| Antiwear property (Wear scar diameter [mm]) | | 0.45 |
| Heat and oxidation stability (Acid number increase [mgKOH/g]) | | 0.03 |

TABLE 16

| | | Comp. Ex. 20 | Comp. Ex. 21 | Comp. Ex. 22 |
|---|---|---|---|---|
| Components of lubricating base oil [% by mass] | Base oil 4 | — | — | 10 |
| | R1 | 25 | 25 | 55 |
| | R2 | 75 | 75 | 35 |
| Kinematic viscosity at 100° C. of lubricating base oil [$mm^2/s$] | | 3.6 | 3.6 | 3.6 |
| Viscosity index of lubricating base oil | | 118 | 118 | 113 |
| Components of lubricating oil composition [% by mass] | Base oil | remainder | remainder | remainder |
| | a1 | 7.0 | — | 6.0 |
| | a2 | — | 7.0 | — |
| | b1 (in terms of phosphorus element) | 0.03 | 0.03 | 0.03 |
| | c1 | 12.0 | 12.0 | 12.0 |
| Kinematic viscosity at 40° C. of lubricating oil composition [$mm^2/s$] | | 27 | 35 | 27 |
| Viscosity index of lubricating oil composition | | 164 | 195 | 157 |
| Phosphorus content of lubricating oil composition [% by mass] | | 0.03 | 0.03 | 0.03 |
| Cold flow property (BF viscosity at −40° C. [mPa · s]) | | 11000 | 16800 | 17000 |
| Shear stability (Kinematic viscosity at 100° C. [$mm^2/s$]) | | 5.4 | 6.5 | 5.5 |
| Antiwear property (Wear scar diameter [mm]) | | 0.51 | 0.50 | 0.48 |
| Heat and oxidation stability (Acid number increase [mgKOH/g]) | | 0.81 | 0.77 | 1.09 |

Examples 20-22, Comparative Examples 23, 24

Preparation of Manual Transmission Lubricating Oil Compositions

For Examples 20 and 21, the aforementioned base oils D2 and D3 and additive a1, and additives a3, b2 and c2 described below, were used to prepare lubricating oil compositions having the compositions listed in Table 17. For Example 22, the aforementioned base oils D5 and D6 and additive a1, and additives a3, b2 and c2 described below, were used to prepare lubricating oil compositions having the compositions listed in Table 17. For Comparative Examples 23 and 24, the aforementioned base oil $R^4$ and additive a1, and the aforementioned base oil $R^7$ and additives a3, b2 and c2, were used to prepare lubricating oil compositions having the compositions listed in Table 17. The kinematic viscosities at 40° C., viscosity indexes and phosphorus contents of the obtained lubricating oil compositions are shown in Tables 17-19.

(Viscosity Index Improvers)

a3: Non-dispersant polymethacrylate (copolymer of monomer mixture composed mainly of monomer wherein $R^{57}$ in general formula (26) is methyl or a C12, 14, 16 or 18 straight-chain alkyl group; weight-average molecular weight: 50,000)

(Phosphorus-Containing Compounds)

b2: Zinc dialkyldithiophosphate (mixture of Pri-ZDTP and Sec-ZDTP)

(Package Additive)

c2: Package additive (added to 6.8% by mass in lubricating oil composition, with the following contents in the lubricating oil composition: alkaline earth metal sulfonate: 0.25% by mass (in terms of alkaline earth metal element), corrosion inhibitor: 0.1% by mass, antioxidant: 0.5% by mass, friction modifier:

1.0% by mass, rubber swelling agent: 0.5% by mass, antifoaming agent: 0.001% by mass, diluent: remainder).

Next, the manual transmission lubricating oil compositions of Examples 20-22 and Comparative Examples 23 and 24 were subjected to the same testing as the automatic transmission lubricating oil compositions of Examples 16-19 and Comparative Examples 20-22, and the cold flow property, shear stability, antiwear property and heat and oxidation stability were evaluated. The results are shown in Table 17.

TABLE 17

| | | Example 20 | Example 21 | Example 22 | Comp. Ex. 23 | Comp. Ex. 24 |
|---|---|---|---|---|---|---|
| Components of lubricating base oil [% by mass] | D2 | 75 | 75 | — | — | — |
| | D3 | 25 | 25 | — | — | — |
| | D5 | — | — | 73 | — | — |
| | D6 | — | — | 27 | — | — |
| | R4 | — | — | — | 78 | 78 |
| | R7 | — | — | — | 22 | 22 |
| Kinematic viscosity at 100° C. of lubricating base oil [$mm^2/s$] | | 4.7 | 4.7 | 4.5 | 4.5 | 4.5 |
| Viscosity index of lubricating base oil | | 149 | 149 | 138 | 124 | 124 |
| Components of lubricating oil composition [% by mass] | Base oil | remainder | remainder | remainder | remainder | remainder |
| | a1 | 4.0 | — | 4.0 | 4.0 | — |
| | a3 | — | 15.4 | — | — | 15.4 |
| | b2 (in terms of phosphorus element) | 0.11 | 0.11 | 0.11 | 0.11 | 0.11 |
| | c2 | 6.8 | 6.8 | 6.8 | 6.8 | 6.8 |
| Kinematic viscosity 40° C. of lubricating oil composition [$mm^2/s$] | | 27 | 55 | 27 | 29 | 60 |
| Viscosity index of lubricating oil composition | | 177 | 215 | 170 | 149 | 199 |
| Phosphorus content of lubricating oil composition [% by mass] | | 0.11 | 0.11 | 0.11 | 0.11 | 0.11 |
| Cold flow property (BF viscosity at −40° C. [mPa · s]) | | 7500 | 15000 | 7700 | 13500 | 42000 |
| Shear stability (Kinematic viscosity at 100° C. [$mm^2/s$]) | | 5.8 | 9.2 | 5.7 | 5.6 | 8.7 |
| Antiwear property (Wear scar diameter [mm]) | | 0.38 | 0.35 | 0.36 | 0.44 | 0.41 |
| Heat and oxidation stability (Acid number increase [mgKOH/g]) | | 0.45 | 0.62 | — | 1.56 | 1.92 |

Example 23, Comparative Example 25

Preparation of Final Reduction Gear Lubricating Oil Compositions

For Example 23, the aforementioned base oils D2 and D3 and additive a1, and the additives b3 and c3 described below, were used to prepare lubricating oil compositions having the compositions listed in Table 18. For Comparative Example 25, the aforementioned base oils $R^4$ and $R^7$ and additive a1, and the additives b3 and c3 described below, were used to prepare lubricating oil compositions having the compositions listed in Table 18. The kinematic viscosities at 40° C., viscosity indexes and phosphorus contents of the obtained lubricating oil compositions are shown in Table 18.

(Phosphorus-Containing Compound)

b3: Mixture of phosphorous acid ester and phosphoric acid ester (Package Additive)

c3: Package additive (added to 7.0% by mass in lubricating oil composition, with the following contents in the lubricating oil composition: ashless dispersant: 1.0% by mass, sulfur-containing extreme-pressure agent: 2% by mass (in terms of sulfur element), corrosion inhibitor: 0.5% by mass, antioxidant: 0.3% by mass, rubber swelling agent: 0.2% by mass, antifoaming agent: 0.001% by mass, diluent: remainder)

The final reduction gear lubricating oil compositions of Example 23 and Comparative Example 25 were subjected to the same testing as the automatic transmission lubricating oil compositions of Examples 16-19 and Comparative Examples 20-22, and the cold flow property, shear stability and antiwear property were evaluated. The results are shown in Table 18.

TABLE 18

| | | Example 23 | Comp. Ex. 25 |
|---|---|---|---|
| Components of lubricating base oil [% by mass] | D2 | 75 | — |
| | D3 | 25 | — |
| | R4 | — | 78 |
| | R7 | — | 22 |
| Kinematic viscosity at 100° C. of lubricating base oil [$mm^2/s$] | | 4.7 | 45 |
| Viscosity index of lubricating oil base oil | | 149 | 124 |
| Components of lubricating oil composition [% by mass] | Base oil | remainder | remainder |
| | a1 | 4.0 | 4.0 |
| | b3 (in terms of phosphorus element) | 0.10 | 0.10 |
| | c3 | 7.0 | 7.0 |
| Kinematic viscosity at 40° C. of lubricating oil composition [$mm^2/s$] | | 27 | 29 |

TABLE 18-continued

| | Example 23 | Comp. Ex. 25 |
|---|---|---|
| Viscosity index of lubricating oil composition | 176 | 149 |
| Phosphorus content of lubricating oil composition [% by mass] | 0.10 | 0.10 |
| Cold flow property (BF viscosity at −40° C. [mPa · s]) | 8600 | 12000 |
| Shear stability (Kinematic viscosity at 100° C. [$mm^2/s$]) | 5.7 | 5.5 |
| Antiwear property (Wear scar diameter [mm]) | 0.39 | 0.44 |

The invention claimed is:

1. A lubricating base oil having a saturated compound content of 95% by mass or greater, and a proportion of 0.5 to less than about 3% by mass of cyclic saturated compounds among the saturated compounds, wherein the lubricating base oil satisfies the condition represented by formula (I):

$$1.435 \leq n_{20} - 0.002 \times kv100 \leq 1.450 \quad (1)$$

wherein $n_{20}$ represents the refractive index of the lubricating base oil at 20° C. and kv100 represents the kinematic viscosity at 100° C. of the lubricating base oil, and wherein the unit of kv100 is $mm^2/s$.

2. A lubricating oil composition comprising a lubricating base oil according to claim 1.

3. A lubricating oil composition for an internal combustion engine, comprising:

a lubricating base oil according to claim 1, an ashless antioxidant containing no sulfur as a constituent element, and at least one compound selected from among ashless antioxidants containing sulfur as a constituent element and organic molybdenum compounds.

4. A lubricating oil composition for a power train device, comprising:

a lubricating base oil according to claim 1, a poly(meth)acrylate-based viscosity index improver, and a phosphorus-containing compound.

* * * * *